US010818279B1

(12) United States Patent
Swanson et al.

(10) Patent No.: US 10,818,279 B1
(45) Date of Patent: Oct. 27, 2020

(54) MUSICAL INPUT DEVICE WITH DYNAMIC CONFIGURATION

(71) Applicant: IRIJULE, INC., Benicia, CA (US)

(72) Inventors: Evan M. Swanson, Benicia, CA (US); Scott M. O'Hair, Benicia, CA (US)

(73) Assignee: IRIJULE, INC., Benicia, CA (US)

( * ) Notice: Subject to any disclaimer, the term of this patent is extended or adjusted under 35 U.S.C. 154(b) by 0 days.

(21) Appl. No.: 16/277,723

(22) Filed: Feb. 15, 2019

Related U.S. Application Data

(63) Continuation-in-part of application No. 15/950,043, filed on Apr. 10, 2018, now Pat. No. 10,269,335.

(60) Provisional application No. 62/485,083, filed on Apr. 13, 2017, provisional application No. 62/631,244, filed on Feb. 15, 2018.

(51) Int. Cl.
*G10H 1/18* (2006.01)
*G10H 1/38* (2006.01)
*G10H 1/00* (2006.01)

(52) U.S. Cl.
CPC ..... *G10H 1/186* (2013.01); *G10H 1/0008* (2013.01); *G10H 1/383* (2013.01); *G10H 2210/325* (2013.01); *G10H 2220/251* (2013.01)

(58) Field of Classification Search
CPC ..... G10H 1/186; G10H 1/0008; G10H 1/383; G10H 2210/325; G10H 2220/251
USPC ..... 84/609
See application file for complete search history.

(56) References Cited

U.S. PATENT DOCUMENTS 5,440,071 A * 8/1995 Johnson ..... G10H 1/34 84/637
5,646,648 A * 7/1997 Bertram ..... G06F 3/0219 341/22
5,856,795 A * 1/1999 Arnold ..... G06F 3/023 264/189
6,063,994 A * 5/2000 Kew ..... G10H 1/0008 84/600
6,351,225 B1 * 2/2002 Moreno ..... G06F 3/0219 341/22
6,444,888 B1 * 9/2002 VanDruff ..... G10H 1/20 84/423 R
7,394,010 B2 * 7/2008 Nishibori ..... G10H 1/06 84/464 A (Continued)

OTHER PUBLICATIONS

Donels, Jeffrey, "Non-final Office Action dated Oct. 18, 2018", U.S. Appl. No. 15/950,043, The United States Patent and Trademark Office, Oct. 18, 2018.

(Continued)

*Primary Examiner* — Jeffrey Donels
(74) *Attorney, Agent, or Firm* — Lindauer Law, PLLC

(57) ABSTRACT

A musical input device accepts user input and generates output data indicative of musical notes. Based on a selected musical scale, a first set of keys is configured, such that each key of the first set outputs a respective chord associated with the scale. A second set of keys may be configured to output individual notes from the scale, or chords that are associated with a different scale. The keys may be provided with visible indicia, such as a color indicating the root note of a chord. Visible indicia may indicate relationships between keys, such as a melody note that matches the root note of a chord. Control keys may be used to add notes to chords or modify notes in chords, such as by adding additional octaves to the output or modifying the voicing, inversion, or spread of a chord.

20 Claims, 28 Drawing Sheets

(56) References Cited

U.S. PATENT DOCUMENTS

| | | | | |
|---|---|---|---|---|
| 8,354,580 | B2 * | 1/2013 | Bowen | G10H 1/34 84/718 |
| 9,159,307 | B1 * | 10/2015 | Ludovici | G10H 1/0066 |
| 2003/0209130 | A1 * | 11/2003 | Anderson | G10H 1/34 84/443 |
| 2006/0123982 | A1 * | 6/2006 | Christensen | G10H 1/0066 84/723 |
| 2008/0173163 | A1 * | 7/2008 | Pratt | G10H 1/20 84/645 |
| 2009/0114078 | A1 * | 5/2009 | Plamondon | G10H 1/34 84/423 R |
| 2014/0033897 | A1 * | 2/2014 | Bludov | G10C 3/12 84/423 R |
| 2014/0076126 | A1 * | 3/2014 | Terry | G10H 1/34 84/609 |
| 2016/0232883 | A1 * | 8/2016 | Velez-Gallego | G10H 1/34 |
| 2017/0116970 | A1 * | 4/2017 | Ua-Aphithorn | G10D 11/00 |

OTHER PUBLICATIONS

Donels, Jeffrey, "Notice of Allowance dated Jan. 22, 2019", U.S. Appl. No. 15/950,043, The United States Patent and Trademark Office, Jan. 22, 2019.

* cited by examiner

MUSICAL INPUT DEVICE WITH DYNAMIC CONFIGURATION

PRIORITY

This application is a continuation-in-part of and claims priority to and the benefit of U.S. patent application Ser. No. 15/950,043, filed Apr. 10, 2018, entitled "Musical Input Device". application Ser. No. 15/950,043 claims priority to U.S. Provisional Patent Application No. 62/485,083, filed Apr. 13, 2017, entitled "Musical Input Device".

This application also claims priority to and the benefit of U.S. Provisional Patent Application No. 62/631,244 filed Feb. 15, 2018, entitled "Musical Input Device with Dynamic Configuration".

Application Ser. No. 15/950,043; 62/485,083; and 62/631,244 are each incorporated by reference herein in their entirety.

BACKGROUND

Expression through music is a uniquely human experience. Musical expression may, in some cases, involve a musician utilizing an instrument to produce a particular sound or set of sounds. Musicians continue to look for ways that allow them to play more efficiently, effectively, and easily.

BRIEF DESCRIPTION OF FIGURES

The detailed description is set forth with reference to the accompanying figures. In the figures, the left-most digit(s) of a reference number identifies the figure in which the reference number first appears. The use of the same reference numbers in different figures indicates similar or identical items or features.

Figure 1:
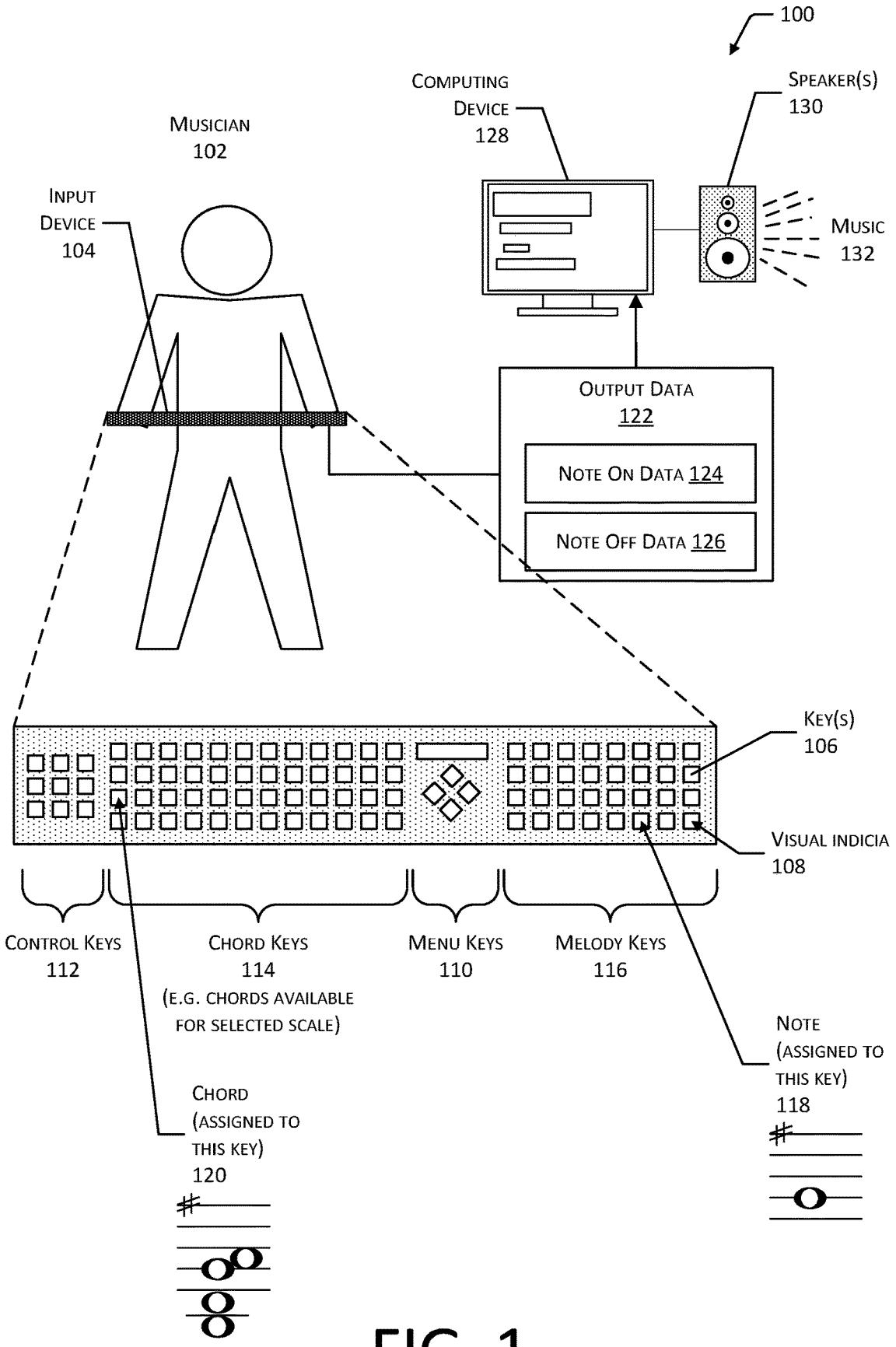
FIG. 1 depicts a system in which a musician uses an input device with chord keys and melody keys that may be used to play electronic musical instruments, according to one implementation.

Elements of the figures are presented by way of illustration and not necessarily as a limitation. Size, proportion, or other aspects of the figures may be exaggerated for clarity. While various implementations are described in this disclosure by way of example, those skilled in the art will recognize that the implementations are not limited to the examples or figures described. It should be understood that the figures and detailed description thereto are not intended to limit implementations to the particular form disclosed but, on the contrary, the intention is to cover all modifications, equivalents, and alternatives falling within the spirit and scope as defined by the appended claims. The headings used in this disclosure are for organizational purposes only and are not meant to be used to limit the scope of the description or the claims. As used throughout this application, the word "may" is used in a permissive sense (i.e., meaning having the potential to) rather than the mandatory sense (i.e., meaning must). Similarly, the words "include", "including", and "includes" mean "including, but not limited to".

DETAILED DESCRIPTION

A musician may utilize many tools to create music. These tools may include their own voice, other parts of their bodies, objects, mechanical instruments, or electronic instruments. The basic building blocks of music are scales, notes, and chords. A sound having a particular pitch (e.g., frequency) is represented by a musical note. Different musical notes represent different pitches. A musical scale ("scale") defines a particular set of notes that may be played together. Typically, a scale will span multiple notes between an octave. An octave is a musical interval between two notes in which the higher note of the octave has double the frequency of the lower note of the octave. As a result, notes that are separated by an interval of one or more octaves may produce a sound of "the same note", only with a higher or lower frequency. For example, a scale such as a B Phrygian scale includes seven notes: B, C, D, E, F#, G, and A. Each individual note of the B Phrygian scale is separated from the preceding or subsequent notes by an interval of one or two semitones. A semitone is the smallest musical interval used in classical Western music, equal to one twelfth of an octave. As other examples, a pentatonic scale may include five notes separated by larger intervals, while a chromatic scale may include twelve notes that are each separated by a single semitone. Other types of music may use other intervals between notes, such as quartertones, equal to one twenty-fourth of an octave. For example, microtonal music may use microtones —intervals smaller than a semitone, also referred to as microintervals—not typically found in classical Western music. Continuing the example, Bayati, Rast, Saba, Sigah, Ajam, and Hoseyni scales may include intervals of three-quarter tone size. Several notes may be combined to form chords. The formation of chords may utilize various rules known in music theory that specify intervals between notes. For example, the Bm7(#5) chord in the B Phrygian scale consists of the notes B, D, G, and A. Notes within a chord may be played either simultaneously or in quick succession, such as in an arpeggio.

Mechanical instruments may be manipulated by a musician to produce desired sounds. For example, a pianist may manipulate keys and pedals of a piano to control hammers and dampers to strike and silence vibrating strings. As another example, a horn player may control breath, embouchure, and valves to produce the desired notes. In comparison, electronic musical instruments may allow a musician to produce sounds that simulate or replicate a mechanical instrument, or sounds that are completely unrelated to any mechanical instrument, through use of electronic signals. Electronic musical instruments also offer advantages in terms of convenience, economy, and so forth. For example, an electronic piano that does not require vibration of long strings to produce sound may be manufactured using a smaller and less expensive form factor than an acoustic piano. As another example, a single small electronic musical instrument may be programmed to replicate the sounds of multiple different types of instruments. In addition to the ability to produce a variety of different sounds associated with many different instruments, electronic musical instruments may allow for a decoupling between the mechanism of input and the instrument being played. For example, a controller may be used to generate information indicative of input from the user. That information may then be used by a computing device to generate an output causing corresponding sounds to be played. In this way, an electronic keyboard may be used to produce a sound that replicates notes from a grand piano, or the sound of a snare drum, using information from the controller in place of, or in addition to, mechanical input by a musician.

In spite of this decoupling, traditional mechanical layouts remain prevalent. For example, a layout that is similar to a piano keyboard is commonly used by musicians as an input device. However, layouts such as the piano keyboard are the result of their mechanical past. The linear layout and spacing of keys on a piano keyboard were originally intended to accommodate the limits of mechanical actions, and not to accommodate the musician.

Described in this disclosure is an input device used to receive user input, such as actuated keys, and generate output data indicative of musical notes, such as MIDI data to cause an audio output that corresponds to the musical notes. The input device may include one or more sets of keys. Keys may be arranged in rows, columns, or other arrangements. Keys may include any mechanism of input including physical buttons, switches, proximity sensors, touch sensors, and so forth. In some implementations, mechanisms of input may also include audio input using a microphone or video input using a camera. For example, a camera may determine a musician interacting with a projected or virtual representation of keys. A musician may select a particular musical scale for use. The scale may include a plurality of musical notes. Each key within a set of keys may then be associated with a chord formed from a subset of the musical notes. For example, a set of keys, designated as "chord keys" may each correspond to a respective chord associated with a musical scale. Actuation of a chord key may cause output of the associated chord. In some implementations, the keys may be provided with visible indicia, such as a color that indicates the root note of the chord associated with the key, a type of chord associated with the key, or another characteristic of the chord.

In some implementations, a second set of keys of the input device may be associated with other types of musical output. For example, a second set of keys may be designated as "melody keys" and each melody key may be associated with an individual note within a selected scale. In some implementations, the melody keys may be provided with visible indicia indicative of the notes associated with each key. In such a case, relationships between melody keys and chord keys may be recognized based on the visible indicia. For example, a melody key associated with a note that matches the root note of a chord key may be provided with the same color.

In other implementations, a second scale may be selected and a second set of keys of the input device may be associated with chords from the second scale. For example, a musician may wish to quickly alternate between playing chords within two different scales or may wish to output audio that modulates between two scales. In some implementations, both sets of keys may be provided with visible indicia that may indicate relationships between the keys. For example, if two keys associated with different scales represent the same musical chord, the keys may be provided with the same color. As another example, if a first key is pressed, other keys associated with the same musical chord, or a similar or related musical chord may brighten, darken, flash, or be provided with some other type of visible indicia.

In some implementations, a second set of keys of the input device may dynamically change function as different keys of the first set are pressed. For example, if a first key is pressed to cause output of a chord, one or more keys within the second set may be assigned to individual notes within the chord to enable a musician to play melody notes that are included within a chord that is currently being output.

In some implementations, the input device may include keys for switching between scales, such as keys for modulating the musical key of a scale or keys for changing the musical mode of a selected scale. In response to actuation of a key to change the musical key or mode of a scale, the functions of the keys associated with chords or melodic notes may be reconfigured to correspond to the changed scale. For example, the input device may include keys for switching to the pentatonic or chromatic mode of a currently selected scale. In some implementations, the input device may include one or more user-defined keys that may be assigned scales or modes selected by a musician and used to enable rapid selection of the user-defined scale by the musician.

In some implementations, the input device may include control keys that may perform control functions to add notes to a chord or change the pitch of one or more notes of a chord. For example, octave keys may be used to select one or more octaves within which the notes of a chord may be played. In some cases, multiple octave keys may be actuated to cause the input device to output notes within multiple octaves simultaneously. As another example, spread keys may be used to control the spread of chords, such as by indicating an amount by which the pitch of a lowest note of a chord may be lowered from a default value when output. As yet another example, voicing keys may be used to control the inversion or voicing of one or more chords.

In some implementations the input device may include one or more display or other output devices. For example, the input device may include a display that is used to present the currently selected scale, display other scales that are available, display information indicative of a chord or notes that are currently being output, and so forth.

During play, a musician may press and release keys to generate output data to produce desired sounds. In one implementation, the output data may be compliant with at least a portion of the Musical Instrument Digital Interface (MIDI) technical standard. For example, output data may be sent to a computing device that processes the output data to determine which sounds to present, and the computing device or another associated computing device may subsequently present those sounds. In other implementations, the input device may itself include a speaker or other output device for generating audible sound based on the output data.

By using the input device and techniques described above, a musician may more easily and swiftly play music. The use of chord keys to present many, if not all, chords associated with a particular scale greatly simplifies the workload on the musician to play a particular chord. The use of visual indicia eases the cognitive load of the musician by providing easily accessible visual confirmation of common root notes in chord keys, while also indicating relationships between the chord keys and other keys on the input device. As a result, a musician may swiftly and easily play music that uses chords from multiple scales as well as individual notes.

FIG. 1 depicts a system 100 in which a musician 102 uses an input device 104 to play electronic musical instruments, according to one implementation. The input device 104 may include keys 106, buttons, or other types of input devices that are responsive to an input from the musician 102. During play, the musician 102 may manipulate the keys 106 to cause the output of desired sounds. The particular keys 106 that are actuated or released by the musician 102 may provide output indicative of an activation or deactivation of the particular key 106. The keys 106 may comprise a control mechanism responsive to physical force, such as a touch provided by the musician 102. In one implementation, the keys 106 may comprise buttons that deform or are displaced from an original position upon application of force, then are mechanically biased to return to approximately the original position after the force is removed.

In other implementations, other control mechanisms may be used. For example, the keys 106 may include force sensitive resistors, capacitive touch sensors, resistive touch sensors, solid state switches, accelerometers, touchscreens, and so forth. In some implementations, the keys 106 may provide other information in addition to an on/off state. For example, a force sensitive resistor may be used to provide information indicative of a change in applied force over time. As another example, an accelerometer may provide information indicative of a rate at which the key 106 was pressed, which may indicate a force provided to press the key 106. In still other implementations, the keys 106 may be virtual, such as presented to the musician 102 using a projector, display, and so forth. For example, the input device 104 may appear as a computer-generated object in a virtual or augmented reality space and a camera or other type of input device may be used to determine interactions between the musician 102 and the virtual input device 104. Different control mechanisms may be utilized with the same input device 104. For example, some keys 106 may be mechanical switches, while others are capacitive touch sensors, and so forth.

The keys 106 may be configured to present one or more visual indicia 108. For example, the visual indicia 108 may include one or more of color, text, an image, or a shape of the key 106. In some implementations, the visual indicia 108 may include different colors of illumination, different hues, shades, or luminosities, different colors presented on a display, border colors, graphics, and so forth. For example, the keys 106 may be constructed with a translucent or transparent keycap and a light source that illuminates the keycap. The light source may be configured or driven to provide different colors. For example, a multicolor light emitting diode (LED) may be configured to provide red, orange, yellow, green, blue, and violet colors. The visual indicia 108 may be used to provide the musician 102 with information about the notes associated with a particular key 106. The visual indicia 108 may be dynamically reconfigurable, such that as the input device 104 is reconfigured, the individual visual indicia 108 of a particular key 106 may change.

The keys 106 may be arranged into various groups that provide different functions. In some implementations, groups of keys 106 may include one or more of menu keys 110, control keys 112, chord keys 114, and melody keys 116. In other implementations, the keys 106 may include multiple sets of chord keys 114 or multiple sets of melody keys 116. For example, while FIG. 1 depicts the input device 104 including a set of chord keys 114 positioned to the left of a set of melody keys 116, in other implementations, the keys 106 may instead include two sets of chord keys 114 or two sets of melody keys 116. Continuing the example, based on input provided using the menu keys 110, control keys 112, and so forth, the functions of other keys 106 may be configured, such as to assign sets of keys as chord keys 114 or melody keys 116. In some implementations, the groups of keys 106 may be arranged into rows and columns, as shown in FIG. 1. In other implementations, the keys 106 may be placed into other configurations. For example, the chord keys 114 and melody keys 116 may be arranged in concentric arcs.

As discussed previously, the basic building blocks of music are scales, notes, and chords, and a sound having a particular pitch is represented by a note 118. Different notes 118 represent different pitches. A scale includes a particular set of notes that may be played together. For example, the B Phrygian scale includes the notes B, C, D, E, F#, G, and A. Two or more notes 118 may be combined to form chords 120. A chord 120 may be constructed from the notes 118 that make up a particular scale. Based on rules of music theory, certain combinations of these notes 118 may be regarded as aesthetically pleasing or suitable for use with certain types of music, such as Western classical music, while other combinations of notes 118 may be regarded as displeasing. Example chord structures may include: Major triads, Minor triads, 7th chords, 7th chords with a sharpened 5th, suspended 4th chords, 7th chords with a suspended 4th, added 2nd chords, 6th chords, major 7th chords, 6th chords with an added 9th, major 7th chords with an added 9th, flattened 5th chords, 6th chords with a flattened 5th, suspended 2nd chords, 9th chords, diminished chords, minor 7th with a flattened 5th, diminished 7th chords, augmented chords, 7th chords with a flattened 9th, 7th chords with a sharpened 9th, major 7th chords with an added 4th, major 7th chords with a sharpened 5th, 7th chords with a flattened 5th and a sharpened 9th, major 7th chords with a flattened 5th, or 7th chords with an added 9th and a sharpened 11th. For example, the Bm7(#5) chord in the B Phrygian scale consists of the notes B, D, G, and A. Notes 118 within the chord 120 may be played simultaneously, or in some implementations, in quick succession, such as an arpeggio.

The menu keys 110 may allow the musician 102 to configure the input device 104 to operate using a particular scale. For example, the menu keys 110 may allow the user to select from a number of different musical scales. Once a scale is selected, the input device 104 may be configured as described below. For example, based on the scale that is selected, particular notes 118 and chords 120 may be associated with particular keys 106, the visual indicia 108 may be configured for particular keys 106, and so forth. In other implementations, the menu keys 110 may be omitted. For example, the input device 104 may receive commands from an external device to select a scale or otherwise control the input device 104.

The control keys 112 may be configured to perform control functions that allow the musician 102 to modify operation of the input device 104 during play. For example, the control keys 112 may be used to change octaves associated with sounds that are output, add audible effects such as sustain or reverb, cause a chord 120 to be output using a particular inversion of the chord 120, and so forth. A shift in octave may comprise adding or subtracting twelve semitones to the notes 118. A chord inversion may comprise changing a chord 120 such that one of the notes 118 in that chord 120 is lowered or raised by one octave.

The chord keys 114 provide the musician 102 with easy access to the chords 120 that are associated with the selected scale. An individual chord key 114 may be associated with a particular chord 120 based on the selected scale. To cause sound corresponding to a particular chord 120 to be output, the musician 102 may actuate a chord key 114 that corresponds to the desired chord 120.

The melody keys 116 may allow the musician 104 to play individual notes 118 or combinations of notes 118 that may not be included in a chord 120 for the selected scale, or at times when it is desired to play selected notes 118 independent of a chord 120. By manipulating the chord keys 114 and the melody keys 116, the musician 102 may easily play complex musical arrangements. For example, when trying to play the B Phrygian chord of Bm7(#5), the musician 102 does not need to remember the four constituent notes 118 of the chord 120, but instead simply needs to know the corresponding key 106 in the chord keys 114 that will produce the desired sounds.

In some implementations, to facilitate operation of the input device 104, the visual indicia 108 provides the musician 104 with an indication of what notes 118 are associated with particular keys 106. For example, visible indicia 108 may include colors provided to the keys 106 using LEDs or similar indicators. Continuing the example, the B note may be associated with the color red. As such, each melody key 116 associated with a B note may be colored red. Similarly, each chord key 114 associated with a chord 120 that includes a B as the root note 118 of the chord 120 may also be colored red. In this way, the musician 102 may visually identify chords 120 and melody notes 118 associated with the same root note 118, as the corresponding keys 106 may have the same color. Additionally, the visual indicia 108 used on the chord keys 114 and the melody keys 116 may improve the ability of the musician 102 to visually identify particular keys 106 that share a common note 118. The visual indicia 108 may also facilitate quick identification of particular notes 118 and enable the musician 102 to quickly visually distinguish between different notes 118. For example, visual indicia 108 may correspond to particular characteristics of the chord 120 that is associated with a chord key 114. Characteristics of a chord 120 may include the root note 118 of the chord 120, a type associated with the chord 120 (e.g., a minor chord, an augmented chord, and so forth), a number of notes 118 included in the chord 120, and so forth. Continuing the example, the chord keys 114 associated with each chord 120 having a root note 118 of B could be colored red. As another example, each chord key 114 associated with a minor chord 120 may be colored blue. As yet another example, each chord key 114 associated with a chord 120 having three notes may be colored orange. In some cases, a key 106 may be provided with multiple visible indicia 108 indicative of multiple characteristics of the associated chord 120 or note 118.

During operation, a hardware processor of the input device 104 may generate output data 122. The output data 122 may comprise information indicative of the state of the keys 106. In some implementations the output data 122 may be compliant with at least a portion of the musical instrument digital interface (MIDI) technical standards as promulgated by the MIDI Manufacturers Association. For example, the output data 122 may include note on data 124 and note off data 126. The note on data 124 may indicate a particular note 118 and that the particular note 118 is designated to be played. The note off data 126 may indicate a particular note 118 and that the particular note 118 is designated to have play stop. For example, when the musician 102 presses the melody key 116 associated with the note B1, note on data 124 is generated that designates the note B1 is to be played. Continuing the example, when the musician 102 releases that melody key 116, note off data 126 is generated that designates that play of note B1 is to be discontinued. The output data 122 may include other information, such as information indicative of a particular instrument, key velocity, key pressure, key acceleration, and so forth. Continuing the example, the note on data 124 may be indicative of the timing and force with which the musician 102 struck or otherwise actuated the melody key 116.

The output data 122 may be provided to a computing device 128 via a communication interface. The computing device 128 may receive the output data 122 and may then use this information in a variety of ways. For example, the output data 122 may be processed and audio signals may be generated. Continuing the example, the output data 122 may correspond to one or more notes 118 associated with an actuated key 106 or multiple actuated keys 106 of the input device 104. The output data 122 may indicate the associated notes 118, a chord 120 that includes the notes 118, the key 106 that was actuated, and so forth. As such, the output data 122 may be associated with one or more keys 106, one or more chords 120, or one or more notes 118. The audio signals generated based on the output data 122 may be presented by a speaker 130 that renders aloud music 132 or other sounds that correspond to the keys 106 that the musician 102 has actuated. The computing device 128 may be an electronic musical instrument, a computer executing software, or a combination thereof. In other implementations, the input device 104 itself may include associated speakers 130 or other types of output devices for generating sound.

In some implementations the computing device 128 or other external device may be used to control one or more functions of the input device 104. For example, the computing device 128 may send commands to set the input device 104 to utilize a particular scale in place of, or in addition to, use of menu keys 110 or control keys 112. In another example, the computing device 128 may send data to the input device 104 that is used by the input device 104 to assign particular notes 118, chords 120, or other functions to particular keys 106.

Instead of, or in addition to the MIDI technical standards, the input device 104 may use one or more other technical standards. For example, the input device 104 may be compatible with at least a portion of one or more standards, such as HD-MIDI, RTP-MIDI, Open Sound Control (OSC), and so forth. The communication interface may utilize a wired serial interface, other wired interfaces such as Ethernet, one or more wireless interfaces, and so forth. For example, the input device 104 may utilize the Bluetooth or WiFi protocols to communicate with the computing device 128.

Figure 2:
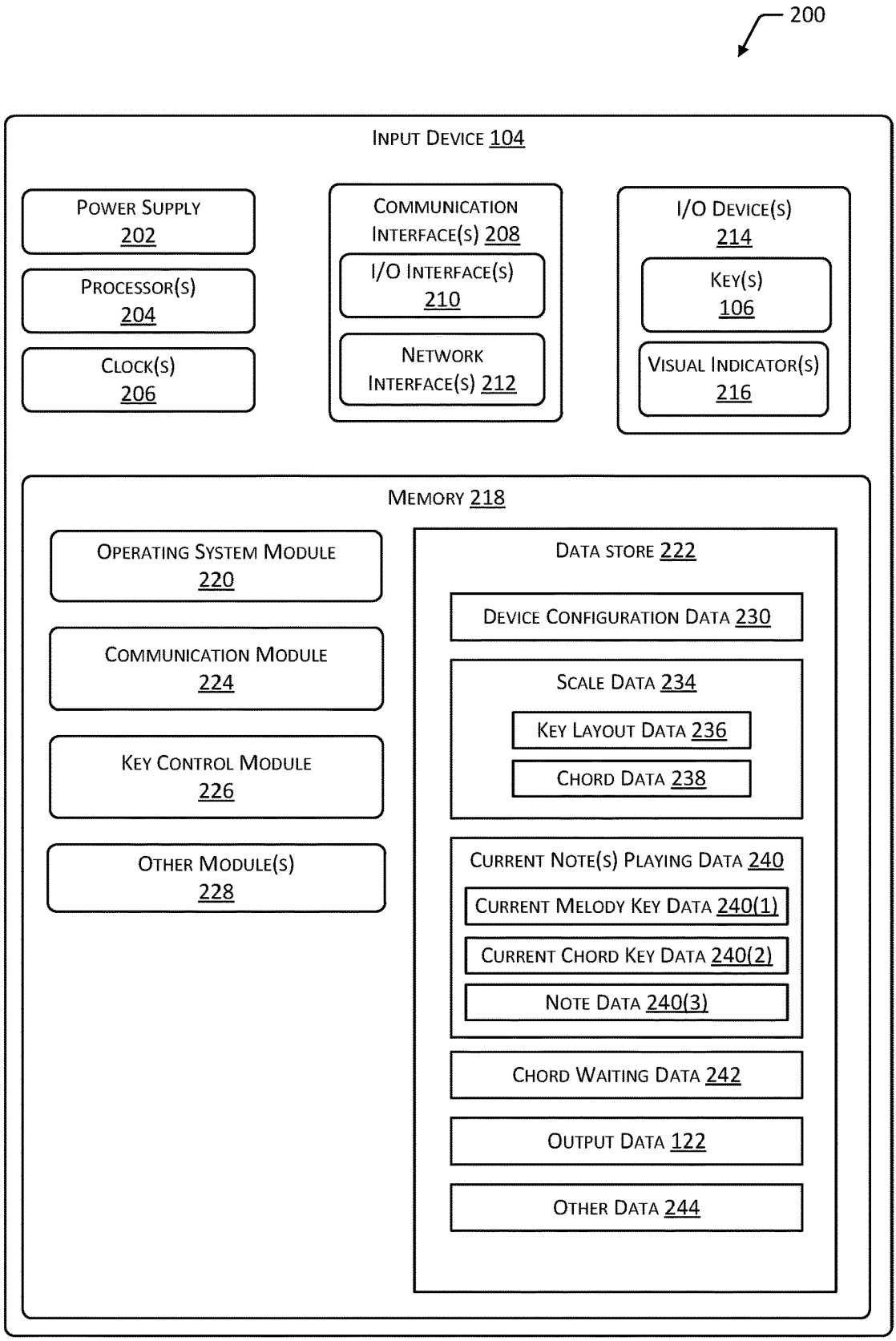
FIG. 2 is a block diagram of the input device, according to one implementation.

FIG. 2 is a block diagram 200 of the input device 104, according to one implementation. The input device 104 may comprise a general purpose computer, system on a chip (SoC), microcontroller, or other device that has been programmed or otherwise configured to provide the following functions. For example, the input device 104 may utilize an Arduino single-board microcontroller.

The input device 104 may include one or more power supplies 202 configured to provide electrical power suitable for operating the components of the input device 104. In some implementations, the power supply 202 may include a rechargeable battery, fuel cell, photovoltaic cell, power conditioning circuitry, wireless power receiver, and so forth.

The input device 104 may include one or more hardware processor(s) 204 ("processors") configured to execute one or more stored instructions. The processor(s) 204 may include one or more cores. One or more clocks 206 may provide information indicative of date, time, ticks, and so forth. For example, the processor(s) 204 may use data from the clock 206 to generate a timestamp, trigger a preprogrammed action, and so forth.

The input device 104 may include one or more communication interfaces 208, such as input/output (I/O) interfaces 210, network interfaces 212, and so forth. The communication interfaces 208 may enable the input device 104, or components of the input device 104, to communicate with other devices or components of the input device 104. The I/O interfaces 210 may include interfaces such as MIDI, Inter-Integrated Circuit (I2C), Open Sound Control (OSC), Serial Peripheral Interface bus (SPI), Universal Serial Bus (USB), RS-232, and so forth.

The network interfaces 212 may be configured to provide communications between the input device 104 and other devices, such as computing devices 128, routers, access points, and so forth. The network interfaces 212 may include devices configured to couple to one or more networks including local area networks (LANs), WLANs, wide area networks (WANs), wireless wide area networks (WWANs), and so forth. For example, the network interfaces 212 may include devices compatible with Ethernet, Wi-Fi, Bluetooth, ZigBee, Z-Wave, 3G, 4G, LTE, and so forth.

The I/O interface(s) 210 may couple to one or more I/O devices 214. The I/O devices 214 may include any manner of input device or output device associated with the input device 104. For example, I/O devices 214 may include the keys 106, touch sensors, keyboards, mouse devices, microphones, image sensors (e.g., cameras), scanners, geolocation or other positioning devices, visual indicators 216, displays, speakers, haptic devices, printers, and so forth. The I/O devices 214 may be physically incorporated with the input device 104 or may be externally placed. For example, the I/O devices 214 may include a foot pedal that is in wired or wireless communication with the input device 104.

The visual indicators 216 may include devices configured to produce the visual indicia 108. For example, the visual indicators 216 may include light emitting diodes (LED), quantum dots, electroluminescent elements, electrophoretic elements, cholesteric elements, optically interferometric elements, and so forth. The visual indicators 216 may be emissive, in that they emit photons, or they may be reflective in that they reflect ambient light. For example, an LED is an emissive visual indicator 216. In comparison, liquid crystal, electrophoretic, cholesteric, and optically interferometric devices interact with ambient light to produce a visual effect.

The visual indicators 216 may be integrated with the keys 106, or may be separate from them. For example, the upper surface of the key 106 that is visible during normal use may include the visual indicator 216. In another example, the keycap of a key 106 may be transparent or translucent while a visual indictor 216 positioned below or to the side of the keycap provides illumination to that keycap, causing the keycap to appear the color of the visual indicator 216 when the visual indicator 216 is active. In other implementations other techniques may be used. For example, the keys 106 may be unchanged while a border or light next to the key 106 exhibits the visual indicia 108.

The input device 104 may include one or more busses or other internal communications hardware or software that allows for the transfer of data between the various modules and components of the input device 104.

As shown in FIG. 2, the input device 104 may include one or more memories 218. The memory 218 may include one or more non-transitory computer-readable storage media (CRSM). The CRSM may be any one or more of an electronic storage medium, a magnetic storage medium, an optical storage medium, a quantum storage medium, a mechanical computer storage medium, and so forth. The memory 218 may provide storage of computer-readable instructions, data structures, program modules, and other data for the operation of the input device 104. A few example modules are shown stored in the memory 218, although the same functionality may alternatively be implemented in hardware, firmware, or as a system on a chip (SoC).

The memory 218 may include one or more operating system (OS) modules 220. The OS module 220 may be configured to manage hardware resource devices such as the I/O interfaces 210, the network interfaces 212, the I/O devices 214, and to provide various services to applications or modules executing on the processors 204. The OS module 220 may implement a variant of the FreeBSD operating system as promulgated by the FreeBSD Project; UNIX or a UNIX-like operating system; a variation of the Linux operating system such as Raspbian or Android; the Windows operating system from Microsoft Corporation of Redmond, Wash., USA; the Mac OS or iOS promulgated by Apple Inc. of Cupertino, Calif., USA; the TinyOS promulgated by the TinyOS Alliance, or other operating systems.

A data store 222 may also be stored in the memory 218. The data store 222 may use a flat file, database, linked list, tree, executable code, script, or other data structure to store information. In some implementations, the data store 222 or a portion of the data store 222 may be distributed across one or more other devices including other input devices 104, network attached storage devices, and so forth.

The memory 218 may store other modules including a communication module 224, a key control module 226, or other modules 228. The modules may be executed as foreground applications, background tasks, daemons, and so forth.

The communication module 224 may be configured to establish communications with one or more other devices using one or more of the communication interfaces 208. Communications may be authenticated, encrypted, and so forth. For example, the communication module 224 may utilize digital certificates to authenticate the identity of devices involved in the communication. As another example, the communication module 224 may be configured to establish a virtual private network (VPN) connection or tunnel with the computing device 128.

The key control module 226 may perform various functions associated with operation of the input device 104, such as utilizing device configuration data 230 stored in the data store 222 that indicates default settings, user preferences, and so forth, to configure the functions of the keys 106 or other portions of the input device 104. The key control module 226 may access scale data 234 that is stored in the data store 222. The scale data 234 may include information associated with one or more scales. For example, scale data 234 may include one or more of key layout data 236, chord data 238, and so forth. The key layout data 236 may assign or otherwise associate a particular note 118 with a particular melody key 116 and a particular chord 120 with a particular chord key 114. The key layout data 236 may include other information, such as a color, graphic, text, or other information used to present a particular visual indicia 108 in association with a corresponding key 106. The chord data 238 may include information indicative of the chords 120 and their constituent notes 118 that are available for a particular scale. The scale data 234 may include key layout data 236 and chord data 238 for a plurality of different scales. For example, the scales may include B Phrygian, B Locrian, A Aeolian, D Dorian, and so forth. Due to the different notes 118 associated with these different scales, each scale may present different notes 118 for association with melody keys 116 and different chords 120 for association with chord keys 114.

The key control module 226 may be configured to receive input that is indicative of a particular scale. For example, a musician 102 may use the menu keys 110 or a separate computing device 128 to provide input selecting the B Phrygian scale. Once a scale is selected, the key control module 226 may access the scale data 234 and determine the key layout data 236 and the chord data 238 associated with the B Phrygian scale. The key layout data 236 may be used to assign different functions to various keys 106. For example, the melody keys 116 may be associated with individual notes 118 defined by the selected scale. The chord keys 114 may be associated with particular chords 120 defined by the selected scale. The chord data 238 may indicate the constituent notes 118 for a particular chord 120. In some implementations the key layout data 236 may incorporate the chord data 238. For example, the constituent notes 118 for a particular chord 120 may be stored as key layout data 236.

The key control module 226 may maintain and otherwise utilize current note(s) playing (CNP) data 240. The CNP data 240 contains information indicative of the notes 118 for which note on data 124 has been issued and no subsequent note off data 126 has yet been issued. The CNP data 240 is indicative of notes 118 played individually, such as from activation of a melody key 116, as well as the notes 118 of a chord 120 associated with activation of a chord key 114. In some implementations the CNP data 240 may include one or more of current melody key data 240(1), current chord key data 240(2), note data 240(3), and so forth. The current melody key data 240(1) may provide information indicative of one or more of the particular melody keys 116 that have been pressed. The current chord key data 240(2) may provide information indicative of one or more of the particular chord keys 114 that have been pressed. In some implementations, the current chord key data 240(2) may be limited to storing data indicative of a single chord key 114. The note data 240(3) may comprise data indicative of the notes 118 that are playing, such as the notes 118 associated with a chord 120 that is assigned to a particular chord key 114, or individual notes 118 that are assigned to the melody keys 116 that are being played. Utilization of the CNP data 240 is discussed in more detail below with regard to FIGS. 3-6.

The key control module 226 may also maintain and otherwise utilize chord waiting data 242, in some implementations. The chord waiting data 242 may store information indicative of notes 118 associated with chords 120 that have been played as a result of input from a chord key 114, but have not yet been sent as output data 122. For example, if a chord key 114 has been actuated but a corresponding sound has not yet been output, the chord waiting data 242 may indicate chords 120 waiting to be played. The chord waiting data 242 is discussed in more detail below with regard to FIG. 5.

In some situations there may be conflicting or contradictory situations regarding whether to send note off data 126 for a particular note 118. For example, a particular note 118 may be included in a chord 120 that is currently playing responsive to actuation of a chord key 114, and at the same time, a melody key 116 that corresponds to the particular note 118 may also be actuated. The key control module 226 may be configured to determine the press or release of particular keys 106, such as the chord key 114 and the melody key 116, then generate the output data 122. The output data 122 may then be sent using the communication interface 208. Details of this operation are discussed in more detail below with regard to FIGS. 3-6.

Other modules 228 may also be present in the memory 218. For example, other modules 228 may include MIDI rendering modules that interpret the output data 122 and produce audio output onboard the input device 104. In this way, the input device 104 may be used as a standalone electronic musical instrument.

Other data 244 may also be stored in the data store 222. For example, other data 244 may include one or more threshold values. Continuing the example, the threshold values may specify a maximum number of chords 120 that may be associated with the chord waiting data 242, a duration of time to retain a chord 120 within the chord waiting data 242, and so forth. Threshold values may also include maximum values, minimum values, ranges of values, and so forth.

Figure 3:
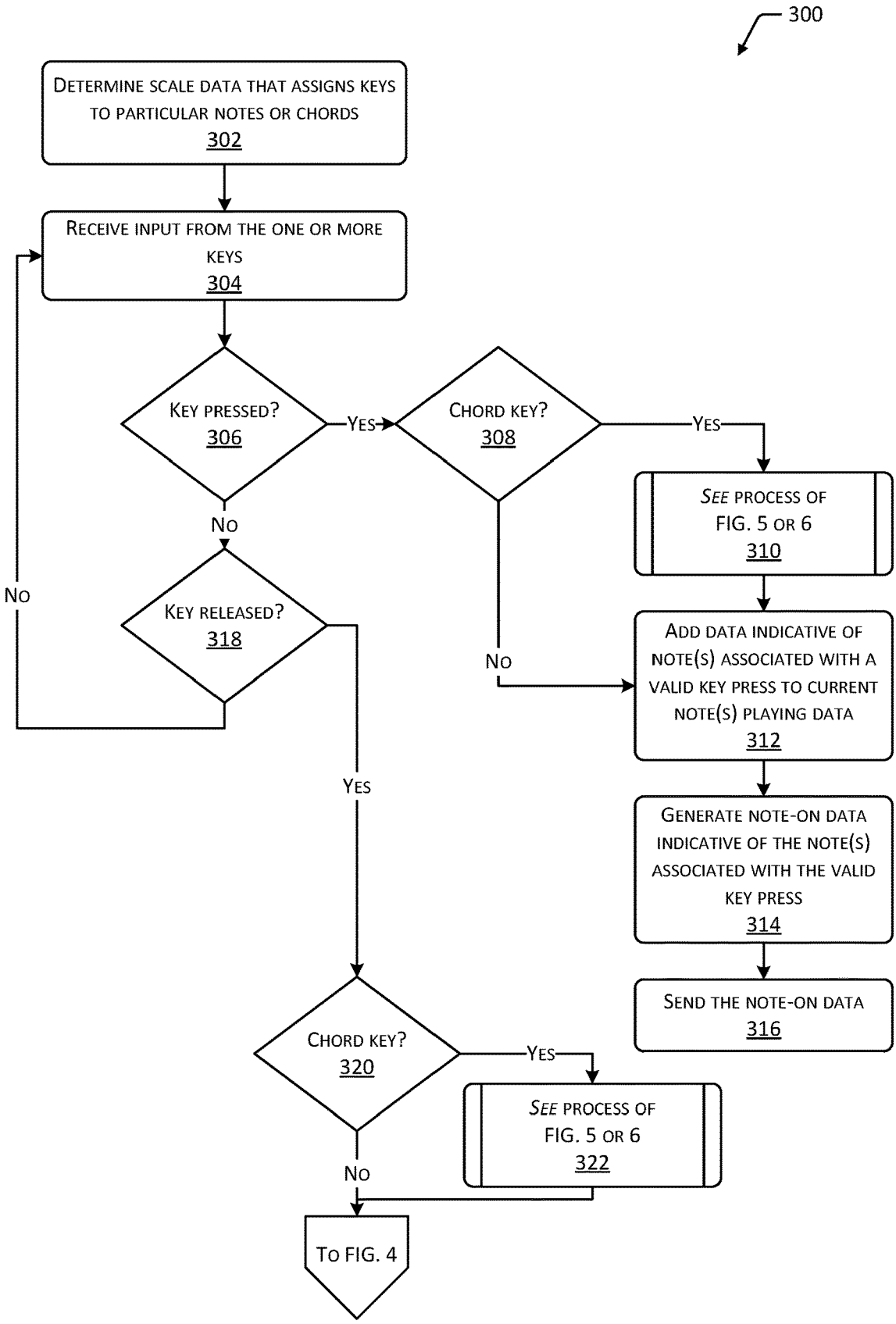
FIGS. 3 and 4 are flow diagrams of a process for generating output data, such as MIDI formatted commands, using the processed input, according to one implementation.
Figure 4:
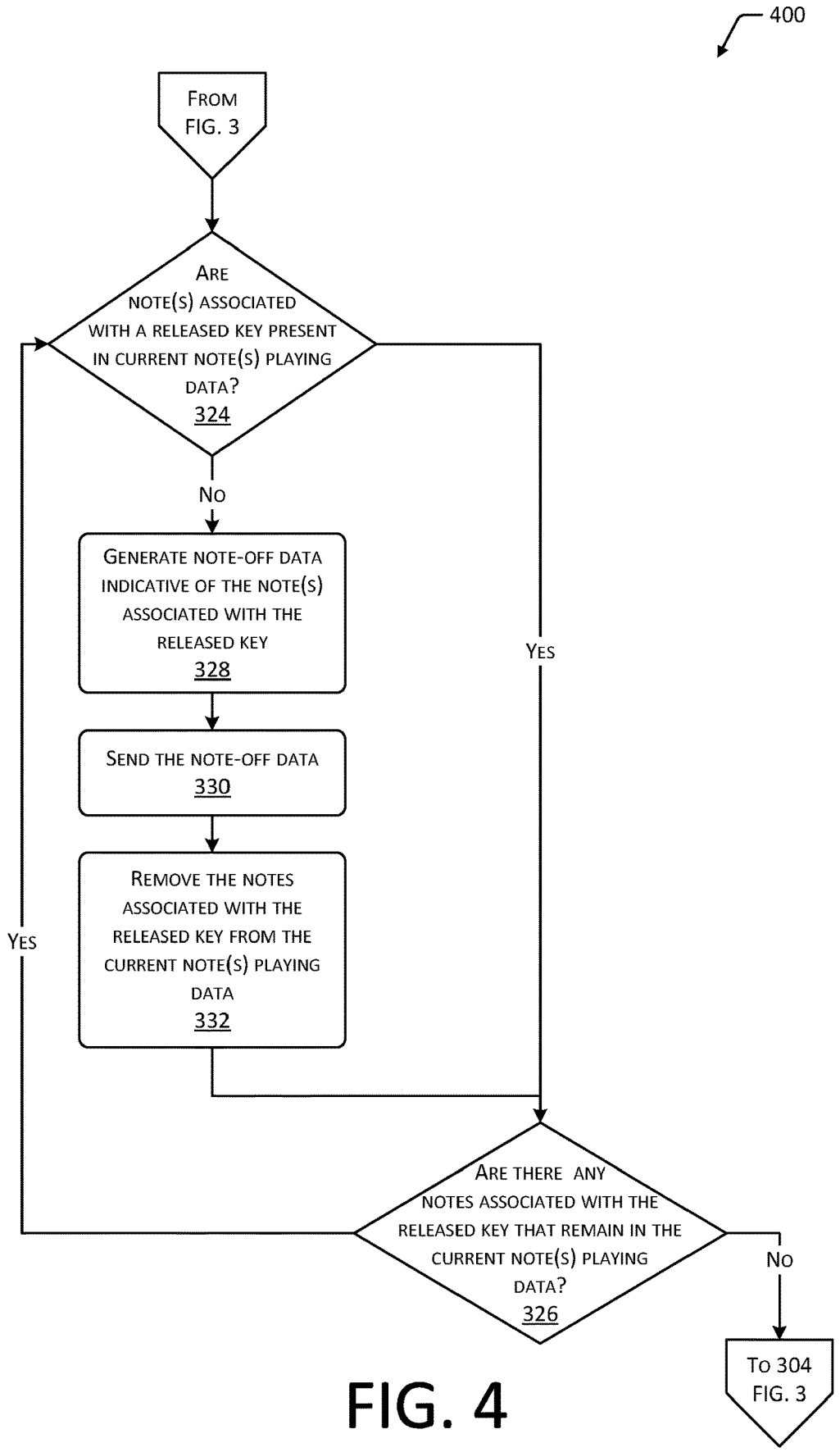

FIGS. 3 and 4 are flow diagrams 300 and 400 of a process for generating output data 122, such as MIDI formatted commands, using the processed input, according to one implementation. The process may be implemented using one or more of the input device 104, the computing device 128, or other devices.

At 302 scale data 234 that assigns keys 106 to particular notes 118 or chords 120 is determined. For example, a musician 102 may use menu keys 110 of the input device 104 or provide input using another computing device 128 to select a particular scale from a menu of available scales. Responsive to input selecting a scale, scale data 234 associated with the selected scale is accessed. The key layout data 236 and chord data 238 associated with that scale data 234 are then used to associate particular notes 118 with melody keys 116, and particular chords 120 with chord keys 114, set the visual indicia 108 for one or more of the keys 106, configure the control keys 112, and so forth.

In some implementations, the processor 204 may perform the following operations to assign functions and characteristics to keys 106: A specified scale includes a plurality of designated musical notes 118. An $n^{th}$ key of the melody keys 116 is assigned to represent an $i^{th}$ note of the designated musical notes 118. For example, the key layout data 236 may specify this assignment. An $r^{th}$ color is associated with the $i^{th}$ note 118. The $n^{th}$ key is configured to present the $r^{th}$ color, providing the $n^{th}$ key with the color as a visual indicia 108. For example, the key layout data 236 may specify this association.

A $c^{th}$ chord is determined, the $c^{th}$ chord including a plurality of notes 118 from the designated musical notes in the scale. A $j^{th}$ key of the chord keys 114 is assigned to represent the $c^{th}$ chord. For example, the key layout data 236 may specify this assignment. The constituent notes 118 of the $c^{th}$ chord may be specified in the chord data 238. The $j^{th}$ key is configured to present the $r^{th}$ color, providing the $j^{th}$ key with the color as visual indicia 108. As used above, n, i, r, c, and j are representative of non-zero positive integer values. The process may continue until either all keys 106 are assigned or until all notes 118 and chords 120 for the particular scale are assigned to a key 106. In some implementations one or more of the chords 120 may be inverted chords. For example, the $c^{th}$ chord assigned to the $j^{th}$ key may be an inverted chord.

At 304 input is received from one or more keys 106. For example, the musician 102 may begin actuating one or more keys 106 of the input device 104. Actuation of the keys 106 by the musician 102 may include pressing and releasing, or otherwise activating and deactivating, one or more keys 106 or other controls. As described above, output data 122 generated based on the actuated keys 106 may be provided to another device, that may record the output data 122, use the output data 122 to generate audible sounds, and so forth. In other implementations, the output data 122 may be used to generate sound using one or more speakers 130 associated with the input device 104.

At 306 a determination is made as to whether a key 106 is pressed. For example, a key 106 may be deemed to be pressed when it transitions from an off state to an on state. Continuing the example, a force from the musician 102 to depress or deform the key 106, contact a touch sensor, toggle a switch, and so forth may transition a key 106 to an on state.

At 308 a determination is made as to whether the key 106 that was pressed is a chord key 114.

Figure 5:
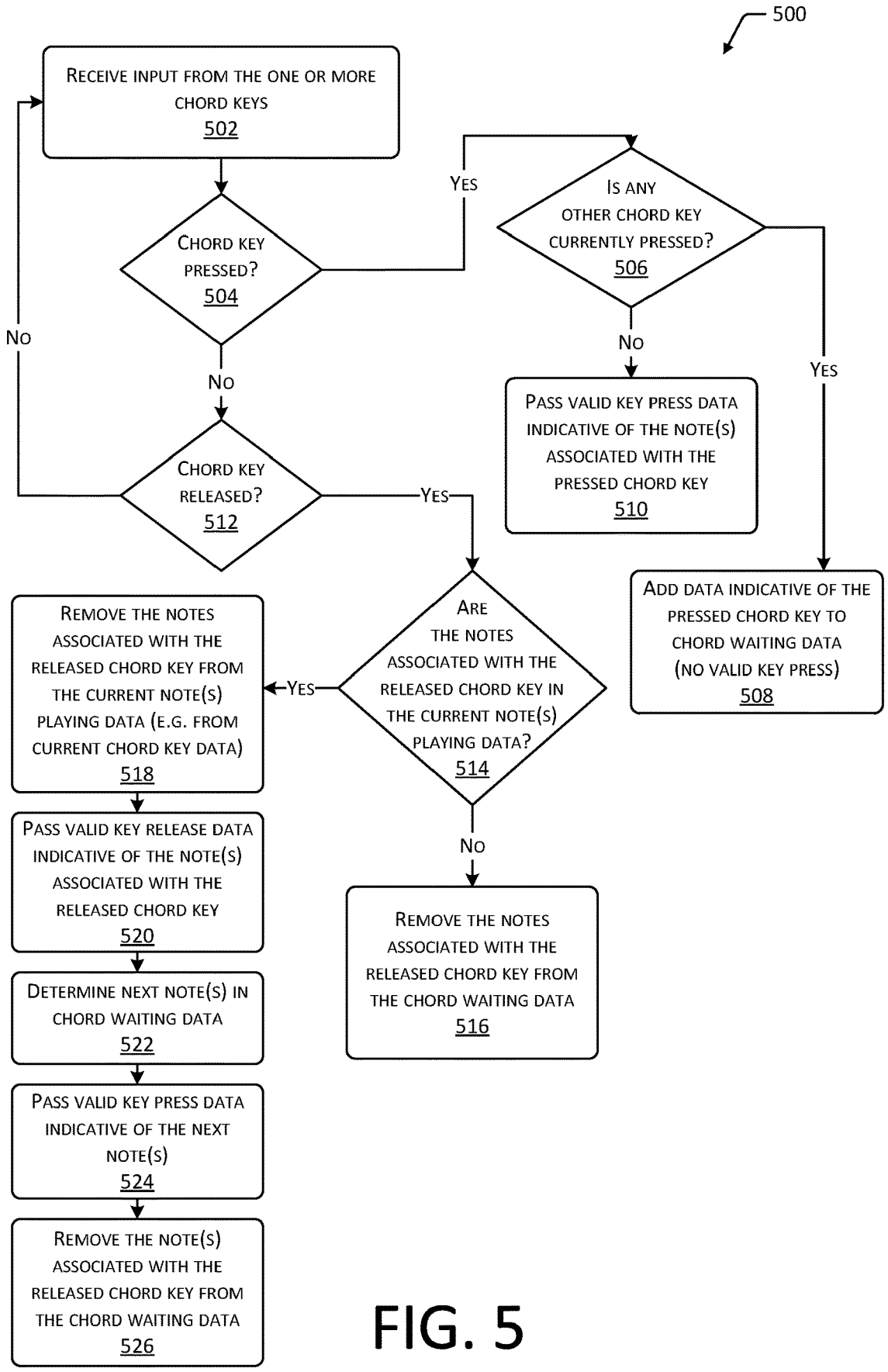
FIG. 5 is a flow diagram of a process for processing input from a chord key, according to one implementation.
Figure 6:
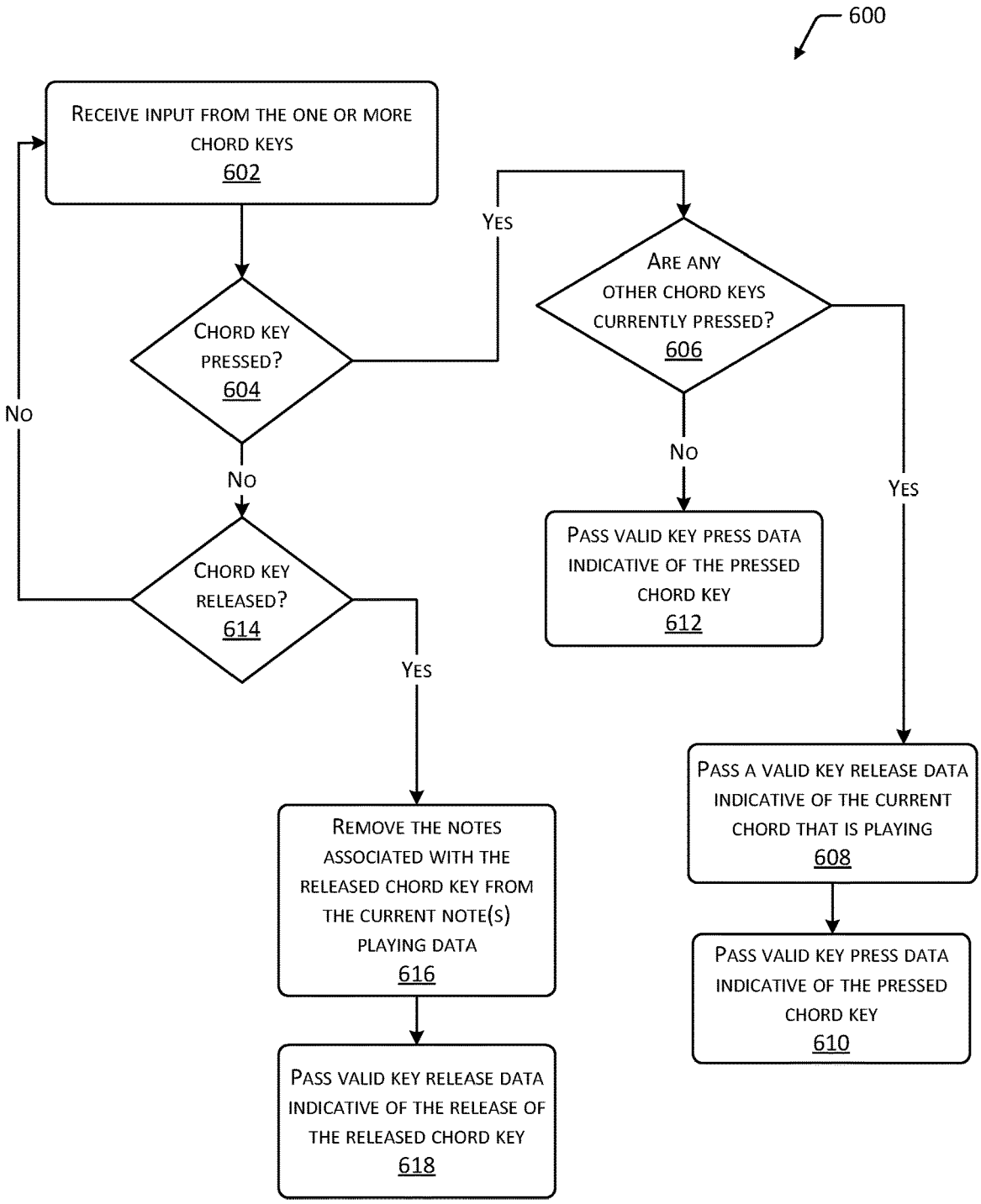
FIG. 6 is another flow diagram of a process for processing input from a chord key, according to one implementation.

As depicted in FIG. 3, a determination of a key press 306 and that the key 106 is a chord key 114 results in the process proceeding to 310. At 310 one or more of the processes described below with regard to FIG. 5 or FIG. 6 may be utilized. In some implementations, these processes may be mutually exclusive such that either the process of FIG. 5 is used or the process of FIG. 6 is used, but not both. The process may then proceed to 312.

At 312, data indicative of one or more notes 118 associated with a valid key press may be added to current note playing data 240. For example, data indicative of these keys 106 may be added to the current chord key data 240(2).

At 314, note on data 124 is generated that is indicative of the one or more notes 118 associated with the valid key press. For example, the note on data 124 may comprise a MIDI command.

At 316, the note on data 124 may be stored in memory, sent as output data 122 to an external device such as the computing device 128, an output device such as a speaker 130, and so forth.

Returning to 308, if the key 106 that is pressed is not a chord key 114 and instead is a melody key 116, the process may proceed to 312, bypassing 310.

Returning to 306, if no key 106 is pressed, the process may continue to 318, which determines if the input is indicative of the release of a key 106. If the determination at 318 indicates that a key 106 has been released, the process may proceed to 320 to determine if the released key 106 is a chord key 114. If a determination is made that the released key 106 is a chord key 114, the process may proceed to 322. At 322 one or more of the processes described below with regard to FIG. 5 or FIG. 6 may be utilized. That process may then proceed to 324. If the determination at 320 is that the key 106 that is released is not a chord key 114 but is instead a melody key 116, the process may proceed to 324 (shown in FIG. 4), bypassing 322.

Returning to 318, if no key 106 is determined to be released, the process may return to 304.

FIG. 4 continues the depiction of the process begun at FIG. 3.

At 324 a determination is made as to whether one or more notes 118 associated with a released key 106 are present in current note(s) playing data 240. For example, if the key 106 is associated with a chord key 114, the determination may involve a search or comparison of the current chord key data 240(2). In another example, if the key 106 is associated with a melody key 116, the determination may involve a search or comparison of the current melody key data 240(1). If it is determined that there are notes 118 associated with the released key 106 present in the current notes playing data 240, the process may proceed to 326.

At 326, a determination is made as to whether there are any notes 118 associated with the released key 106 that remain in the current notes playing data 240. If there are not any notes 118 associated with the released key 106 that remain in the current notes playing data 240, the process may return to block 304, to wait for or receive input from the one or more keys 106. If there are notes 118 associated with the released key 106 that remain in the current notes playing data 240, the process may return to 324.

At 324 if the notes 118 associated with the released key 106 are not present in the current notes playing data 240, the process may continue to 328. At 328, note off data 126 that is indicative of the notes 118 associated with the released key 106 is generated. For example, a MIDI command indicating note off may be generated.

At 330 the note off data 126 may be stored in memory 218, sent as output data 122, and so forth.

At 332, the notes 118 associated with the released key 106 are removed from the current notes playing data 240. For example, if the released key 106 includes a chord key 114, data indicative of that chord key 114 or the notes 118 associated with the chord 120 may be removed from the current chord key data 240(2). As used in this disclosure, operations such as adding or removing data to or from a data structure are provided by way of illustration and not necessarily as a limitation. It is understood that other equivalent operations may be utilized. For example, instead of adding or removing data, a flag may be added, removed, toggled, and so forth.

FIG. 5 is a flow diagram of a process 500 for processing input from a chord key 114, according to one implementation. The process 500 may be implemented using one or more of the input device 104, the computing device 128, or other devices. As described with regard to FIG. 3, if input indicative of a key 106 being pressed is received and the pressed key 106 is determined to be a chord key 114, one or both of the processes in FIG. 5 or FIG. 6 may be performed.

At 502, input is received from one or more of the chord keys 114.

At 504 a determination is made as to whether a chord key 114 has been pressed. If a chord key 114 has been pressed, the process may proceed to 506. At 506 a determination is made as to whether any other chord key 114 is currently pressed. Data indicative of the key press may be passed to a later process or portion thereof, as described with regard to FIG. 3. If a determination is made that another chord key 114 is currently pressed, the process may proceed to 508. At 508, data indicative of the pressed chord key 114 is added to the chord waiting data 242. At this point, no valid key press has been determined.

Returning to 506, if there is no other chord key 114 that is currently pressed, the process may proceed to 510. At 510, data indicative of a valid key press is passed. This data may be indicative of one or more of the notes 118 associated with the pressed chord key 114, a designator for the specific chord key 114, and so forth. Data indicative of the key press may be passed to a later process or portion thereof, as described with regard to FIG. 3.

Returning to 504, if no chord key 114 is determined to be pressed, the process may proceed to 512. At 512, a determination is made as to whether a chord key 114 has been released. If not, the process may return to 502. If a chord key 114 has been released, the process may continue to 514.

At 514 a determination may be made as to whether the notes 118 associated with the released chord key 114 are indicated in the current notes playing data 240. For example, a designator indicative of a particular chord key 114 or the notes 118 associated with the corresponding chord 120 may be compared to the current chord key data 240(2).

If the chord 120 or the notes 118 associated with the released chord key 114 are not indicated within the current notes playing data 240, the process may proceed to 516. At 516 the notes 118 associated with the released chord key 114 are removed from the chord waiting data 242. For example, a designator indicative of a particular chord key 114, chord 120, or notes 118 associated with the chord 120 may be removed from the chord waiting data 242.

Returning to 514, if the notes 118 associated with the released chord key 114 are present in the current notes playing data 240, the process may proceed to 518. At 518, the notes 118 associated with released chord key 114 may be removed from the current notes playing data 240. For example, data indicative of the particular chord key 114, chord 120, or associated notes 118 may be removed from the current chord key data 240(2).

At 520 a valid key release is determined that is indicative of the notes associated with the released chord key 114.

At 522 the next note(s) 118 in the chord waiting data 242 are determined. For example, the chord waiting data 242 may comprise a stack, list, or other data structure that indicates an ordered arrangement of notes 118 or chords 120, such as the order in which the associated keys 106 were pressed.

At 524 a valid key press is determined that is indicative of the notes 118 associated with the next notes 118 determined at 522.

At 526 the notes 118 associated with the released chord key 114 are removed from the chord waiting data 242. For example, the chord 120 associated with a valid key press that has been expressed in terms of note on data 124 and has been sent to the computing device 128 for output may be deemed to be played. The notes 118 may therefore be removed from the chord waiting data 242 to prevent duplication.

FIG. 6 is a flow diagram of a process 600 for processing input from a chord key 114, according to one implementation. The process 600 may be implemented using one or more of the input device 104, the computing device 128, or other devices. As described with regard to FIG. 3, if input indicative of a key 106 being pressed is received and the pressed key 106 is determined to be a chord key 114, one or both of the processes in FIG. 5 or FIG. 6 may be performed.

At 602, input is received from one or more of the chord keys 114.

At 604 a determination is made as to whether a chord key 114 has been pressed. If a chord key 114 has been pressed, the process may proceed to 606. At 606 a determination is made as to whether any other chord key 114 is currently pressed. The current note(s) playing data 240 may be used to determine that a current chord 120 is playing. For example, the current chord key data 240(2) may be searched to determine a currently pressed chord key 114. If a chord key 114 is currently pressed, the process continues to 608.

At 608, a valid key release is determined that is indicative of the current chord 120 that is playing. Data indicative of the key release may be passed to a later process or portion thereof, as described with regard to FIG. 3.

At 610 a valid key press indicative of the pressed chord key 114 is determined. Data indicative of the key press may be passed to a later process or portion thereof, as described with regard to FIG. 3. In the implementation described with regard to FIG. 6, pressing another chord key 114 may stop a previous chord key 114 from being played. In other implementations, the process may be modified to allow for multiple chords 120 to be simultaneously played.

Returning to 606, if there is no other chord key 114 that is currently pressed, the process may proceed to 612. At 612, data indicative of a valid key press is passed. This data may be indicative of one or more of the notes 118 associated with the pressed chord key 114, a designator for the specific chord key 114, and so forth. Data indicative of the key press may be passed to a later process or portion thereof.

Returning to 604, if no chord key 114 is determined to be pressed, the process may proceed to 614. At 614, a determination is made as to whether a chord key 114 has been released. If a determination is made that a chord key 114 has not been released, the process may return to 602. If a chord key 114 has been released, the process may continue to 616.

At 616, the notes 118 associated with the released chord key 114 may be removed from the current notes playing data 240. For example, data indicative of the particular chord key 114 may be removed from current chord key data 240(2).

At 618 a valid key release is determined that is indicative of the chord 120 or notes 118 associated with the released chord key 114. This data may be indicative of one or more of the notes 118 associated with the released chord key 114, a designator for the specific chord key 114, and so forth. Data indicative of the key release may be passed to a later process or portion thereof.

One or more of the functions as described above with regards to FIGS. 3-6 may be performed using one or more of the processor 204 of the input device 104, the computing device 128, or other another device. For example, the input device 104 may send raw output data 122 comprising information indicative of the state of keys 106, or changes in the state of the keys 106, to another device that generates the output data 122. As another example, the input device 104 may generate output data 122 to be provided to another computing device 128. As yet another example, the input device 104 may process the output data 122 to generate sound or other types of output without use of an additional computing device 128.

Figure 7A:
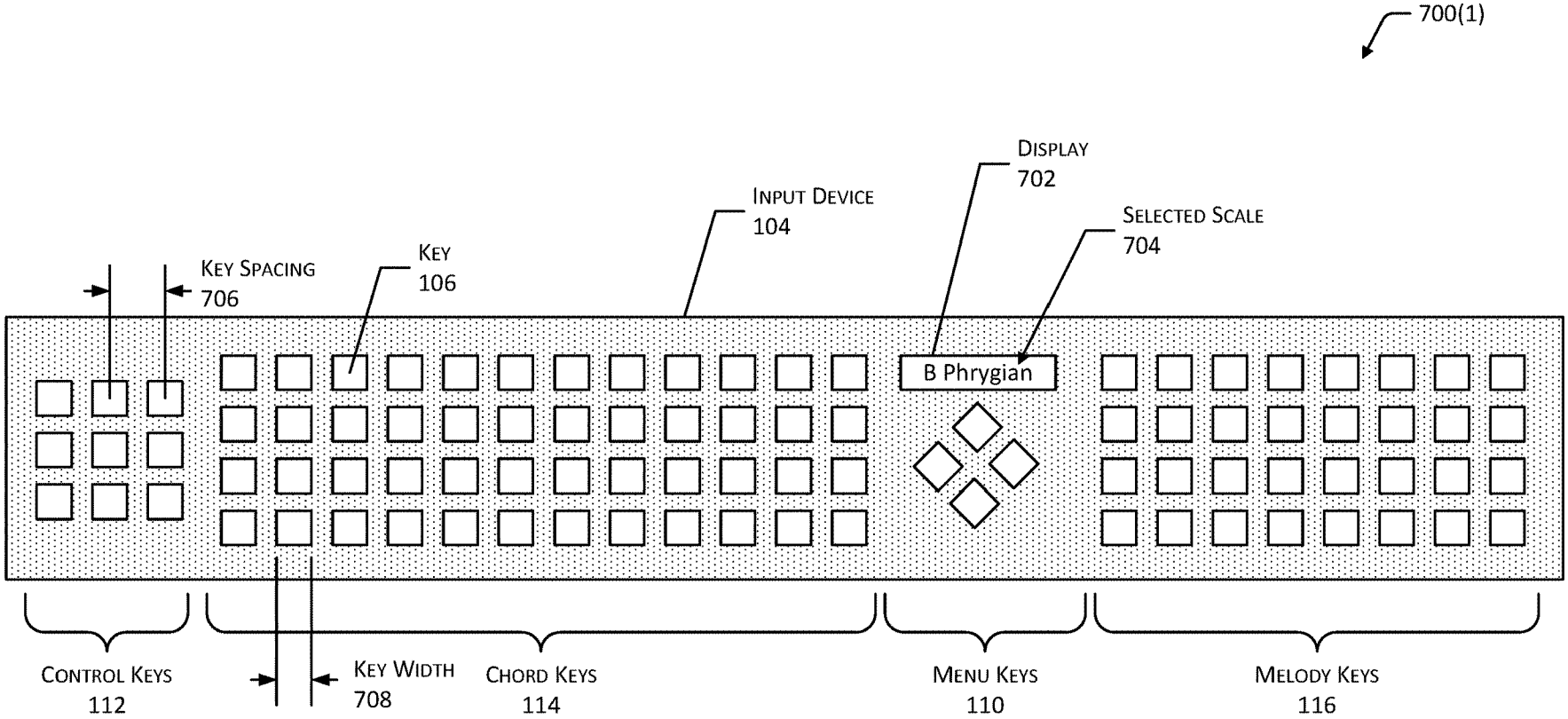
FIG. 7A depicts a layout of the input device, according to one implementation.

FIG. 7A depicts a layout 700(1) of the input device 104, according to one implementation. The input device 104 may include a display 702. The display 702 may be used to present information such as a selected scale 704. In this illustration, the display 702 shows that the musician 102 has selected the B Phrygian scale. Menu keys 110 may be used to select a different scale. In other implementations, other types of input, such as input provided using other keys 106 of the input device 104, a touch sensor associated with the display 702, audio input provided to a microphone, and so forth, may be used to control the selected scale. In some implementations, the display 702 may also be used to display other information, such as a current note 118 or chord 120 that is playing.

The keys 106 may have a key spacing 706 that provides a suitable physical separation to minimize inadvertent key actuation while also providing ready accessibility to the keys 106 by the musician 102. For example, the key spacing 706 may be between 18 and 30 millimeters from center to center. In one implementation, the key spacing 706 may be 20 mm from center to center of adjacent keys 106. The keys may also have a key width 708 that provides a suitable area to facilitate key actuation and accessibility. In some implementations, the key width 708 may be between 10 and 25 mm. In one implementation, the key width 708 may be 22 mm.

The keys 106 may be arranged in various layouts. In the layout depicted in FIG. 7A, there are 48 chord keys 114 that are arranged in four rows of twelve keys 106. Additionally, FIG. 7A depicts 32 melody keys 116 arranged in four rows of eight keys 106. During operation, depending upon the selected scale 704, some of the keys 106 may be unassigned. For example, the B Phrygian scale only utilizes 28 notes. As a result, four melody keys 116 may be unassigned. In some implementations, unassigned keys 106 may be manually assigned selected chords 120 or notes 118 via user input. For example, using the control keys 112, menu keys 110, or other keys 106 of the input device 104, a musician 102 may select a particular unassigned key 106 and a particular chord 120 or note 118 to be associated with the unassigned key 106. In one implementation, a musician 102 may select a particular chord 120 by actuating a chord key 114 and multiple unassigned keys 106 may each be associated with individual notes 118 contained within the particular chord 120. Assignment of unassigned keys 106 is described in more detail with regard to FIG. 7C.

The chord keys 114 or the melody keys 116 may have different numbers of rows or columns, may include fewer or greater numbers of keys 106, and so forth. In other implementations, other layouts of the keys 106 may be used. For example, the chord keys 114 and the melody keys 116 may be arranged in concentric arcs. In some implementations, the chord keys 114 may be arranged on the right of the input device 104 while the melody keys 116 are arranged on the left of the input device 104.

When present, the menu keys 110 and the control keys 112 may be arranged in other ways as well, or in other locations with respect to the input device 104. For example, the control keys 112 may be arranged in a row rather than a square grid arrangement as depicted in FIG. 7A.

Attributes such as the key spacing 706, key width 708, and so forth may vary between different keys 106 within a group of keys 106, or from one group of keys 106 to another. For example, the chord keys 114 may have a smaller key spacing 706 and smaller key width 708 than the melody keys 116, allowing more chord keys 114 to be placed in a smaller area.

Figure 7B:
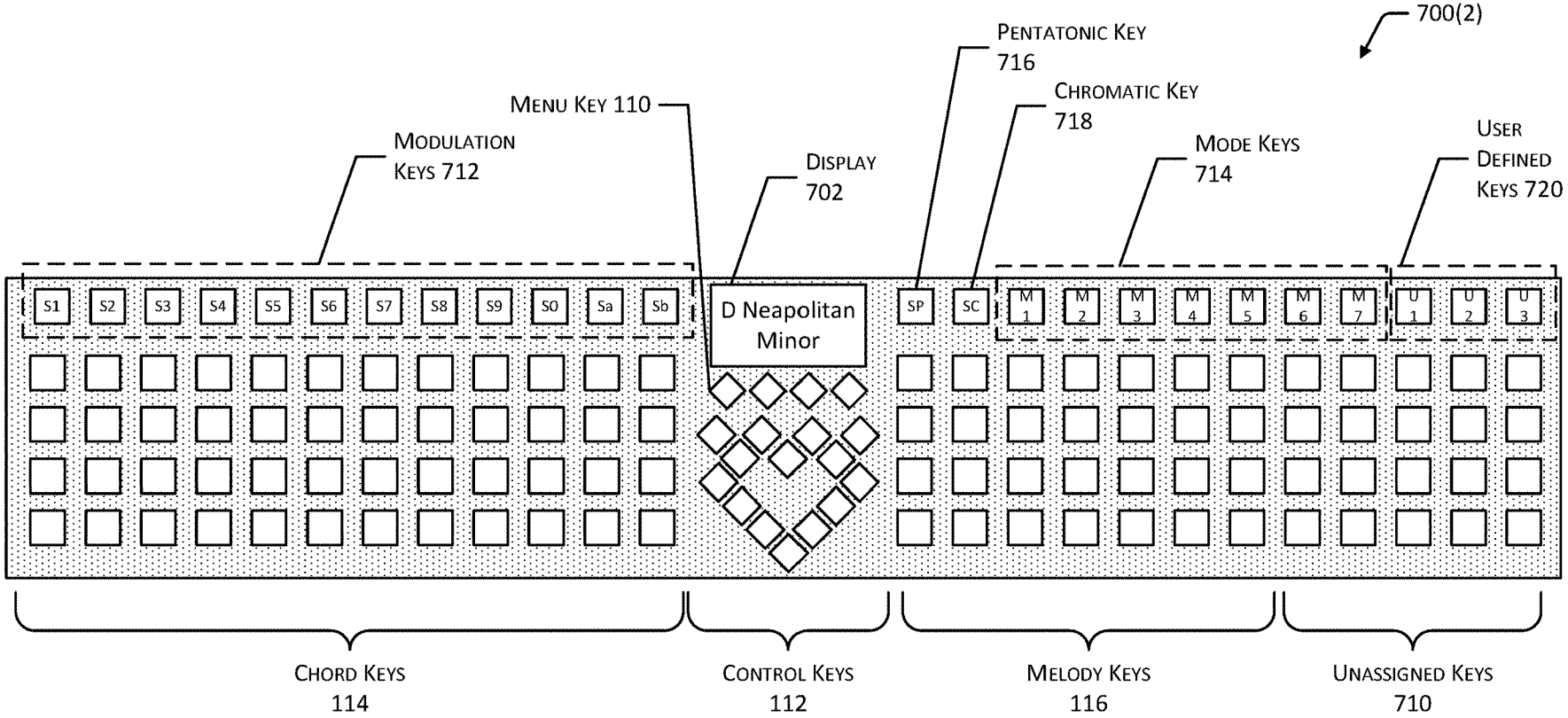
FIG. 7B depicts another layout of the input device, according to one implementation.

FIG. 7B depicts another layout 700(2) of the input device 104, according to one implementation. Similar to the implementation shown in FIG. 7A, the input device 104 may include a display 702 that may indicate a scale selected by a musician 102 and in some implementations, other information such as one or more chords 120 or notes 118 that are currently being played. For example, FIG. 7B depicts the display 702 indicating a selected scale of D Neapolitan Minor. Menu keys 110, other keys 106, or other devices for providing input to the input device 104 may be used to select scales and control other functions of the input device 104.

As discussed previously, in response to the selected scale, the chord keys 114 may be configured to cause output of particular chords 120 associated with the scale when actuated, while the melody keys 116 may be configured to cause output of particular notes 118 within the scale when actuated. In some cases, the input device 104 may include one or more unassigned keys 710. For example, FIG. 7B depicts the input device 104 including two sets of 48 keys, separated by the control keys 112 and display 702. In some cases, a scale may have fewer than twelve notes 118, in which case one or more keys 106 included in the set of keys 106 assigned as melody keys 116 may be unassigned keys 710. In some implementations, the unassigned keys 710 may be assigned particular chords 120 or notes 118 based on user input, as described with regard to FIG. 7C.

In some implementations, the input device 104 may include one or more modulation keys 712 that may be actuated by a musician 102 to change the root note of the selected scale quickly. For example, while playing music using the input device 104, a musician may wish to modulate the musical key associated with the music without selecting a different scale using the menu keys 110 and display 702. In such a case, the musician 102 may actuate one of the modulation keys 712 to immediately change the root note of the currently-selected scale. The musical mode of the selected scale may be retained while the root note is changed in this manner. For example, a modulation key 712 corresponding to the note of "C" may be used to quickly change the input device 104 from a selected scale of G melodic minor to a scale of C melodic minor, changing the root note of the scale from G to C while retaining the musical mode of the scale as melodic minor. In response to actuation of a modulation key 712, each of the chord keys 114 and melody keys 116 may be associated with different chords 120 and notes 118 that correspond to the root note of the actuated modulation key 712. Additionally, the visual indicia 108 associated with the keys 106 may be modified to correspond to the new root note assigned to each key 106 subsequent to actuation of the modulation key 712.

For example, FIG. 7B depicts the input device 104 including twelve modulation keys 712 positioned in a horizontal row. However, other numbers and configurations of modulation keys 712 may also be used. Each modulation key 712 may correspond to a particular root note. For example, in FIG. 7B, the display 702 currently indicates that the D Neapolitan Minor scale has been selected. Actuation of a first modulation key 712 may shift the root note of the scale and each of the keys 106 to correspond to the C Neapolitan Minor scale. In response to actuation of the first modulation key 712, the information presented in the display 702 may also be updated. In a similar manner, actuation of a second modulation key 712 may cause the keys 106 to be configured to correspond to the C-sharp Neapolitan Minor scale, actuation of a third modulation key 712 may cause the keys 106 to be configured to correspond to the D Neapolitan Minor scale, actuation of a fourth modulation key 712 may cause the keys 106 to be configured to correspond to the D-sharp Neapolitan Minor scale, and so forth. For example, if the input device 104 includes twelve modulation keys 712, each modulation key 712 may correspond to a respective semitone. Continuing the example, the left-most modulation key 712 may correspond to the note of C, while each successive modulation key 712 progressing from left to right ascends one semitone, with the right-most modulation key 712 corresponding to the note of B. In other implementations, the semitones associated with each modulation key 712 may vary based on the selected scale. For example, if the D Neapolitan Minor scale has been selected, the left-most modulation key 712 may correspond to the note of D, with each successive modulation key 712 ascending by one semitone. In such a case, the root notes associated with each modulation key 712 may be assigned when a scale is selected by a musician 102. In other implementations, modulation keys 712 may correspond to other intervals, such as quartertones or other microtones. For example, an input device 104 may include twenty-four modulation keys 712, each corresponding to a respective quartertone. As another example, modulation keys 712 may correspond to intervals larger than one semitone. Continuing the example, an input device 104 may include fewer than twelve modulation keys 712, and the modulation keys 712 may correspond to notes 118 within a selected scale rather than individual semitones. Use of the modulation keys 712 to enable immediate selection of each possible root note for a selected scale may enable a musician 102 to generate output in multiple musical keys without requiring the musician 102 to navigate a menu or other type of user interface to select alternate scales each time a change in the musical key is desired.

In some implementations, the input device 104 may include one or more mode keys 714. Mode keys 714 may be actuated by the musician 102 to change the mode of the selected scale quickly, while retaining the root note of the scale. For example, a musician 102 generating music using the input device 104 with a selected scale of D Neapolitan Minor may wish to execute a modal interchange and continue generating music using the scale of D Hungarian Gypsy. A modal interchange may include a change in the scale associated with a piece of music in which the root or tonic note of the scale remains the same, but the notes 118 within the original scale change to the notes 118 associated with a different mode of the scale. For example, a modal interchange may be used when a musician 102 wishes to output chords from a parallel tonality or modality without ceasing use of a current musical key. In such a case, the musician 102 may actuate one of the mode keys 714, each of which may be associated with a different mode based on the root note of the currently-selected scale. In response to actuation of a mode key 714, one or more of the chord keys 114 or melody keys 116 may be associated with different chords 120 and notes 118 that correspond to the notes 118 within the scale that corresponds to the selected mode key 714. For example, the chords 120 and notes 118 associated with the mode indicated by the actuated mode key 714 may be determined, and the chord keys 114 and melody keys 116 of the input device 104 may be assigned to respective chords 120 and notes 118 within the new mode. Additionally, in some cases, the visual indicia 108 associated with one or more of the keys 106 may be modified to correspond to the new root note assigned to the key(s) 106 subsequent to actuation of the mode key 714. Information presented in the display 702 may also be updated in response to actuation of a mode key 714.

For example, FIG. 7B depicts the input device 102 including seven mode keys 714 positioned in a horizontal row. However, other numbers and configurations of mode keys 714 may also be used. Each mode key 714 may correspond to a different mode that shares a root note with the currently-selected scale. For example, in FIG. 7B, the display 702 currently indicates that the D Neapolitan Minor scale has been selected. A first mode key 714 may correspond to the D Neapolitan Minor scale, a second mode key 714 may correspond to the D Lydian #6 scale, a third mode key 714 may correspond to the D Mixolydian Augmented scale, a fourth mode key 714 may correspond to the D Hungarian Gypsy scale, a fifth mode key 714 may correspond to the D Locrian Dominant scale, a sixth mode key 714 may correspond to the D Ionian #2 scale, and a seventh mode key 714 may correspond to the D Ultralocrian bb3 scale. The mode associated with each of the mode keys 714 may be assigned in response to selection of a scale by the musician 102. Use of the mode keys 714 to enable immediate selection of a mode may enable a musician 102 to generate output using multiple modes that share a root note with the selected scale without requiring the musician 102 to navigate a menu or other type of user interface to select alternate scales each time a modal interchange is desired.

In some cases, the modulation keys 712 and mode keys 714 may both be used to change the root note and mode associated with the keys 106 of the input device 104. For example, a musician 102 may initially select the D Neapolitan Minor scale. Then, the musician 102 may actuate a modulation key 712 to change the root note of the scale to B. In response to actuation of the modulation key 712, the keys 106 of the input device 104 may be configured to correspond to the B Neapolitan Minor scale. The mode keys 714 may also be assigned to modes that correspond to the B Neapolitan Minor scale. Then, the musician 102 may actuate a mode key 714 that causes the keys 106 of the input device 104 to be configured to correspond to the B Hungarian Gypsy scale, thus executing a modal interchange while retaining the root note of B selected using the modulation key 712.

In some cases, one or more modes may be common to all or most selectable scales, and keys 106 on the input device 104 may remain assigned to those modes independent of the selectable scale. For example, while the depicted mode keys 714 may be assigned or otherwise associated with particular modes based on the scale that is selected by the musician 102, the input device 104 may also include a pentatonic key 716 and a chromatic key 718. The pentatonic key 716 may be actuated to configure the keys 106 of the input device 104 to correspond to the pentatonic scale that shares the same root note as the currently-selected scale. For example, after selecting the D Neapolitan Minor scale, actuating the pentatonic key 716 may cause the keys 106 of the input device 104 to be configured to correspond to the D Minor Pentatonic scale. The chromatic key 718 may be actuated to configure the keys 106 of the input device 104 to correspond to the chromatic scale that shares the same root note as the currently-selected scale. For example, after selecting the D Neapolitan Minor scale, actuating the chromatic key 718 may cause the keys 106 of the input device 104 to be configured to correspond to the D Chromatic scale. In some cases, different scales and different modes may be associated with a different number of notes 118. As a result, different numbers of keys 106 may be associated with notes 118 of a scale or may be unassigned keys 710 based on the scale that is selected. For example, a pentatonic scale may include only five notes 118, and when a pentatonic scale is selected, the input device 104 may be configured to include five columns of melody keys 116 and seven columns of unassigned keys 710. However, a chromatic scale may include twelve notes 118, and when a chromatic scale is selected, the input device 104 may be configured to include twelve columns of melody keys 116 and no unassigned keys 710. In other implementations, the input device 104 may include a different number of keys 106 than the two sets of 48 keys shown in FIG. 7B.

In some implementations, the input device 104 may include one or more user defined keys 720. User defined keys 720 may be used to quickly configure the keys 106 of the input device 104 to correspond to a scale or mode selected by a musician 102, independent of the scale or mode that is currently selected. For example, a musician 102 may use the menu keys 110 or control keys 112, one or more other keys 106 of the input device 104, or a separate computing device 128 to provide input configuring the user defined keys 720. Each user defined key 720 may be assigned a selected scale. Continuing the example, a musician 102 may assign a user defined key 720 to the B Phrygian scale. Subsequently, the musician 102 may select the D Neapolitan Minor scale and begin to generate music using the input device 104. In some cases, the musician 102 may modulate the root note associated with the selected scale using one or more modulation keys 712 or change the mode associated with the selected scale using one or more mode keys 714. Upon actuation of the user defined key 720, the keys 106 of the input device 104, including the modulation keys 712 and mode keys 714, may be configured to correspond to chords 120, notes 118, and modes associated with the B Phrygian scale. Subsequent actuations of modulation keys 712 may then be used to change the root note of the selected scale from B to a different root note, and subsequent actuations of mode keys 714 may be used to change the mode of the selected scale from Phrygian to a different mode. While FIG. 7B depicts the input device 104 including three user defined keys 720 adjacent to the mode keys 714, any number of user defined keys 720 may be positioned at any location on the input device 104.

Figure 7C:
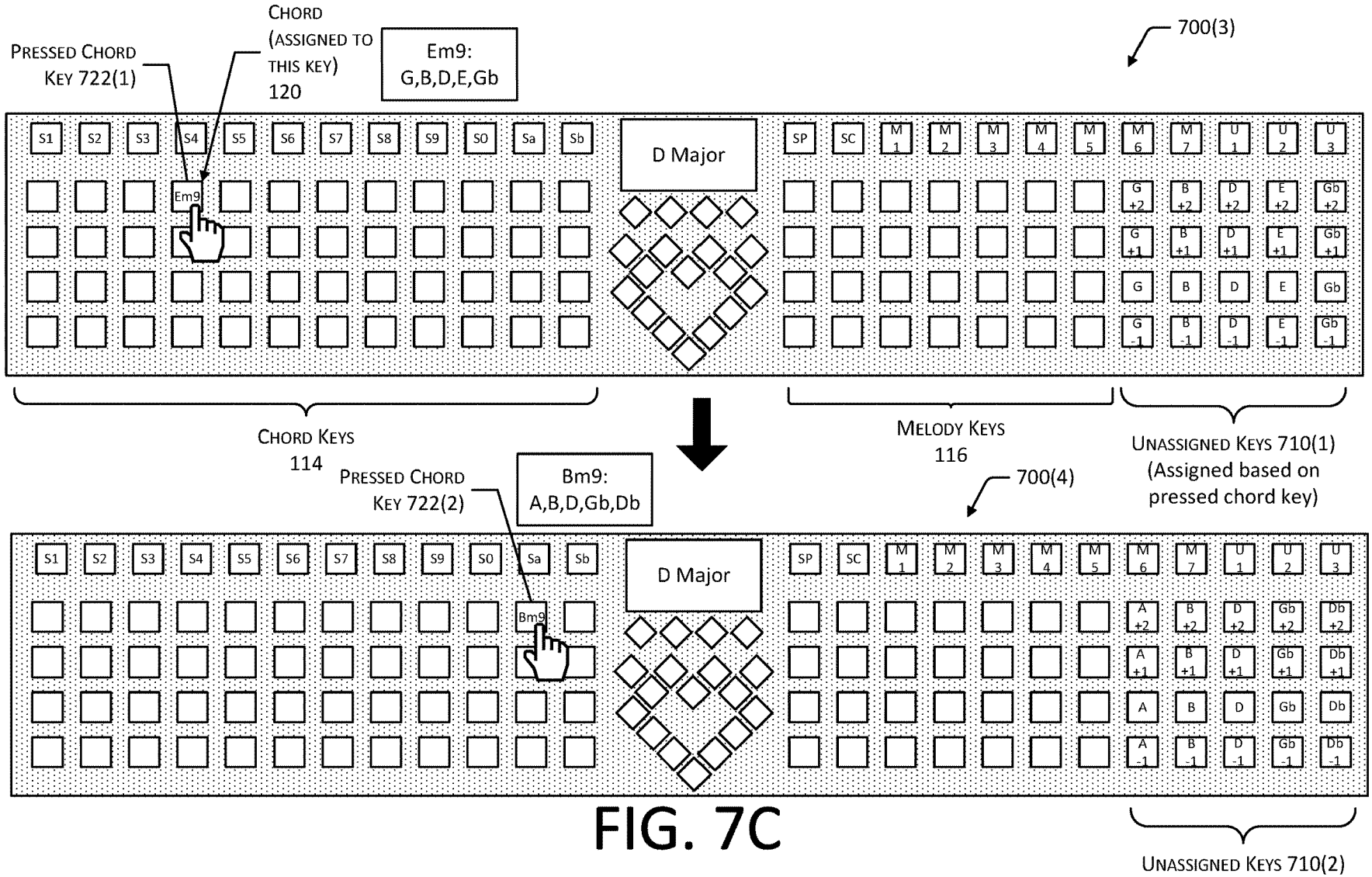
FIG. 7C depicts two layouts that configure unassigned keys of the input device based on a pressed chord key, according to some implementations.

FIG. 7C depicts layouts 700 that configure unassigned keys 710 of the input device 104 based on a pressed chord key 722, according to some implementations. For example, the input device 104 may include a live note update feature by which the functions of the unassigned keys 710 may be updated as other keys 106 of the input device 104 are actuated. As described with regard to FIGS. 7A and 7B, in some cases, assignment of chord keys 114 and melody keys 116 associated with a selected scale may not necessarily cause every key 106 of the input device 104 to be associated with a chord 120 or note 118. For example, FIG. 7C depicts a layout 700(3) of the input device 104 having two sets of 48 keys 106 in which the D Major scale has been selected. The first set of keys 106 may be designated as chord keys 114, each chord key 114 corresponding to a chord 120 associated with the D Major scale. However, only a portion of the second set of keys 106 may be designated as melody keys 116 due to the D Major scale having only seven melodic notes 118. As such, FIG. 7C depicts 28 keys 106 of the second set designated as melody keys 116, while 20 keys 106 of the second set are unassigned keys 710.

In some cases, a musician 102 may wish to play melody notes 118 that are included within a chord 120 that is currently being output. For example, the output of a melody having notes 118 contained within a chord 120 that is currently being output may avoid producing dissonant or non-aesthetic combinations of notes. While the chord keys 114 and melody keys 116 may be provided with colors or other visible indicia 108 that may enable a musician 102 to visually recognize keys 106 associated with related notes 118, in some cases, the musician 102 may wish to quickly and reliably play melody notes 118 that are contained within a chord 120 that corresponds to a chord key 114 that is currently being actuated. In such a case, when a chord key 114 is actuated, the unassigned keys 710 may be assigned to notes 118 that correspond to the notes 118 of a chord 120 that is currently being output or the notes 118 of a chord 120 that corresponds to a currently pressed chord key 722.

For example, FIG. 7C depicts a first layout 700(3) in which the pressed chord key 722(1) corresponds to an E minor ninth (Em9) chord 120 that includes the notes G, B, D, E, and G-flat. In response to the actuation of the pressed chord key 722(1), the input device 104 may determine the chord 120 that corresponds to the pressed chord key 722(1) based on the selected scale, and the notes 118 included within the chord 120. Then, at least a portion of the notes 118 included within the chord 120 may be assigned to one or more of the unassigned keys 710(1). For example, FIG. 7C depicts the layout 700(3) including 20 unassigned keys 710(1), divided into four rows that each include five keys 106. Each unassigned key 710(1) within a row is shown associated with one note 118 of the determined chord 120, in ascending order from left to right. For example, each left-most unassigned key 710(1) is shown associated with the note G, followed by B, then D, then E, then G-flat, proceeding from left to right along each row. The rows of the unassigned keys 710(1) may be associated with different octaves. For example, an unassigned key 710(1) immediately above a key associated with the note G may cause a note of G that is one octave higher to be output, while an unassigned key 710(1) immediately below the key associated with the note G may cause a note of G that is one octave lower to be output. In some implementations, when the unassigned keys 710(1) are associated with the notes 118 that correspond to a pressed chord key 722(1), the unassigned keys 710(1) may also be provided with visible indicia 108 that correspond to the notes 118. For example, unassigned keys 710(1) that are associated with a note of G may be provided with the same color or a similar color as chord keys 114 associated with chords 120 having a root note of G and melody keys 118 associated with a note of G.

As such, when a musician 102 pressing a particular chord key 114 wishes to quickly and reliably cause the output of melodic notes 118 that are included within the chord 120 that corresponds to the chord key 114, the musician 102 may utilize the unassigned keys 710(1) that are assigned in response to the pressed chord key 722(1).

In some implementations, the unassigned keys 710 of the input device 104 may be quickly reassigned as part of a live note update function each time that the musician 102 presses a different chord key 114. For example, FIG. 7C depicts a second layout 700(4) that may occur after a musician 102 ceases actuating the first pressed chord key 722(1) and begins actuating a second pressed chord key 722(2). As shown in the second layout 700(4), the second pressed chord key 722(2) may correspond to a B minor ninth (Bm9) chord that includes the notes A, B, D, G-flat, and D-flat. In response to actuation of the second pressed chord key 722(2), the input device 104 may determine the chord 120 that is associated with the second pressed chord key 722(2) and the notes 118 included in the chord 120. Then, at least a portion of the unassigned keys 710(2) may be associated with one or more of the notes 118 included in the chord 120. For example, FIG. 7C depicts the second layout 700(4) associating each row of unassigned keys 710(2) with the notes of the Bm9 chord in ascending order, from left to right, with each row representing the notes 118 of the chord 120 in a different octave.

Through use of the unassigned keys 710 of the input device 104 in this manner, at least a portion of the keys 106 may dynamically change configuration at any time to correspond to a chord key 114 that is being actuated by the musician 102. In some implementations, the input device 104 may be configurable to activate or deactivate this feature. For example, if a musician 102 wishes to retain the current state of the unassigned keys 710(1), the musician 102 may deactivate this feature such that when a subsequent chord key 114 is pressed, the unassigned keys 710(1) are not reconfigured and remain associated with notes 118 included in a previously-played chord 120.

Figure 7D:
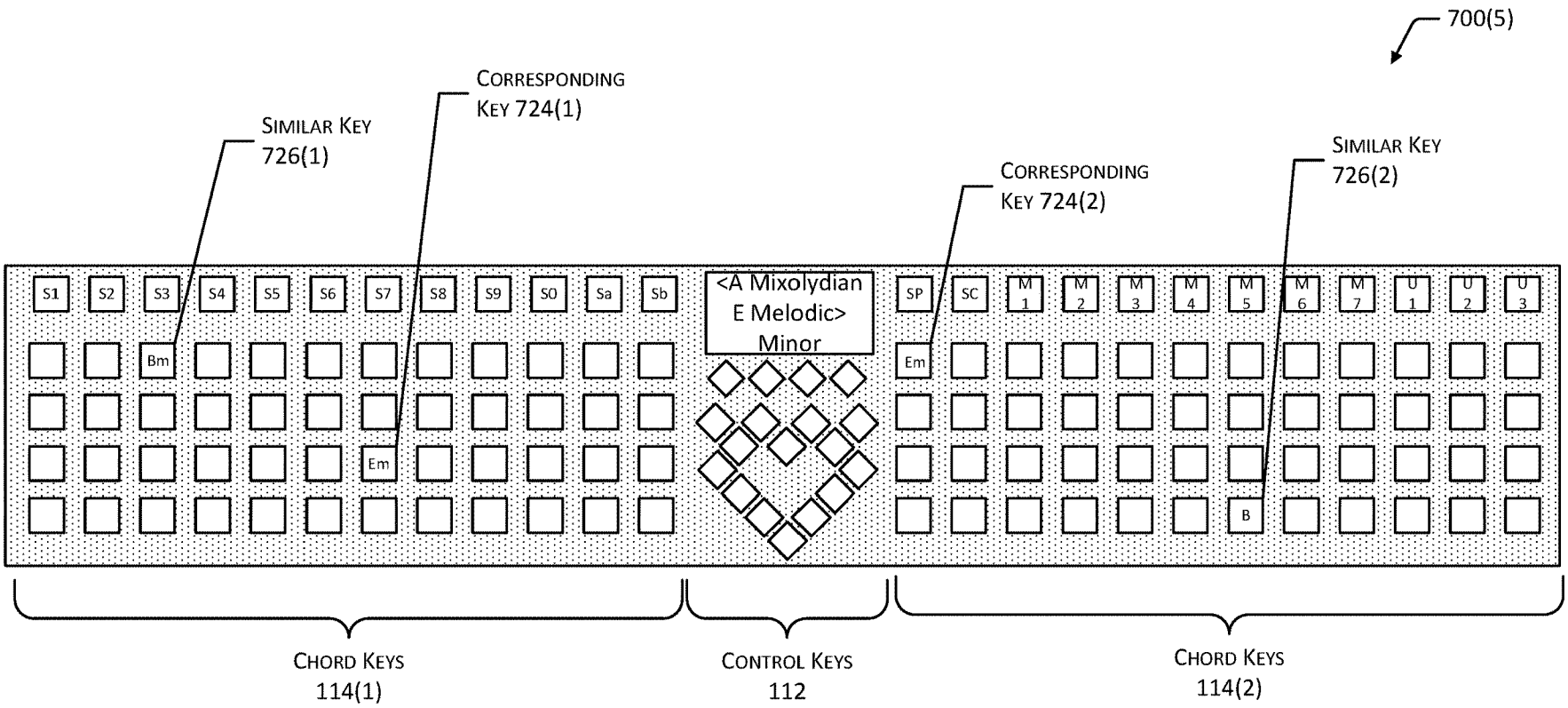
FIG. 7D depicts a layout of the input device, according to one implementation, in which the input device has been configured to include two sets of chord keys.

While FIGS. 7A-7C depict layouts 700 for an input device 104 that include chord keys 114, melody keys 116, and in some cases unassigned keys 710, in other implementations, one or more of the chord keys 114, melody keys 116, or unassigned keys 710 may be omitted. For example, FIG. 7D depicts a layout 700(5) of the input device 104, according to one implementation, in which the input device 104 has been configured to include two sets of chord keys 114.

For example, a musician 102 may select two different scales using menu keys 110, control keys 112, one or more other keys 106 of the input device 104, or a separate computing device 128. As shown in FIG. 7D, an example selection of two different scales may include the A Mixolydian scale and the E Melodic Minor scale. The depicted layout 700(5) for the input device 104 includes two sets of 48 keys 106, excluding the menu keys 110, control keys 112 and the top row of keys that includes the modulation keys 712, mode keys 714, pentatonic key 716, chromatic key 718, and user defined keys 720 described with regard to FIG. 7B. In response to the selected scales a first set of keys 106 may be designated as chord keys 114(1) that correspond to chords 120 associated with a first selected scale. For example, FIG. 7D depicts a first set of chord keys 114(1) that may each correspond to a chord 120 associated with the A Mixolydian scale. A second set of chord keys 114(2) may each correspond to a chord 120 associated with the E Melodic Minor scale. As described previously, in some implementations, one or more of the keys 106 may be provided with a visible indicia 108, such as a color, indicative of the root note associated with the chord 120 represented by the key 106. For example, keys 106 associated with chords 120 within the A Mixolydian scale that have a root note of A may be colored red, while keys 106 associated with chords 120 within the A Mixolydian scale having a root note of E may be colored blue. Similarly, the keys 106 representing chords 120 of the E Melodic Minor scale may be provided with colors or other visible indicia 108 based on the root note of each chord. In some implementations, the same visible indicia 108 may be used to represent the same characteristics in each set of chord keys 114. For example, all chord keys 114 having a root note of E, independent of the scale with which the represented chord 120 is associated, may be colored blue. In other implementations, different visible indicia 108 may be used to represent characteristics of chord keys 114 based on a scale with which the represented chord 120 is associated. For example, keys 106 associated with chords 120 within the A Mixolydian scale that have a root note of A may be colored red, keys 106 within the A mixolydian scale that are associated with a root note of E may be colored blue, keys 106 associated with chords 120 within the E Melodic Minor scale that have a root note of E may be colored red, while keys 106 within the E Melodic Minor scale that are associated with a root note of B may be colored blue.

In some cases, the sets of chords 120 associated with two different scales may include one or more identical chords 120. For example, the sets of chords 120 associated with A Mixolydian scale and the sets of chords 120 associated with E Melodic Minor scale may both include an E minor (Em) chord. Identical chords 120 shared between musical keys may be used for musical transitions, such as a diatonic common chord modulation. For example, a first portion of a piece of music may be played in a first scale, then, when a chord 120 that is common with a second scale is played, a second portion of the music may be played using the second scale, with the common chord 120 serving as a bridge or transitional element. To facilitate visual identification of chords 120 that are common between two selected scales, corresponding keys 724 on the input device 104 may be provided with visual indicia 108 to indicate the relationship between the corresponding keys 724. For example, a first corresponding key 724(1) that represents the E minor chord associated with the A Mixolydian scale may be provided with the same color as a second corresponding key 724(2) that represents the E minor chord associated with the E Melodic Minor scale. In some implementations, the visible indicia 108 indicating the relationship between the corresponding keys 724 may be presented when one of the corresponding keys 724 is actuated. For example, if a musician 102 actuates the first corresponding key 724(1), the second corresponding key 724(2) may increase in brightness, present a different color, pulse or flash with a particular pattern of light, or present another type of visible indicia 108.

In some cases, the sets of chords 120 associated with two different scales may include one or more similar chords 120, such as chords 120 that are not identical but may share a root note or one or more other notes. For example, the sets of chords 120 associated with A Mixolydian scale may include a B minor (Bm) chord, while the sets of chords 120 associated with E Melodic Minor scale may both include a B major (B) chord. Similar chords 120 shared between musical keys may be used as transitions in a chord progression, such as an altered common chord modulation. To facilitate visual identification of similar chords 120 between two selected scales, similar keys 726 on the input device 104 may be provided with visual indicia 108 to indicate the relationship between the similar keys 726. For example, a first similar key 726(1) that represents the B minor chord associated with the A Mixolydian scale may be provided with the same color or a related color as a second similar key 726(2) that represents the B major chord associated with the E Melodic Minor scale. A related color may include the same color presented with a different brightness, or a color having chromatic values within a threshold range of another color. For example, different shades of red may be considered related colors. In some implementations, the visible indicia 108 indicating the relationship between the similar keys 726 may be presented when one of the similar keys 726 is actuated. For example, if a musician 102 actuates the first similar key 726(1), the second similar key 726(2) may increase in brightness, present a different color, pulse or flash with a particular pattern of light, or present another type of visible indicia 108. The input device 104 may present corresponding visual indicia 108 for corresponding keys 724, for similar keys 726, or for both corresponding keys 724 and similar keys 726. In some implementations, the same visual indicia 108 may be used to represent both corresponding keys 724 and similar keys 726. In other implementations, different visual indicia 108 may be used to represent corresponding keys 724 than the visual indicia 108 used to represent similar keys 726.

Figure 7E:
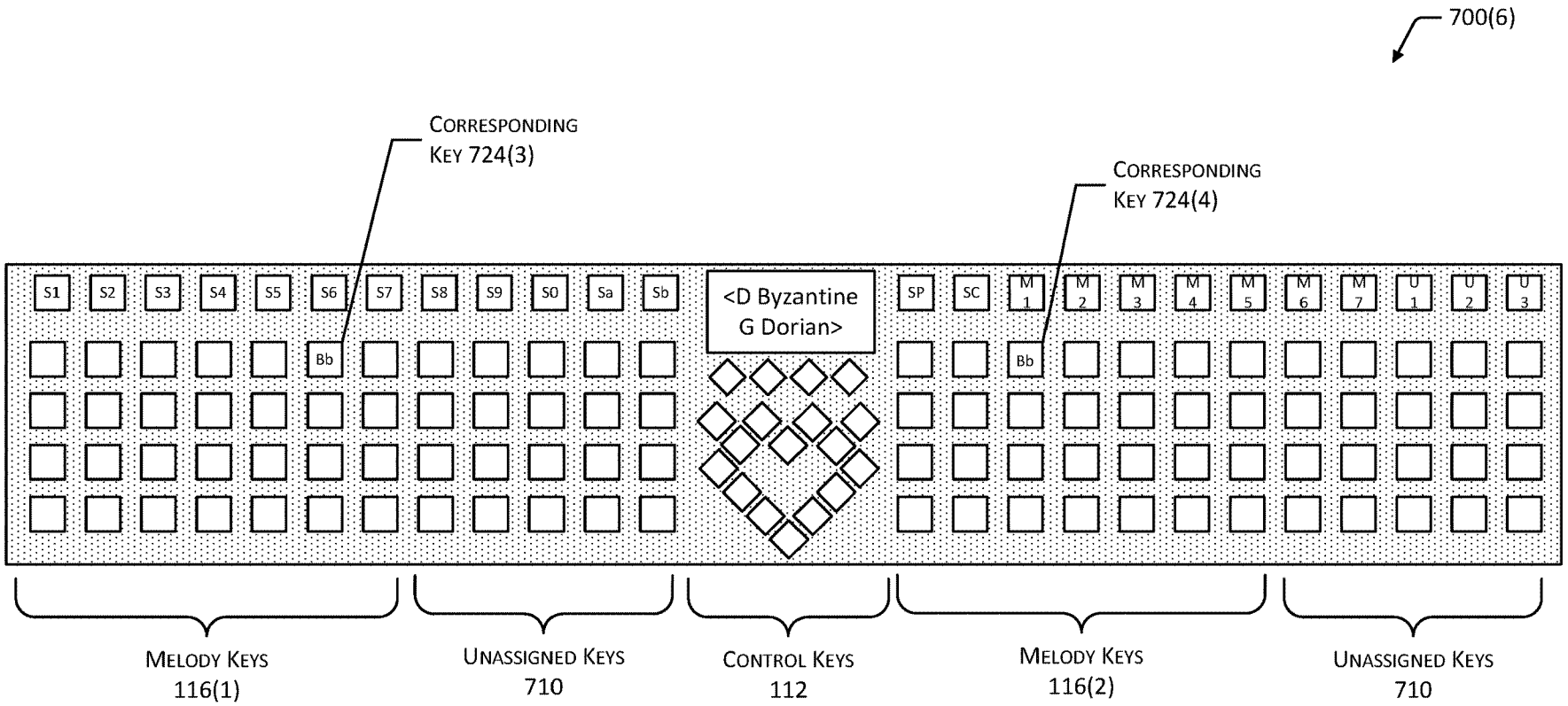
FIG. 7E depicts a layout of the input device, according to one implementation, in which the input device has been configured to include two sets of melody keys.

In some implementations, an input device 104 may instead be configured to include multiple sets of melody keys 116. For example, FIG. 7E depicts a layout 700(6) of the input device 104, according to one implementation, in which the input device 104 has been configured to include two sets of melody keys 116. In the depicted layout 700(6), a first selected scale may include the D Byzantine scale, while a second selected scale includes the G Dorian scale. A first set of melody keys 116(1), located on a first side of the input device 104, may be assigned to the melodic notes 118 associated with the D Byzantine scale. If the set of keys 106 on the first side of the input device 104 includes a larger number of keys 106 than the number of notes 118 associated with the D Byzantine scale, the first side of the input device 104 may also include one or more unassigned keys 710, which may be associated with chords 120 or notes 118 based on user input or may be dynamically reconfigured based on actuated keys 106, as described with regard to FIG. 7C. A second set of melody keys 116(2), located on a second side of the input device 104, may be assigned to the melodic notes 118 associated with the G Dorian scale. If the set of keys 106 on the second side of the input device 104 includes a larger number of keys 106 than the number of notes 118 associated with the G Dorian scale, the second side of the input device 104 may also include one or more unassigned keys 710.

In some cases, the two selected scales may include one or more identical melodic notes 118. For example, both the D Byzantine and G Dorian scales include a melodic note of B flat. In some implementations, corresponding keys 724 that are associated with the same melodic note 118 may be provided with the same or similar visible indicia 108, such as a same or related color. In other implementations, if one corresponding key 724(3) associated with a particular melodic note 118 is actuated, another corresponding key 724(4) associated with the same melodic note 118 may present a visual indicia 108, such as a particular color, brightness, light pattern, and so forth. In some implementations, other melodic notes 118 that have a relationship with the note 118 associated with an actuated melody key 116 may be provided visual indicia 108 to facilitate identification of related melody keys 116. Related melody keys 116 may include melody keys 116 that represent notes 118 having a selected interval therebetween, such as one semitone or less, a major third, a perfect fifth, an octave, and so forth.

Figure 8:
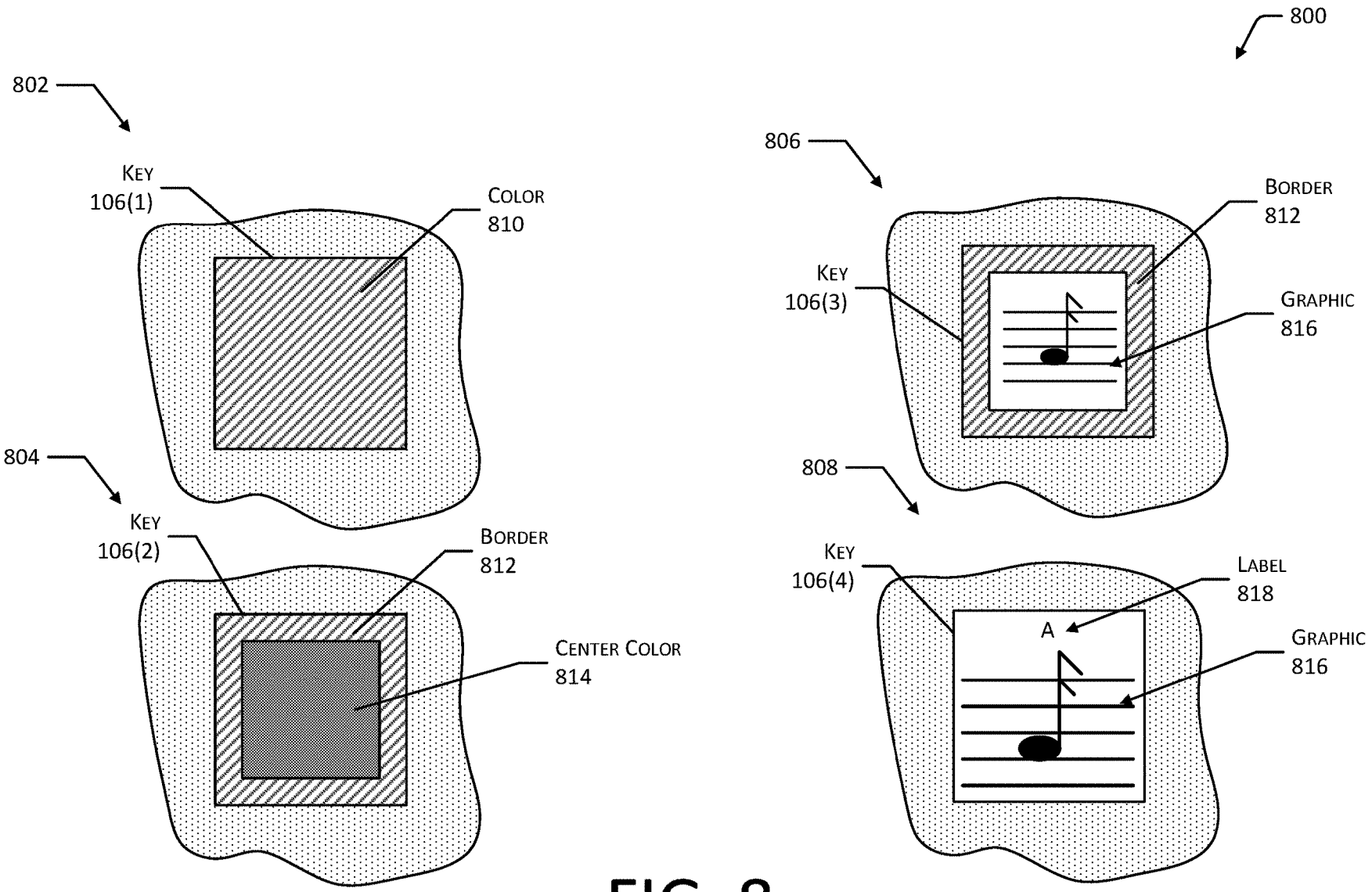
FIG. 8 depicts different visual indicia that may be presented by the input device, according to one implementation.

FIG. 8 depicts enlargements 800 of different example visual indicia 108 that may be presented by the input device 104, according to one implementation. As described previously, the visual indicia 108 may be produced by one or more visual indicators 216. For example, the visual indicators 216 may include light emitting diodes (LED), quantum dots, electroluminescent elements, electrophoretic elements, cholesteric elements, optically interferometric elements, and so forth. The visual indicators 216 may be emissive elements that they emit photons, or they may be reflective elements that reflect ambient light. For example, an LED is an emissive visual indicator 216. In comparison, liquid crystal, electrophoretic, cholesteric, and optically interferometric devices interact with ambient light to produce a visual effect.

The visual indicators 216 may be able to produce illumination of a particular color, change the apparent color, and so forth. Some visual indicators 216 may be poly chromatic while others may be monochromatic. For example, a multicolor LED may be able to produce red, green, blue, and is thus designated as polychromatic. In comparison, a reflective liquid crystal element or electrophoretic element may be monochromatic in that it presents the visual indicia 108 with one or more shades of a single color.

The visual indicators 216 may comprise segmented displays, pixelated displays, and so forth. For example, a segmented display such as a liquid crystal display may utilize predefined segments that may be selectively activated to produce a particular image. Continuing the example, the segment display may be configured to provide a rendering of a musical staff and notes 118 at one or more locations on that staff, such as an image representative of the notes 118 or chord 120 associated with a key 106. In another example, a pixelated display may comprise rows and columns of pixels that may be addressed either individually or in subgroups, such that a particular image may be produced.

Depicted are first 802, second 804, third 806, and fourth 808 implementations of visible indicia 108. The visible indicia 108 may utilize one or more of emissive or reflective visual indicators 216. The first implementation 802 depicts a key 106(1) in which a portion of the key 106 that is proximate to a musician 102 during use presents a particular color 810. For example, a transparent or translucent key cap of the key 106 may be illuminated by a red LED.

The second implementation 804 depicts a key 106(2) which includes a border 812 that surrounds a center color 814 with one or more of a different color or pattern. For example, the center color 814 may be green while the border 812 is blue. In one implementation, the center color 814 may be associated with a particular root note while the border 812 is associated with one or more other characteristics, such as a particular designation of a chord progression, or vice versa. As another example, the center color 814 or the border 812 of two keys 106 may be colored in a manner that indicates a relationship between the notes 118 or chords 120 represented by the two keys, such as corresponding or similar chords 120 or notes 118, as described with regard to FIGS. 7D and 7E. In this way, the musician 102 may be able to determine not only the root note of a particular key 106, but also other characteristics of a note 118 or chord 120, such as a particular type of chord 120 associated with the particular key 106 or the relationship between the note 118 or chord 120 represented by one key 106 and that represented by another key 106. In other implementations, other sections of the key 106(1) may be illuminated with different colors. For example, a left half of a key 106 may be red, and a right half of the key 106 may be blue.

The third implementation 806 depicts a key 106(3) that includes a border 812 surrounding a graphic 816. The graphic 816 may present a visual representation, such as an image, diagram, and so forth. For example, as depicted in FIG. 8, the graphic 816 may include a portion of a musical staff, a representation of a musical note 118 or chord 120 assigned to the key 106, and so forth. In other implementations, other graphics may be presented.

The fourth implementation 808 depicts a key 106(4) that presents a graphic 816 and a label 818. The label 818 may include text or other symbology that may provide an indication as to the function assigned to the key 106(4), such as text representing the name of a note 118 or chord 120. In other implementations, other graphics could be presented.

The various implementations described above are provided by way of illustration and not necessarily as a limitation. It is understood that various combinations of these and other visual indicia 108 may be utilized. For example, the first implementation 802 may also include one or more of a graphic 816 or a label 818.

In some implementations, a key 106 may utilize a combination of different visual indicators 216. For example, an LED may be used to provide colored illumination while a liquid crystal display presents a graphic 816, label 818, or other image.

In some implementations, different types of visual indicators 216 may be used by different keys 106 of the input device 104. For example, the chord keys 114 and the melody keys 116 may utilize an LED to illuminate the key while the menu keys 110 and the control keys 112 may utilize a display to present one or more of graphics 816, labels 818, and so forth.

In some implementations, instead of, or in addition to, the use of visual indicia 108, tactile or haptic indicia may be used to indicate the functions of one or more keys 106. For example, a key 106 may be configured to provide tactile output that allows the musician 102 to differentiate between keys 106 on the basis of touch. The key 106 may include an electroactive polymer, piezoelectric crystal, micro-electromechanical system, or other device that allows for the shape or texture of a portion of the key 106 to be changed. In another implementation, the key 106 may remain the same, but utilize an electrical signal to stimulate the nerves of a finger of the musician 102 to produce a particular haptic sensation. Varying the actual or apparent tactile response of a key 106 may enable a musician 102 to distinguish between different keys 106. For example, the key 106 assigned to the note of B may be smooth, the key 106 assigned to the note of C may be rough, the key 106 assigned to the note of D may be ridged, and so forth.

In some implementations, such as those in which the key 106 is generated electronically, the shape of the key 106 may be used to distinguish one key 106 from other keys 106. For example, the keys 106 associated with a note of B may be triangular, the keys 106 associated with a note of C may be square, and so forth.

In some implementations, the color, shape, texture, or more than one feature of the keys 106 may be manually configured. For example, the input device 104 may be associated with a particular scale, and key caps having a particular color, texture, and so forth may be manually placed at particular positions on the input device 104.

Figure 9:
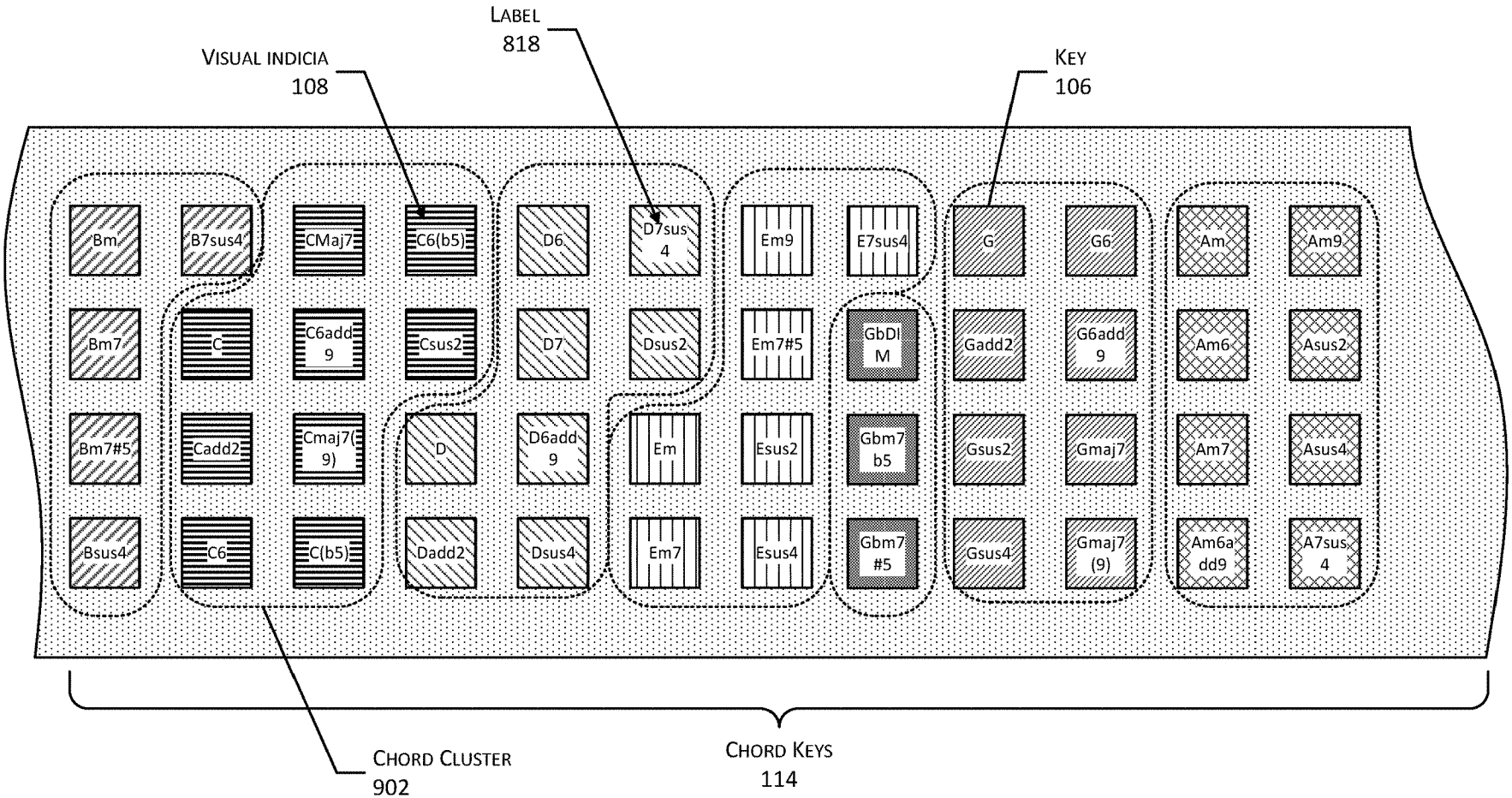
FIG. 9 depicts an enlarged view of the chord keys with visual indicia appropriate to a selection of a B Phrygian scale, according to one implementation.

FIG. 9 depicts an enlarged view 900 of the chord keys 114 with visual indicia 108 associated with a selection of a B Phrygian scale, according to one implementation. In FIG. 9, different colors 810 of the visual indicia 108 are represented by different crosshatch patterns. The labels 818 provide information about the particular chord 120 that is associated with a particular key 106 within the group of chord keys 114. However, in some implementations, labels 818 may be omitted and use of colors 810 to represent root notes of chords 120 assigned to chord keys 114 may be used. A grouping of keys 106 that are associated with a particular root note 118 may be designated as a chord cluster 902. For example, the chord cluster 902 associated with a root note of C may include nine chords 120 represented by nine respective keys 106. In some implementations, the keys 106 within the same chord cluster 902 may utilize the same visual indicia 108. For example, the keys 106 within the chord cluster 902 for the root note of C may each be colored orange. In some implementations, each key 106 associated with a chord 120 having the root note of C may present a different label 818 indicative of that particular chord 120. In other implementations, a colored border 812 or other feature of a key 106 may be used to indicate chords 120 having similar characteristics. For example, all major triads may have a border 812 that is colored blue, such that a major triad having a root note of C may include a key 106 that is colored orange, with a border 812 that is blue. Other characteristics of chords 120 that may be indicated using visual indicia 108 may include a number of notes 118 within a chord 120, particular notes 118 included within a chord 120, a type associated with the chord 120, and so forth.

The chords 120 represented by the chord keys 114 may be arranged in various sequences. For example, the chord keys 114 may be assigned chords 120 that increase in pitch from bottom to top in each column, or top to bottom in each column, then progress to the subsequent column from left to right. In another example the chord keys 114 may be assigned chords 120 in a serpentine layout, such that chords 120 increase from bottom to top in a first column, then from top to bottom in an adjacent second column, and so forth. Other arrangements may be used as well.

Depending upon the selected scale 704, the number of chords 120 associated with a particular root note 118 may vary. For example, the chord cluster 902 for the Gb root note 118 only comprises three chords 120, while the number of chords 120 associated with the C root note includes nine.

In other implementations, other layouts of chord clusters 902 and their associated chords 120 may be utilized. For example, each column of keys 106 within the chord keys 114 may be designated to a different root note 118. To fit within the number of keys 106 included in a column, some possible chords 120 associated with a scale may be omitted.

Figure 10:
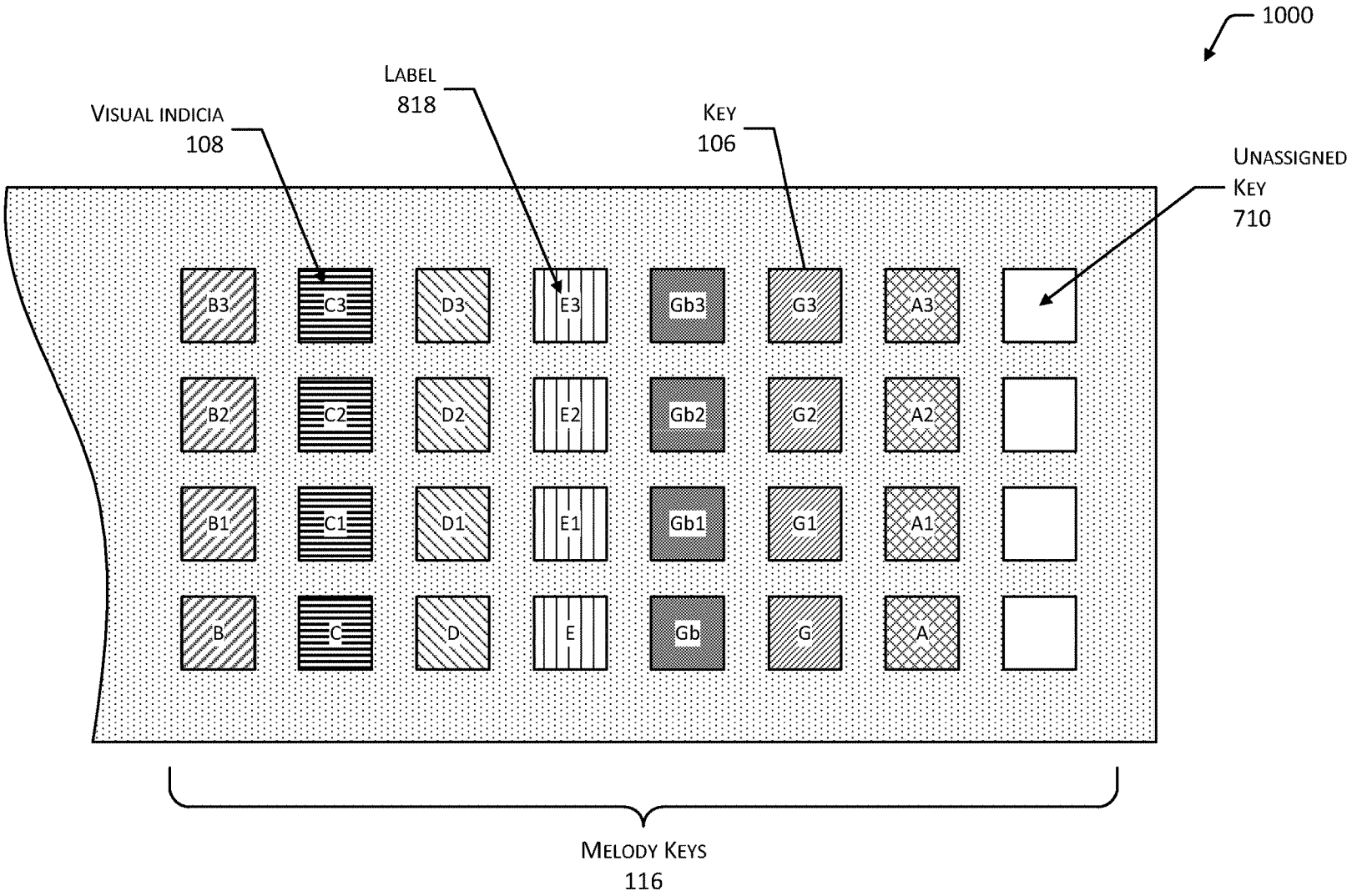
FIG. 10 depicts an enlarged view of the melody keys with visual indicia appropriate to a selection of a B Phrygian scale, according to one implementation.

FIG. 10 depicts an enlarged view 1000 of the melody keys 116 with visual indicia 108 associated with a selection of a B Phrygian scale, according to one implementation. In FIG. 10, different colors 810 of the visual indicia 108 are represented by different crosshatch patterns. For the sake of illustration, not necessarily as a limitation, the crosshatching is consistent from FIG. 10 to FIG. 9. For example, the crosshatching used to indicate the color 810 of the melody keys 116 associated with the note of C in this illustration is the same crosshatching used to indicate those chords 120 having a root note of C in FIG. 9. Continuing the example, to indicate the relationship between melody keys 116 associated with the note of C, chord keys 114 associated with chords 120 having a root note of C may be provided with the same color 810. In some implementations, labels 818 may provide information about the particular note 118 that is associated with a particular key 106 within the group of melody keys 116.

In the implementation depicted in FIG. 10, each column is associated with a different note 118, while each row of that column designates a different octave of the note 118. For example, the leftmost key 106 within a row may be associated with the note of B, while the uppermost row may be associated with a higher octave than the next lower row, which may be associated with a higher octave than the row below, and so forth. The notes 118 in the scale thus progress from lowest to highest in a left-to-right arrangement.

Some scales may utilize fewer notes 118 than other scales. As a result, based on the selection of the particular scale, some keys 106 may be unassigned. For example, when the B Phrygian scale is selected, as depicted in FIG. 10, the eighth column of keys 106 and any additional columns of keys, as depicted in FIGS. 7B through 7E, may remain as unassigned keys 710. In some implementations, the unassigned keys 710 may be designated to perform other functions. In other implementations, unassigned keys 710 may be manually assigned to cause output of chords 120 or notes 118 selected by a musician 102. In still other implementations, unassigned keys 710 may be dynamically assigned to notes 118 or chords 120 based on a chord key 114 currently actuated by a musician 120, as described with regard to FIG. 7C.

Because the assignment of a particular note 118 or chord 120 to a particular key 106 may vary with the selection of a scale, the use of consistent visual indicia 108 between the chord keys 114 and the melody keys 116 may aid a musician 102 in playing. For example, a musician 102 may readily determine if a root note 118 of a particular chord key 114 corresponds to a note 118 associated with a melody key 116.

Figure 11:
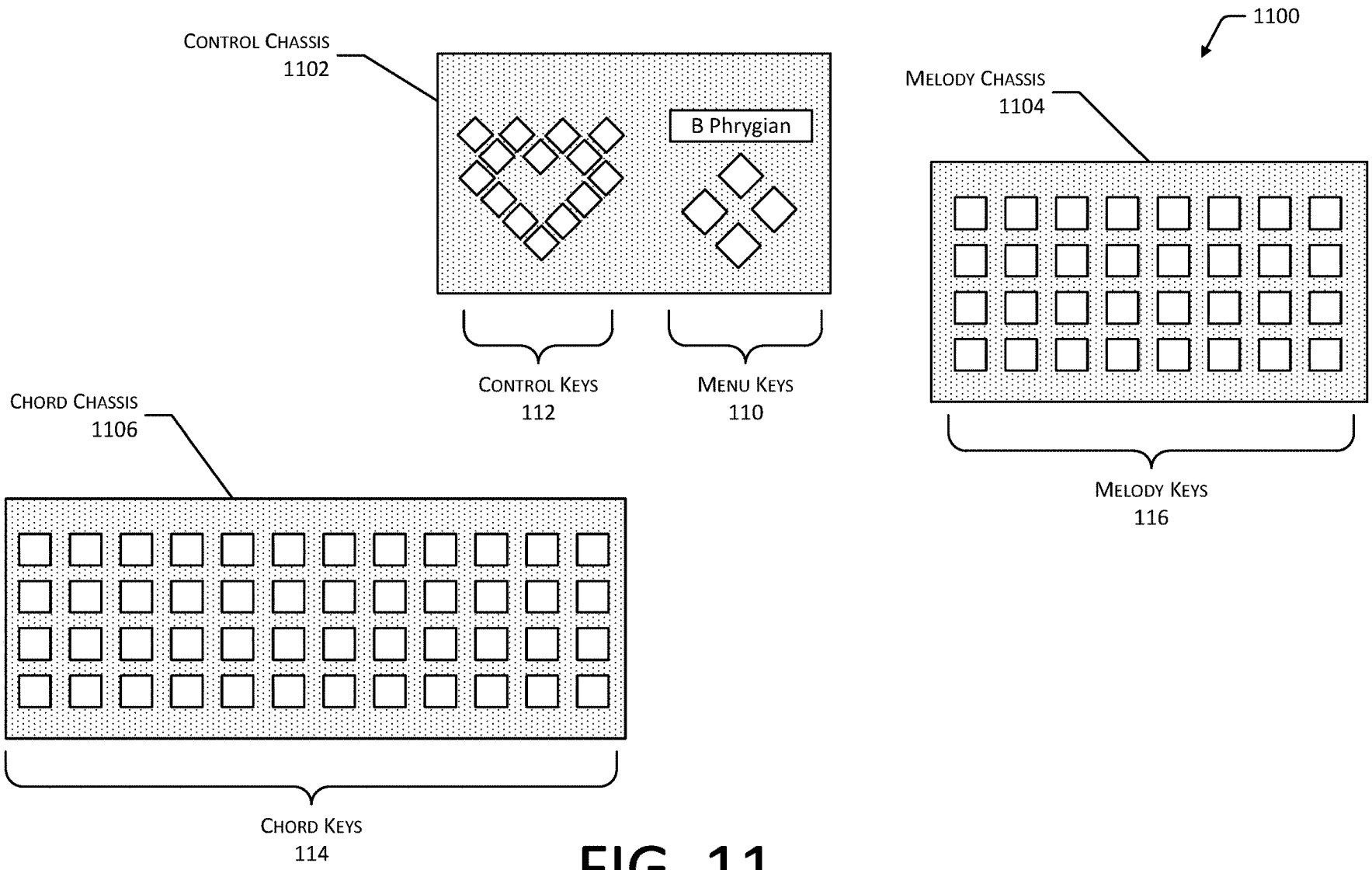
FIG. 11 depicts another configuration of the keys utilizing separate modules, according to one implementation.

FIG. 11 depicts another configuration 1100 of the keys utilizing separate modules, according to one implementation. For example, groupings of keys 106 need not be associated with a single chassis, but may instead be distributed across multiple chassis. A control chassis 1102 is depicted that includes the menu keys 110 and the control keys 112. A melody chassis 1104 that includes the melody keys 116 is shown, while a chord chassis 1106 that includes the chord keys 114 separate from the melody keys 116 is shown. In other implementations, other configurations may be utilized. For example, the chord chassis 1106 or the melody chassis 1104 may include the control keys 112. By utilizing separate chassis, a musician 102 may add desired functionalities, improve the ergonomics of play, and so forth. For example, the musician 102 may utilize two of the chord chassis 1106 units to provide an expansion for additional chords 120. Each chassis may include a communication interface 208 that allows for communication with one or more of the other chassis or with the computing device 128.

Figure 12:
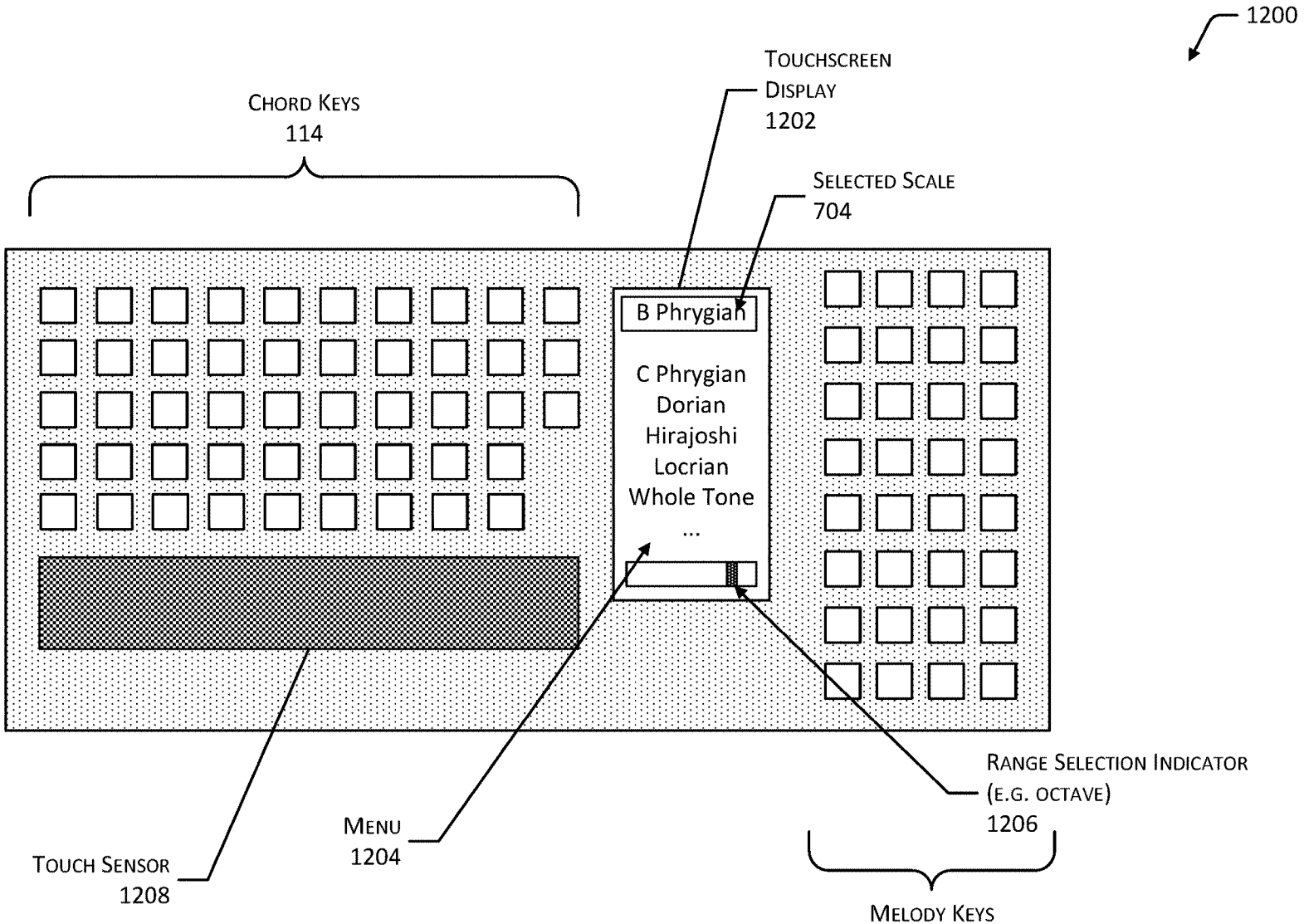
FIG. 12 depicts another configuration of the input device, according to one implementation.

FIG. 12 depicts another configuration 1200 of the input device 104, according to one implementation. In this implementation, the input device 104 utilizes a touchscreen display 1202. The touchscreen display 1202 presents a menu 1204 from which the musician 102 has selected a particular selected scale 704. Other information may also be presented on the touchscreen display 1202. For example, a range selection indicator 1206 may indicate the current setting as to which octave is in use. In some implementations, the touchscreen display 1202 may also indicate a chord 120 that is being output in response to actuation of a chord key 114.

FIG. 12 also depicts a touch sensor 1208. The touch sensor 1208 may provide additional input that may be used to control operation of the input device 104. For example, the touch sensor 1208 may include a one-dimensional touch sensor or a linear touch sensor that may be used to set the octave of the input device 104. Continuing the example, the musician 102 may touch the leftmost side of the touch sensor 1208 to select the lowest available octave or the rightmost side of the touch sensor 1208 to select the highest available octave.

Figure 13:
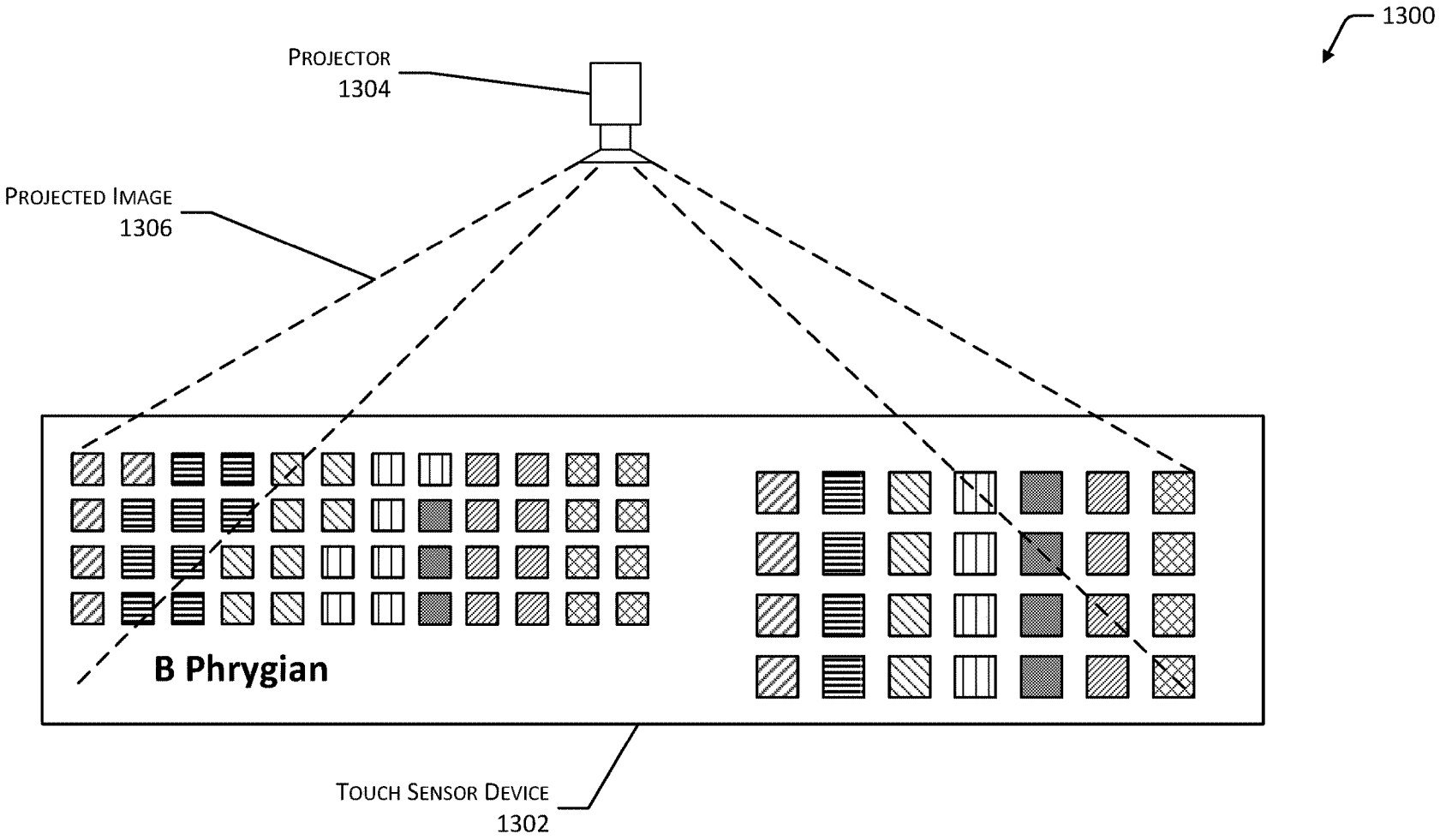
FIG. 13 depicts an input device using a projection of an image, according to one implementation.

FIG. 13 depicts an input device 1300 that utilizes a projection of an image, according to one implementation. In this implementation, a touch sensor device 1302, such as a touch sensitive mat or sensor array, may be configured to generate input indicative of a touch by the musician 102 at particular points on the touch sensor device 1302. For example, the touch sensor device 1302 may include one or more of a capacitive touch sensor, resistive touch sensor, a force sensing resistor, an optical touch sensor, and so forth. A display device, such as a projector 1304, may provide a projected image 1306 onto a surface of the touch sensor device 1302. In the implementation depicted in FIG. 13, the individual keys 106 may be virtual, having no discrete physical manifestation. As the musician 102 plays, the fingers of the musician 102 may contact the touch sensor device 1302 at different locations. The touch sensor device 1302 may provide output indicative of the contacted locations which may then be associated with a particular one of the keys 106 as projected onto the touch sensor device 1302.

As described above, attributes such as the key spacing 706, key width 708, and so forth may vary between different keys 106 within a group of keys 106 or from one group of keys 106 to another. For example, the chord keys 114 may have a smaller key width 708 than the melody keys 116.

In some implementations, the touch sensor device 1302 may be omitted. For example, a camera may acquire an image of at least a portion of the projected image 1306 and determine a position of the fingers of the musician 102. Data indicative of the position of the musician 102 may be used to generate output indicative of particular keys 106, notes 118, or chords 120. Other techniques or devices may be used to determine the location of the musician 102 with respect to the projected image 1306, or portions thereof.

In another implementation, other display devices may be used to provide the projected image 1306. For example, the display device may include a head mounted display device. The keys 106 of the input device 104 may be virtual, with the input device 104 including an electronic representation that is not associated with physical hardware. Instead, using one or more of augmented reality or virtual reality, the input device 104 and its corresponding keys 106 may appear to be present to the musician 102. The musician 102 may then play this virtual representation of the input device 104 by interacting with the virtual representation.

Figure 14:
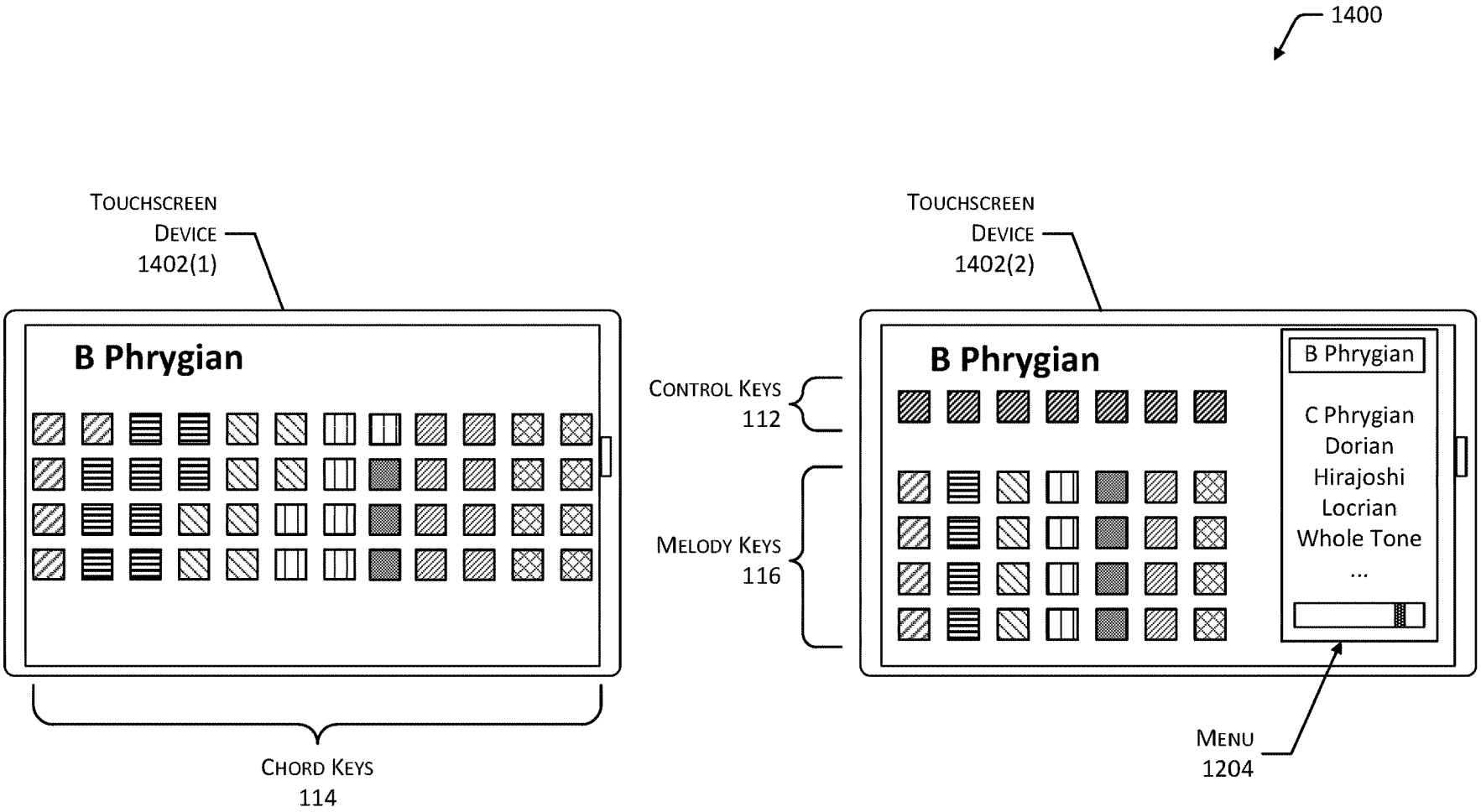
FIG. 14 depicts utilization of touchscreen devices as input devices, according to some implementations.

FIG. 14 depicts utilization of multiple touchscreen devices as input devices 104, according to some implementations. In the implementation depicted in FIG. 14, one or more touchscreen devices 1402 may be utilized to act as display devices that present the keys 106 and their associated visual indicia 108, as described above. The touchscreen devices 1402 may include one or more of tablets, computers, smart phones, touchscreen monitors, and so forth. The touchscreen devices 1402 may be of the same or different form factors. For example, one touchscreen device 1402 may include a tablet computer while another touchscreen device 1402 includes a smart phone.

In FIG. 14, two touchscreen devices 1402(1) and 1402(2) are depicted. The first touchscreen device 1402(1) is shown presenting chord keys 114, while the second touchscreen device 1402(2) is shown presenting control keys 112, melody keys 116, and a menu 1204.

Figure 15:
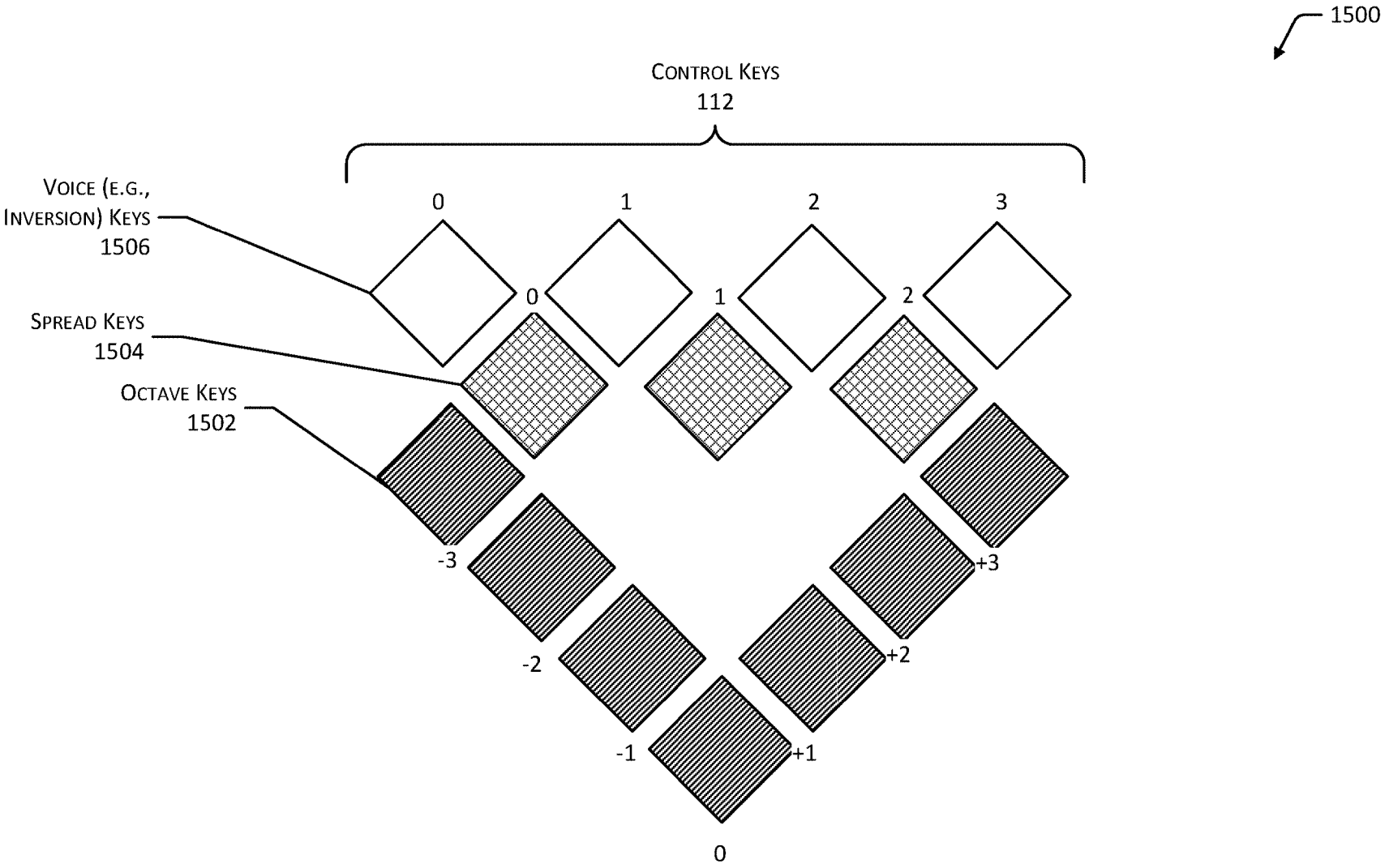
FIG. 15 depicts a layout of control keys, according to one implementation.

FIG. 15 depicts a layout of control keys 112, according to one implementation. The control keys 112 may be used to perform various control functions, such as changing a pitch associated with notes 118 that are output or adding one or more notes 118 to a chord 120 that is output. In the implementation shown in FIG. 15, there are seven octave keys 1502(−3) through 1502(+3). Activation of the octave keys 1502 may be used to shift the octave for play of one or more of the chord keys 114 or the melody keys 116. For example, if the octave key 1502(0) is activated, the note 118 associated with the melody key 116 or the notes 118 of a chord 120 associated with a chord key 114 may be output in a default octave based on the actuated key 106. However, if the octave key 1502(+1) is actuated, each note 118 associated with a melody key 116 or chord key 114 may be output one octave higher than a default octave. Similarly, if the octave key 1502(−1) is actuated, each note 118 associated with a melody key 116 or chord key 114 may be output one octave lower than a default octave. While FIG. 15 depicts seven octave keys 1502 spanning three octaves below and three octaves above a default octave, in other implementations, other numbers of octaves and octave keys 1502 may be used.

In some implementations, multiple octave keys 1502 may be actuated simultaneously, enabling a musician 102 to cause "stacked" octaves to be output. For example, if the octave key 1502(0) and the octave key 1502(+1) are both actuated, each note 118 associated with an actuated melody key 116 or chord key 114 may be output at both the default octave and at one octave higher than the default octave. For example, if each octave key 1502 is actuated, up to seven octaves of notes 118 may be output simultaneously, generating a richer, more resonant sound than output of notes 118 within a single octave. Any combination of octave keys 1502 may be actuated, causing notes 118 within any single octave or combination of octaves to be output.

FIG. 15 also depicts the control keys 112 including three spread keys 1504(0) through 1504(2). The spread keys 1504 may be used to select the spread of a chord 120. The spread of a chord 120 includes the interval between the lowest note and the highest note of the chord 120. For example, actuation of the spread key 1504(1) may result in the displacement of one note in a chord 120 by one octave. Continuing the example, actuation of the spread key 1504(1) may result in the lowest note 118 within a chord 120 being lowered by one octave, while actuation of the spread key 1504(2) may result in the lowest note 118 being lowered by two octaves. While FIG. 15 depicts three spread keys 1504, any number of spread keys 1504 may be used to displace one or more notes 118 within a chord 120. Additionally, in other implementations, spread keys 1504 may be used to raise the octave associated with one or more notes 118 within a chord 120, or to change the octave associated with notes 118 other than the lowest note 118 of the chord.

The control keys 112 may also include voice keys 1506 (0)-(3). Voice keys 1506 may allow the musician 102 to specify a particular note 118 of a chord 120 to be placed in the bass (e.g., lowest) position, such as by specifying a particular inversion of the chord 120. For example, actuation of the voice key 1506(0) may result in output of a non-inverted chord, actuation of the voice key 1506(1) may result in output of the first inversion of a chord, and so forth.

By utilizing one or more of the octave keys 1502, the spread keys 1504, or the voice keys 1506, the musician 102 may quickly and easily play a wide variety of different notes 118 and chords 120 associated with a particular scale, without requiring the musician to know the composition of the chord 120 before playing.

In some implementations, the control functions performed by the control keys 112 may be processed in a designated order to enable different types of chords 120 to be output. For example, the control functions provided by the voice keys 1506 may be processed first, to determine the arrangement of notes 118 within a chord 120. Then, the control functions provided by the spread keys 1504 may be processed, such that the lowest note of the voiced or inverted chord 120 may be lowered by one or more octaves. Then, the control functions provided by the octave keys 1502 may be processed to determine the octaves at which the voiced or inverted chord 120, having a note 118 affected by actuation of the spread keys 1504, may be output. For example, a chord 120 may include a C Major triad having the notes C, E, and G. A first voice key 1506 may be actuated to select a first inversion of the C Major triad, having the notes E, G, and Cp1. As used herein, capital letters may be used to indicate musical notes, such as the letters "E", "G", and "C" indicating corresponding musical notes. A lowercase "b" immediately following a capital letter may be used to denote a "flat", indicating a note one semitone below the indicated note, such as the letters "Gb" indicating a note of G-flat. A pound sign ("#") immediately following a capital letter may be used denote a "sharp", indicating a note one semitone above the indicated note, such as the notation "D#" indicating a note of D-sharp. The notation "−N" following a letter may be used to denote that the indicated note is one or more octaves below a default octave, with N being any integer. For example, the letter "C" may correspond to the note of middle C, while the notation "C-1" may correspond to a note of C that is one octave below middle C. The notation "pN" following a letter may be used to denote that the intended note is one or more octaves above a default octave, with N being any integer. For example, the notation "Cp1" may correspond to a note of C that is one octave above middle C. A first spread key 1504 may be actuated to lower the lowest note of the inverted chord 120 by one octave—in this case, the note of E, resulting in a spread, inverted chord 120 having the notes E-1, G, and Cp1. Then, three of the octave keys 1502(−1), 1502(0), and 1502(+1) may be actuated to cause output of the chord 120 in the default octave, as well as one octave lower and one octave higher than the default octave, simultaneously. As a result of the actuated voice key 1506, spread key 1504, and octave keys 1502, the chord 120 that is output may include the notes: E-2, G-1, C, E-1, G, Cp1, E, Gp1, and Cp2.

In other implementations, other control keys 112 may be present. For example, control keys 112 may be provided that allow for output of semitones, quartertones, or other microtones, audio effects, and so forth may be present. A greater or fewer number of each type of key may be present. For example, in some implementations there may be nine octave keys 1502, four spread keys 1504, and so forth.

The control keys 112 depicted in this illustration are arranged in an arrowhead pattern, with the voice keys 1506 on the uppermost portion, spread keys 1504 arrayed across the base of the arrowhead below the voice keys 1506, and octave keys 1502 arrayed beneath the spread keys 1504 to form the arrowhead pattern. In other implementations, other layouts may be utilized.

Figure 16A:
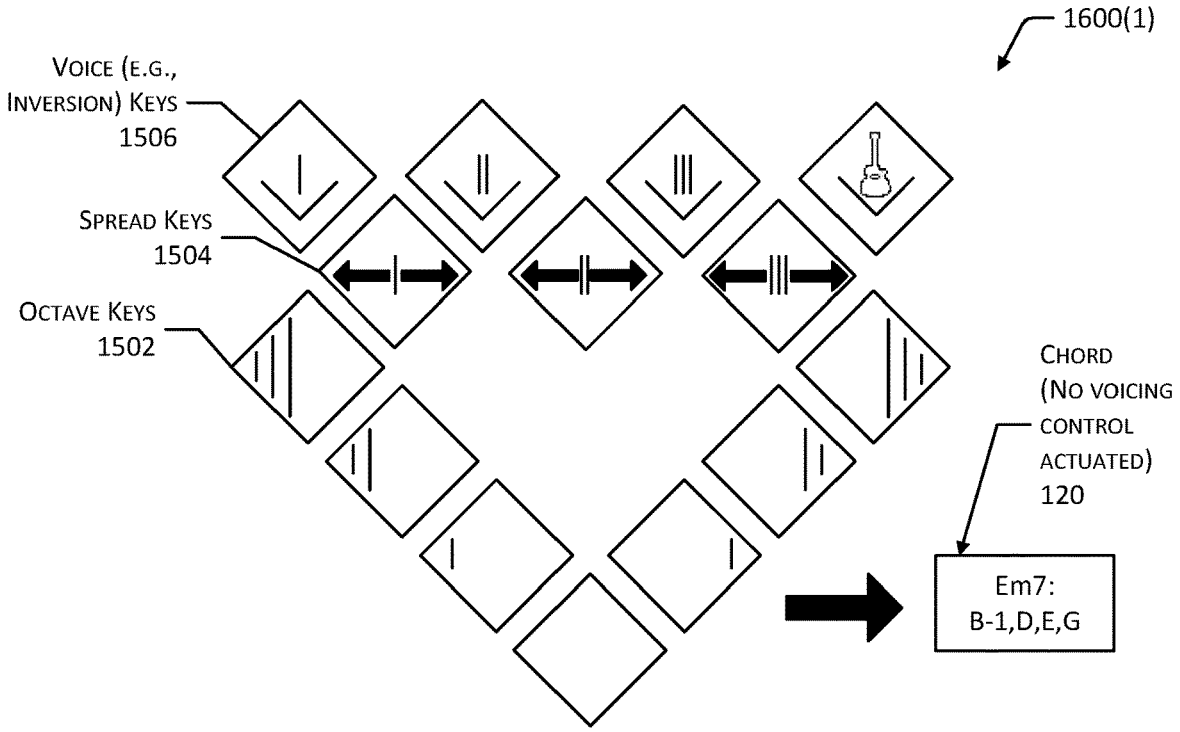
FIGS. 16A and 16B depict layouts of control keys, according to one implementation, that illustrate use of voice keys to control the voicing or inversion of chords.
Figure 16A:
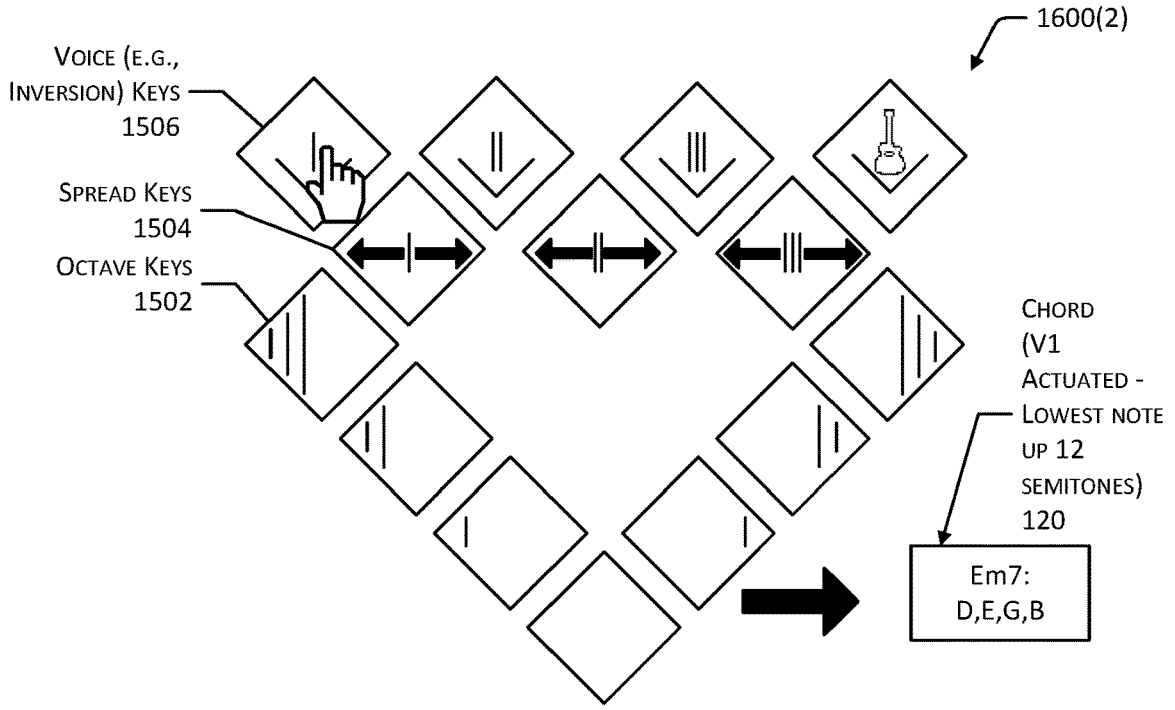
Figure 16B:
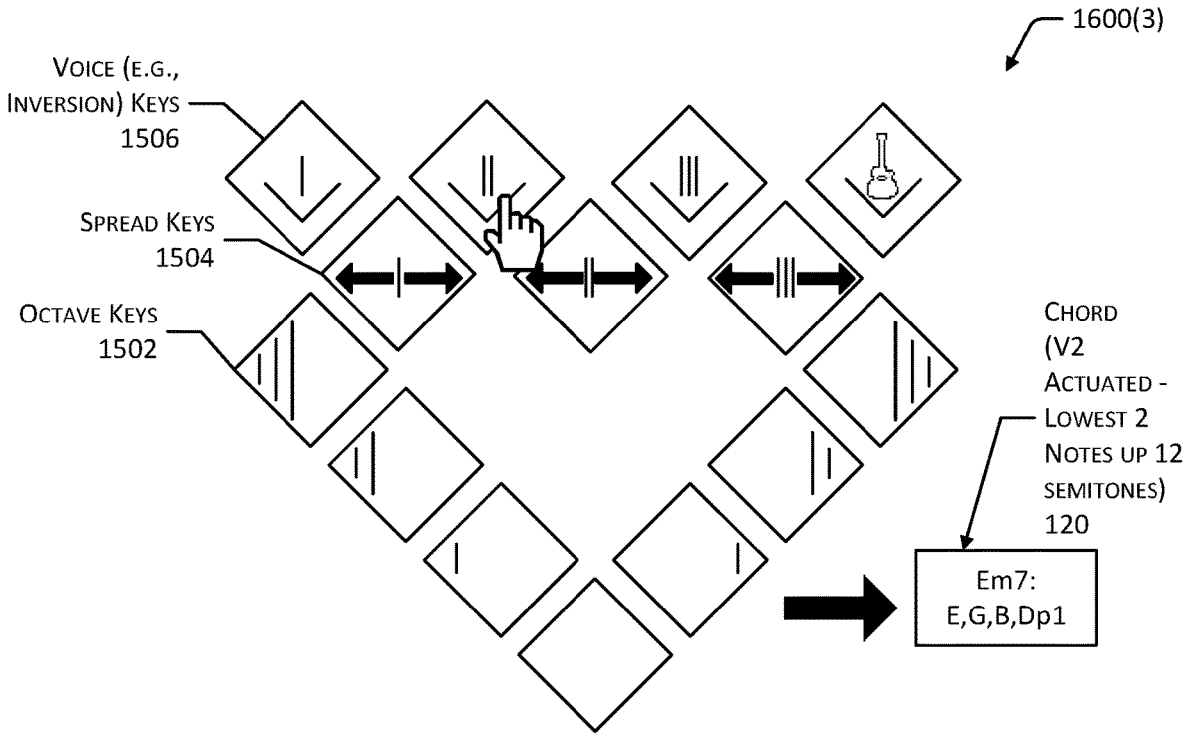
Figure 16B:
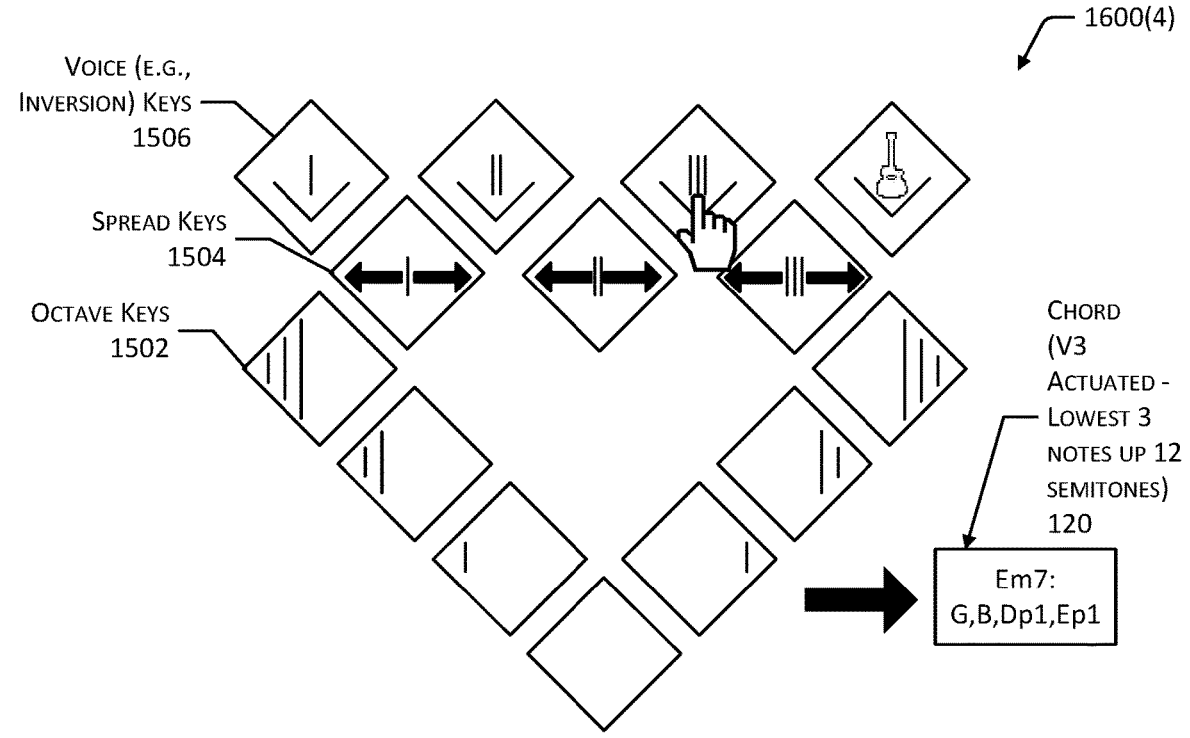

FIGS. 16A and 16B depict layouts 1600 of control keys 112, according to one implementation, that illustrate use of voice keys 1506 to control the voicing or inversion of chords 120. As described previously, a chord 120 may include multiple individual notes 118 that are output simultaneously or rapidly, such as an arpeggio. For example, a chord 120 may include from three to five individual notes. In some cases, the voicing of a chord 120 or the inversion associated with the chord 120 may be modified, such as by using the voice keys 1506. For example, the inversion or voicing of a chord 120 may determine which note 118 within the chord 120 is the lowest of the notes, and the order and arrangement of other notes 118 within the chord 120.

As one example, FIG. 16A depicts a layout 1600(1) of the control keys 112 in which none of the voice keys 1506 have been actuated. An example chord 120, shown as an E minor seventh (Em7) chord, may include the notes B, D, E, and G, with B being the lowest note of the chord 120. For example, FIG. 16A depicts the chord 120 notated as "B-1,D,E,G" to indicate that the note of B is within an octave that is lower than the octave associated with the other notes 118 of the chord 120.

FIG. 16A depicts a second layout 1600(2) of the control keys 112, showing actuation of a first voice key 1506. Actuation of the first voice key 1506 may cause the arrangement of notes in the example chord 120 to be changed. For example, in the second layout 1600(2), the arrangement of notes in the Em7 chord is shown as "D,E,G,B". Actuation of the first voice key 1506 may cause the lowest note of the original chord 120 (e.g., the note of B within the lower octave) to be raised one octave (e.g., twelve semitones), such that the note of D becomes the lowest note in the chord 120 and the note of B becomes the highest note in the chord 120.

FIG. 16B depicts a third layout 1600(3) of the control keys 112, showing actuation of a second voice key 1506. Actuation of the second voice key 1506 may cause the arrangement of notes 118 in the example chord 120 to be changed in a manner that differs from the arrangement shown in association with the first voice key 1506. For example, in the third layout 1600(3), the arrangement of notes in the Em7 chord is shown as "E,G,B,Dp1", which indicates that the note of D is played in an octave higher than the other notes 118 in the chord 120. Actuation of the second voice key 1506 may cause the lowest note 118 and the second lowest note 118 of the original chord 120 to both be raised one octave (e.g., twelve semitones), such that the note of E becomes the lowest note 118 in the chord and the note of D becomes the highest note 118 in the chord.

FIG. 16B also depicts a fourth layout 1600(4) of the control keys 112, showing actuation of a third voice key 1506. Actuation of the third voice key 1506 may cause the arrangement of the notes 118 in the example chord 120 to be changed in a manner that differs from the arrangements associated with the first voice key 1506 and the second voice key 1506. For example, in the fourth layout 1600(4), the arrangement of notes 118 in the Em7 chord is shown as "G,B,Dp1,Ep1", which indicates that the notes of D and E are played in a higher octave than the notes of G and B. Actuation of the third voice key 1506 may cause the lowest three notes 118 of the original chord 120 to each be raised one octave (e.g., twelve semitones), such that the note of G becomes the lowest note in the chord 120 and the note of E becomes the highest note in the chord 120. While FIGS. 16A and 16B describe use of voice keys 1506 to raise notes 118 within a chord 120 by one octave, in other implementations, a voice key 1506 may cause the pitch of one or multiple notes 118 in a chord 120 to be changed by other values greater or less than twelve semitones, including intervals that use quartertones or other microtones.

FIGS. 17A through 17F depict example layouts 1700 of control keys 112, according to one implementation, that use a guitar voicing key 1702 to transform chords 120 having fewer than six notes 118 to a chord 120 that includes six notes 118. For example, a musician 102 may wish to cause a chord 120 that includes three, four, or five notes 118 to be output in a manner that simulates the six strings of a guitar. If the guitar voicing key 1702 is actuated, rule data indicating one or more rules 1704 may be used to map the notes 118 of a chord 120 for an actuated chord key 114 to an alternate set of notes 118 that correspond to a guitar chord 120. The particular rules 1704 that are used to map the notes 118 of a first chord 120 to notes 118 of a guitar chord 120 may vary based on the number of notes 118 included in the first chord 120 and whether one or more other voice keys 1506 are actuated.

Figure 17A:
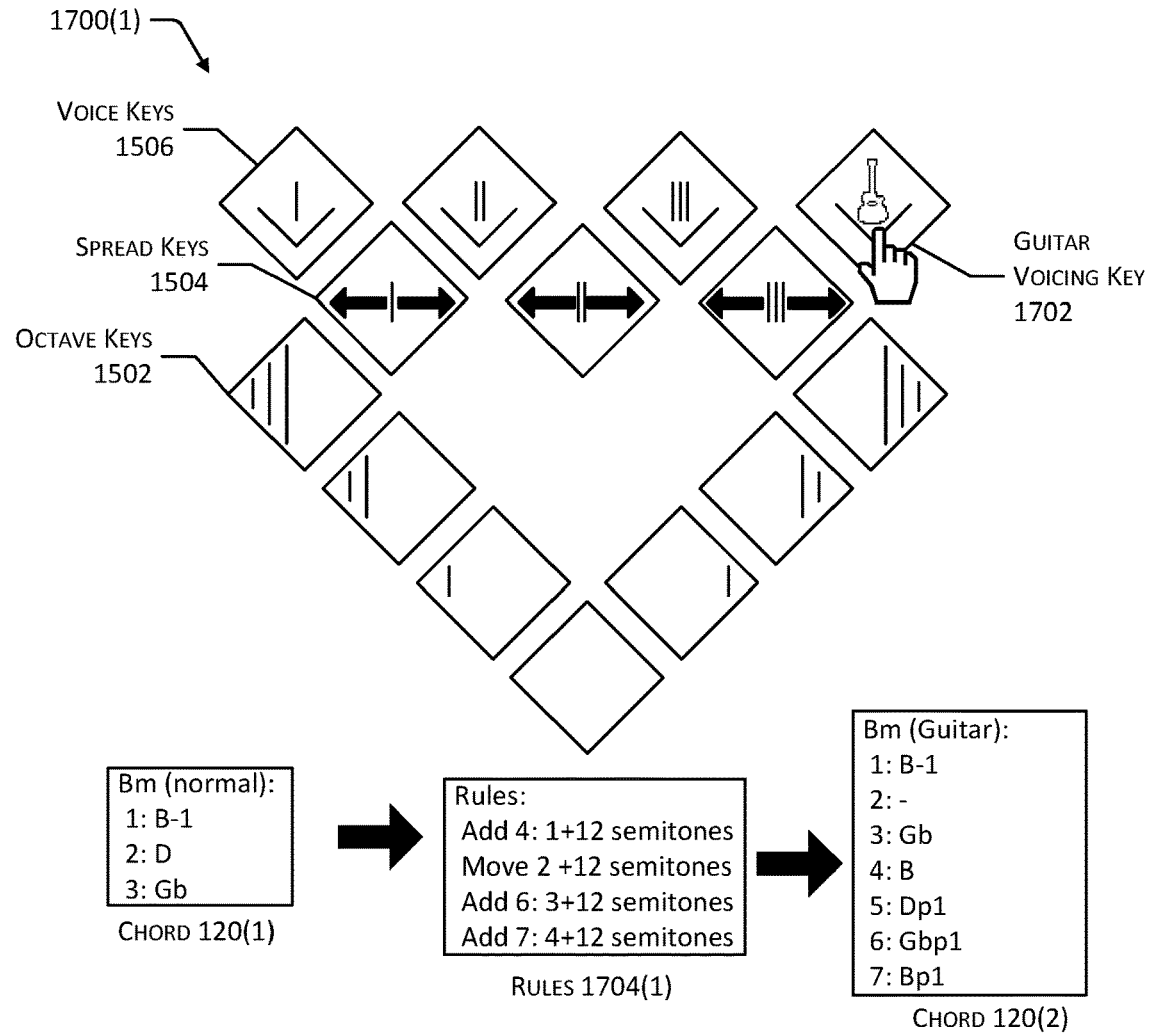
FIGS. 17A through 17F depict example layouts of control keys, according to one implementation, that use a guitar voicing key to transform chords having fewer than six notes to a chord that includes six notes.
Figure 17A:
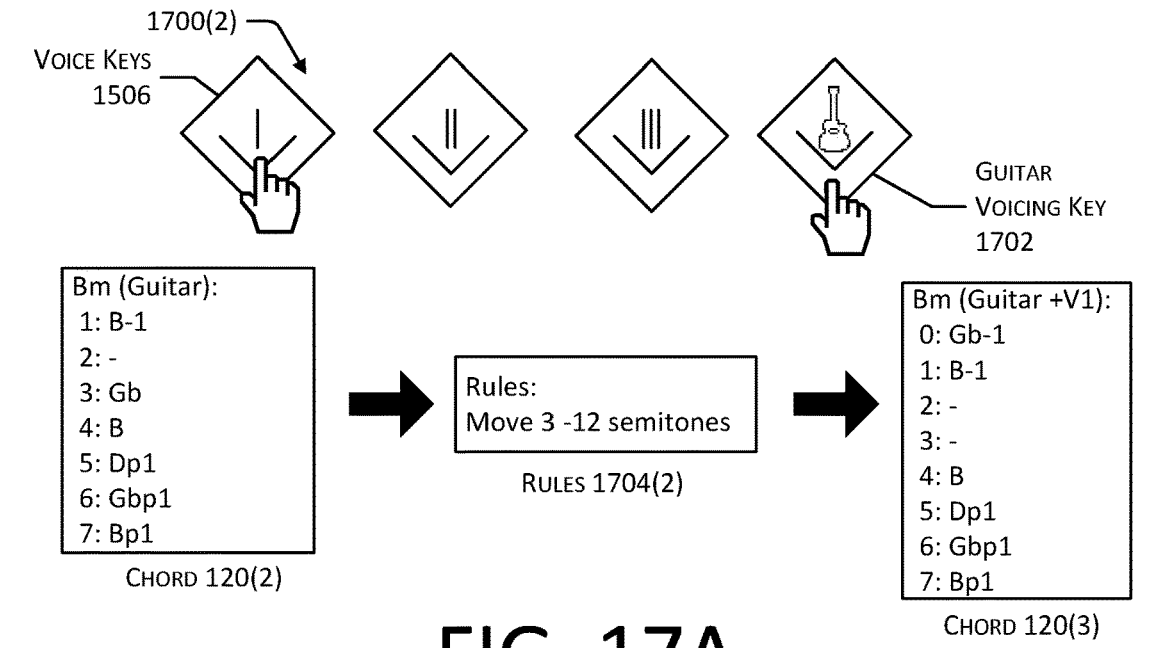

For example, FIG. 17A depicts a first layout 1700(1) in which the guitar voicing key 1702 is actuated, while none of the voice keys 1506 are actuated. An example chord 120(1) having three notes 118, a B minor (Bm) triad, may be mapped to an alternate set of six notes 118 that correspond to a B minor chord 120(2) that may be played using a guitar. For example, FIG. 17A depicts a first set of rules 1704(1) that may be applied to the three notes 118 of the first chord 120(1) to form a second chord 120(2). Specifically, the example rules 1704(1) add a fourth note 118 to the chord 120(1) that is one octave higher than the first note 118, move the second note 118 of the chord 120(1) one octave (12 semitones) higher, add a fifth note 118 to the chord 120(1) that is one octave higher than the third note 118, and add a sixth note 118 to the chord 120(1) that is one octave higher than the fourth note 118 (two octaves higher than the first note 118). As a result, an initial chord 120(1) having the three notes "B-1,D,Gb" may be transformed to a second chord 120 having the six notes "B-1,Gb,B,Dp1,Gbp1,Bp1". In other implementations, the voice keys 1506 and guitar voicing key 1702 may cause notes 118 within an initial chord 120(1) to be moved in intervals other than one octave and in some cases, intervals that include fractions of a semitone, such as quartertones or other microtones. For example, while FIGS. 17A-17F depict examples in which notes 118 are moved in intervals of 12 semitones and notes 118 that are one octave apart from existing notes 118 are added to chords 120, notes 118 that are spaced apart from other notes 118 in a chord 120 by other intervals may be added, and existing notes 118 of the chord 120 may be moved by other intervals. Additionally, while FIGS. 17A through 17F describe implementations in which chords 120 having less than six notes 118 may be transformed to chords 120 having six notes 118, in other implementations, a chord 120 having any initial number of notes 118 may be transformed to a chord 120 having any different number of notes 118 that is larger or smaller than the initial number of notes 118. For example, a chord 120 having six notes 118 may be transformed to a chord 120 having five or fewer notes 118, or a chord 120 having three notes 118 may be transformed to a chord 120 having twelve notes 118.

FIG. 17A depicts a second layout 1700(2) in which the guitar voicing key 1702 and the first voice key 1506 are actuated, and a chord key 114 for an initial chord 120(1) having three notes 118 is selected. In such a case, in addition to applying the rules 1704(1) described with regard to the first layout 1700(1) to the initial chord 120(1) to form the second chord 120(2), one or more additional rules 1704(2) may be applied to the second chord 120(2) to form a third chord 120(3) that is a voiced version of the second chord 120(2). Specifically, the second layout 1700(2) illustrates the second rules 1704(2) including the movement of the second note 118 of the chord 120(2) one octave lower. As a result, the second chord 120(2) having the notes "B-1,Gb,B,Dp1, Gbp1,Bp1" is transformed to a third chord 120(3) having the notes "Gb-1,B-1,B,Dp1,Gbp1,Bp1".

Figure 17B:
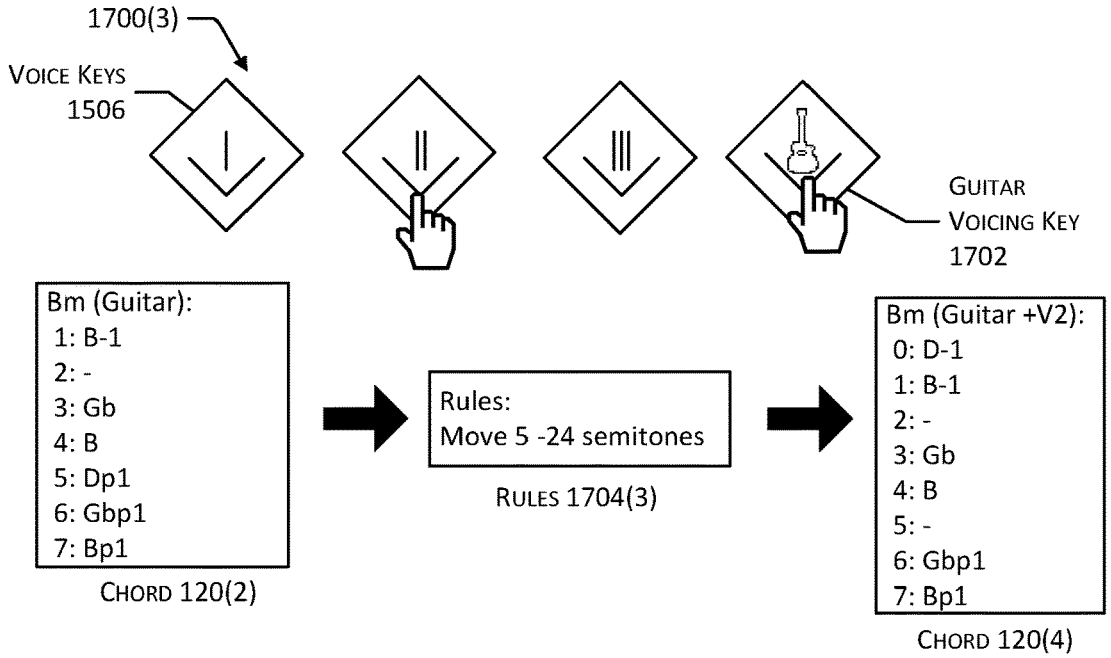
Figure 17B:
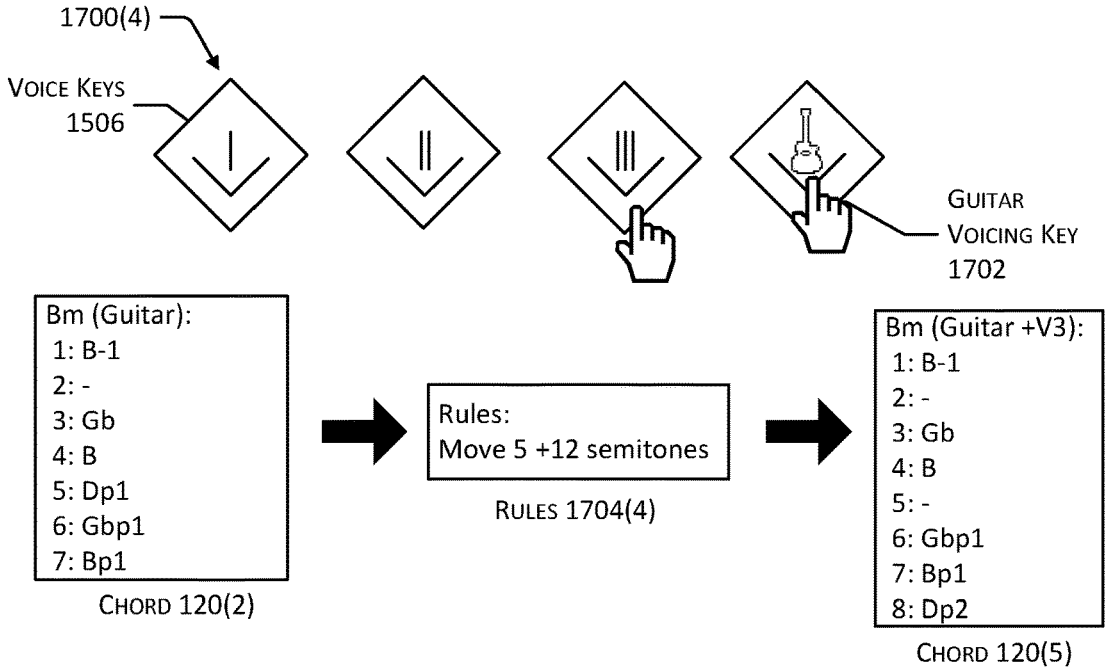

FIG. 17B depicts a third layout 1700(3) in which the guitar voicing key 1702 and the second voice key 1506 are actuated, and a chord key 114 for an initial chord 120(1) having three notes 118 is selected. In such a case, in addition to applying the rules 1704(1) described with regard to the first layout 1700(1) to the initial chord 120(1) to form the second chord 120(2), one or more additional rules 1704(3) may be applied to the second chord 120(2) to form a fourth chord 120(4) that is a voiced version of the second chord 120(2). Specifically, the third layout 1700(3) depicts the rules 1704(3) including movement of the fourth note 118 of the chord 120(2) two octaves lower. As a result, the second chord 120(2) having the notes "B-1,Gb,B,Dp1,Gbp1,Bp1" is transformed to a fourth chord 120(4) having the notes "D-1,B-1,Gb,B,Gbp1,Bp1".

FIG. 17B depicts a fourth layout 1700(4) in which the guitar voicing key 1702 and the third voice key 1506 are actuated, and a chord key 114 for an initial chord 120(1) having three notes 118 is selected. In such a case, in addition to applying the rules 1704(1) described with regard to the first layout 1700(1) to the initial chord 120(1) to form the second chord 120(2), one or more additional rules 1704(4) may be applied to the second chord 120(2) to form a fifth chord 120(5) that is a voiced version of the second chord 120(2). Specifically, the fourth layout 1700(4) depicts the rules 1704(4) including movement of the fourth note 118 of the chord 120(2) one octave higher. As a result, the second chord 120(2) having the notes "B-1,Gb,B,Dp1,Gbp1,Bp1" is transformed to a fifth chord 120(5) having the notes "B-1, Gb,B,Gbp1,Bp1,Dp2".

Figure 17C:
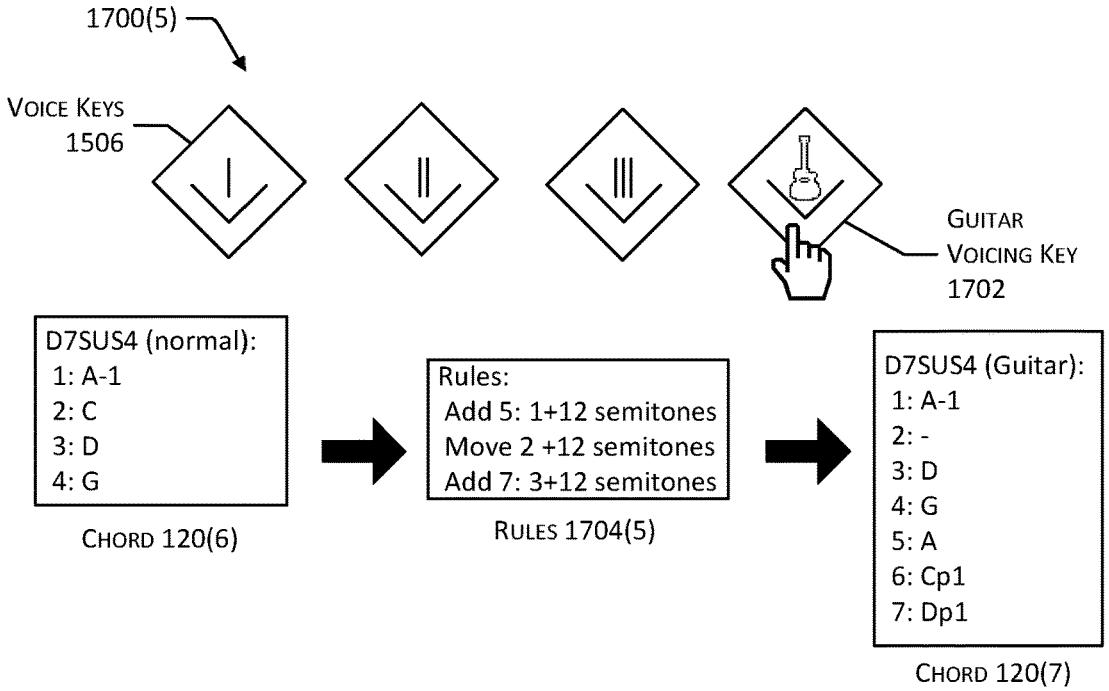
Figure 17C:
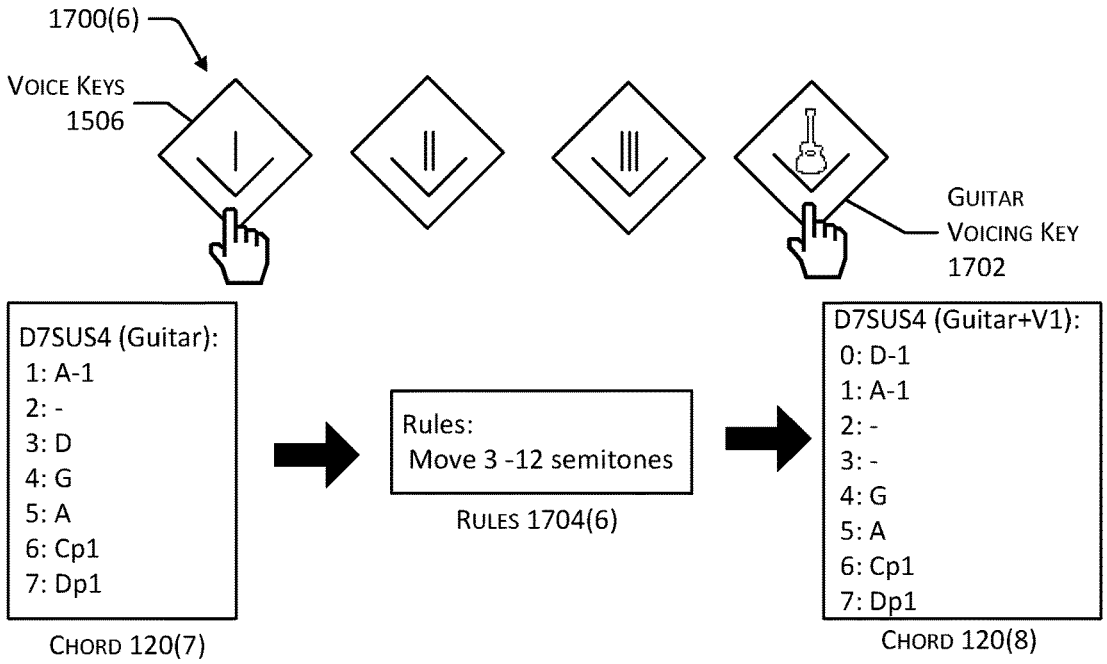

FIG. 17C depicts a fifth layout 1700(5) in which the guitar voicing key 1702 is actuated, while none of the voice keys 1506 are actuated. An example chord 120(6) having four notes 118, a D seventh sustained chord (D7SUS4), may be mapped to an alternate set of six notes 118 that correspond to a D7SUS4 chord 120(7) that may be played using a guitar. For example, FIG. 17C depicts a fifth set of rules 1704(5) that may be applied to the four notes 118 of the example sixth chord 120(6) to form a seventh chord 120(7). Specifically, the rules 1704(5) add a fifth note 118 to the chord 120(6) that is one octave higher than the first note 118, move the second note 118 of the chord 120(6) one octave (12 semitones) higher, and add a sixth note 118 to the chord 120 that is one octave higher than the third note 118 of the chord 120(6). As a result, an initial chord 120(6) having the four notes "A-1,C,D,G" may be transformed to a chord 120(7) having the six notes "A-1,D,G,A,Cp1,Dp1".

FIG. 17C depicts a sixth layout 1700(6) in which the guitar voicing key 1702 and the first voice key 1506 are actuated, and a chord key 114 for an initial chord 120(6) having four notes 118 is selected. In such a case, in addition to applying the rules 1704(5) described with regard to the fifth layout 1700(5) to the initial chord 120(6) to form the seventh chord 120(7), one or more additional rules 1704(6) may be applied to the seventh chord 120(7) to form an eighth chord 120(8) that is a voiced version of the seventh chord 120(7). Specifically, the sixth layout 1700(6) illustrates sixth rules 1704(6) including the movement of the second note 118 of the chord 120(7) one octave lower. As a result, the seventh chord 120(7) having the notes "A-1,D,G,A,Cp1, Dp1" is transformed to an eighth chord 120(8) having the notes "D-1,A-1,G,A,Cp1,Dp1".

Figure 17D:
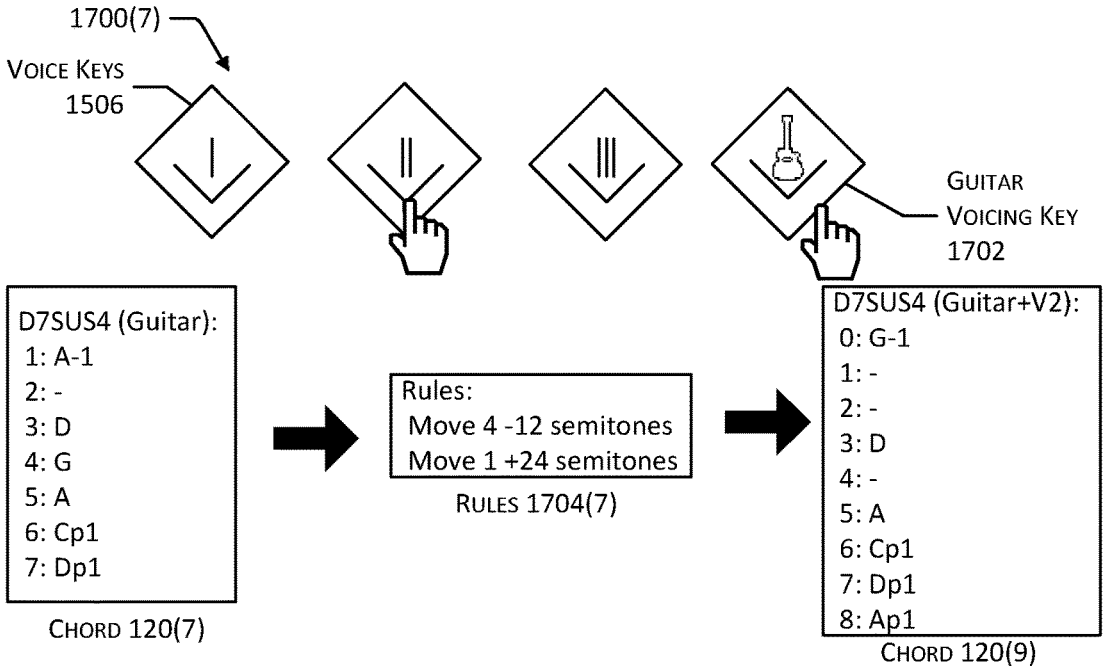
Figure 17D:
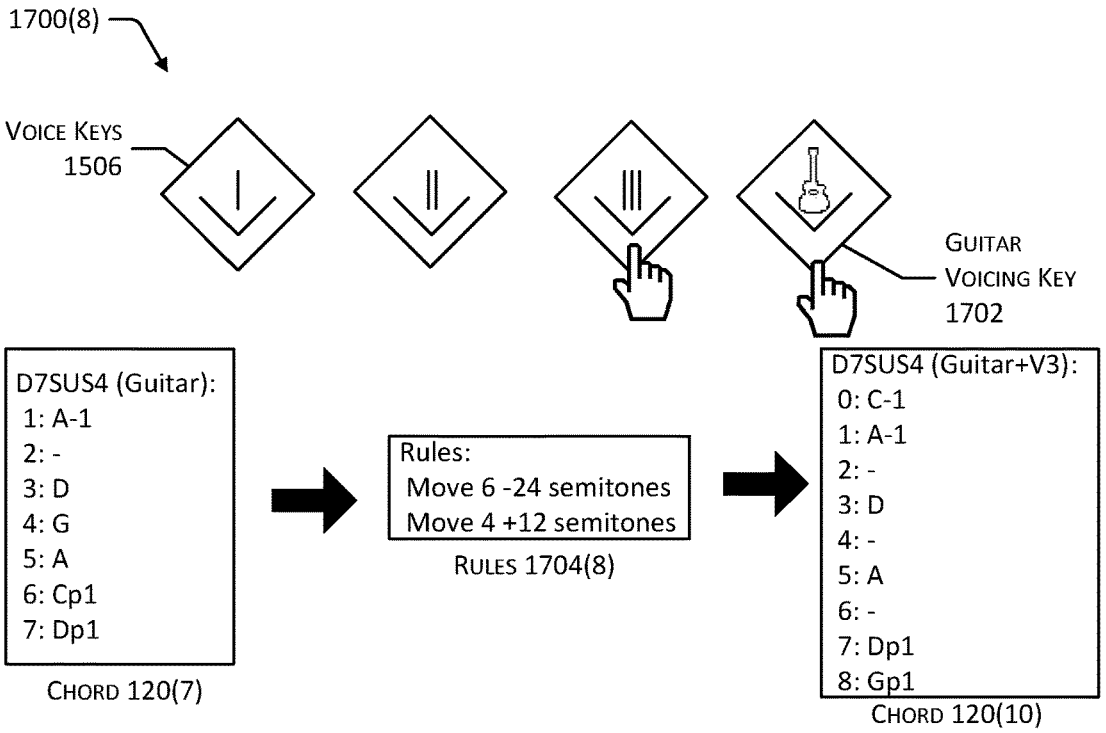

FIG. 17D depicts a seventh layout 1700(7) in which the guitar voicing key 1702 and the second voice key 1506 are actuated, and a chord key 114 for an initial chord 120(6) having four notes is selected. In such a case, in addition to applying the rules 1704(5) described with regard to the fifth layout 1700(5) to the initial chord 120(6) to form the seventh chord 120(7), one or more additional rules 1704(7) may be applied to the seventh chord 120(7) to form a ninth chord 120(9) that is a voiced version of the seventh chord 120(7). Specifically, the seventh layout 1700(7) illustrates seventh rules 1704(7) including movement of the third note 118 of the chord 120(7) one octave lower and movement of the first note 118 of the chord 120(7) two octaves higher. As a result, the seventh chord 120(7) having the notes "A-1,D,G,A,Cp1, Dp1" is transformed to a ninth chord 120(9) having the notes "G-1,D,A,Cp1,Dp1,Ap1".

FIG. 17D also depicts an eighth layout 1700(8) in which the guitar voicing key 1702 and the third voice key 1506 are actuated, and a chord key 114 for an initial chord 120(6) having four notes is selected. In such a case, in addition to applying the rules 1704(5) described with regard to the fifth layout 1700(5) to the initial chord 120(6) to form the seventh chord 120(7), one or more additional rules 1704(8) may be applied to the seventh chord 120(7) to form a tenth chord 120(10) that is a voiced version of the seventh chord 120(7). Specifically, the eighth layout 1700(8) illustrates eighth rules 1704(8) including movement of the fifth note 118 of the chord 120(7) two octaves lower and movement of the third note 118 of the chord 120(7) one octave higher. As a result, the seventh chord 120(7) having the notes "A-1,D, G,A,Cp1,Dp1" is transformed to a tenth chord 120(10) having the notes "C-1,A-1,D,A,Dp1,Gp1".

Figure 17E:
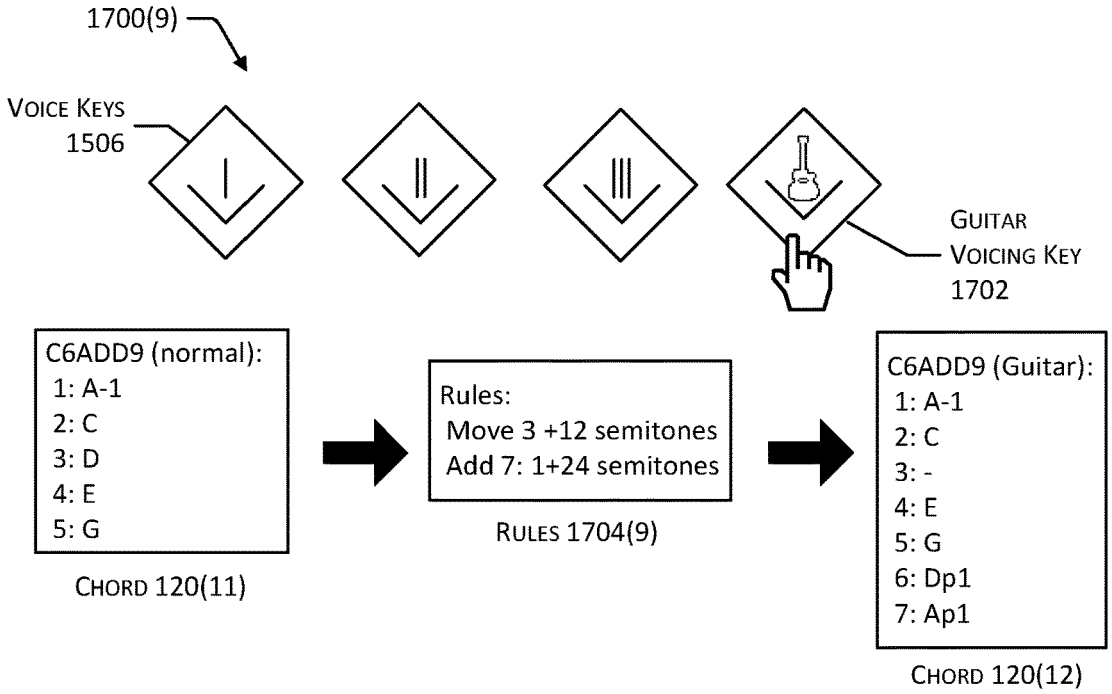
Figure 17E:
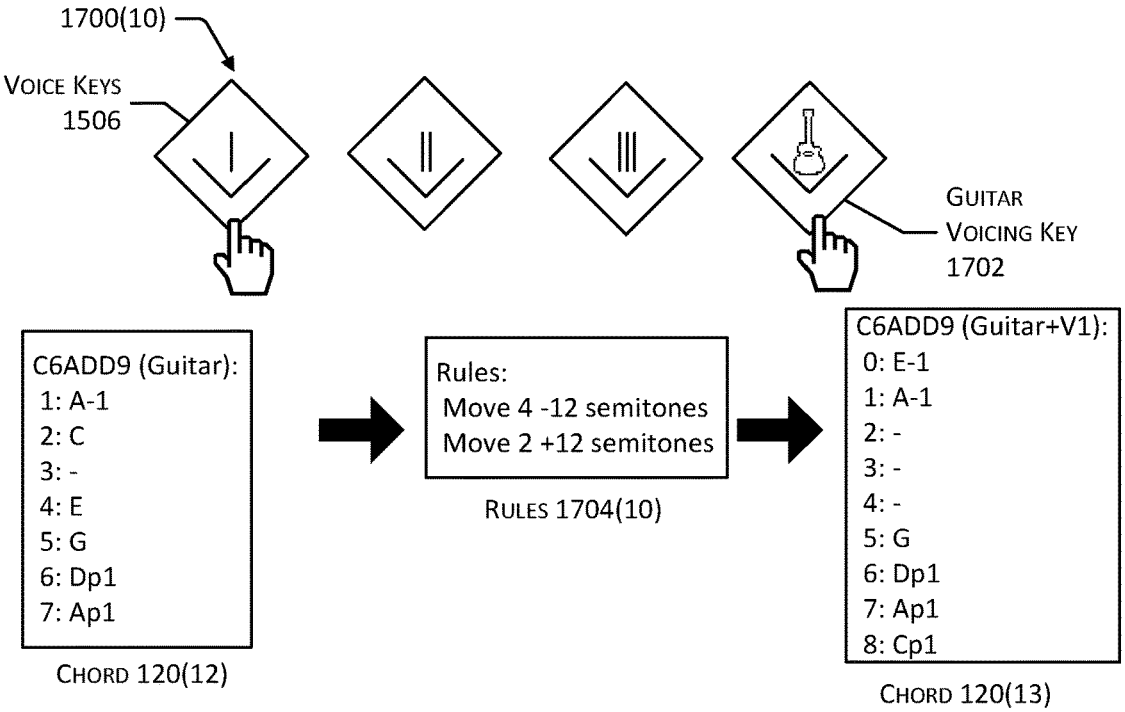

FIG. 17E depicts a ninth layout 1700(9) in which the guitar voicing key 1702 is actuated, while none of the voice keys 1506 are actuated. An example chord 120(11) having five notes 118, a C6ADD9 chord, may be mapped to an alternate set of six notes 118 that correspond to a C6ADD9 chord 120(12) that may be played using a guitar. For example, FIG. 17E depicts a ninth set of rules 1704(9) that may be applied to the five notes 118 of the example eleventh chord 120(11) to form a twelfth chord 120(12). Specifically, the rules 1704(9) move the third note 118 of the chord 120(11) one octave higher and add a sixth note 118 to the chord 120(11) that is two octaves higher than the first note 118 of the chord 120(12). As a result, an initial chord 120(11) having the five notes "A-1,C,D,E,G" may be transformed to a chord 120(12) having the six notes "A-1,C,E, G,Dp1,Ap1".

FIG. 17E depicts a tenth layout 1700(10) in which the guitar voicing key 1702 and the first voice key 1506 are actuated, and a chord key 114 for an initial chord 120(11) having five notes 118 is selected. In such a case, in addition to applying the rules 1704(9) described with regard to the ninth layout 1700(9) to the initial chord 120(11) to form the twelfth chord 120(12), one or more additional rules 1704 (10) may be applied to the twelfth chord 120(12) to form a thirteenth chord 120(13) that is a voiced version of the twelfth chord 120(12). Specifically, the tenth layout 1700 (10) illustrates tenth rules 1704(10) including movement of the third note 118 of the chord 120(12) one octave lower and movement of the second note 118 of the chord 120(12) one octave higher. As a result, the twelfth chord 120(12) having the notes "A-1,C,E,G,Dp1,Ap1" is transformed to a thirteenth chord 120(13) having the notes "E-1,A-1,G,Dp1,Ap1, Cp1".

Figure 17F:
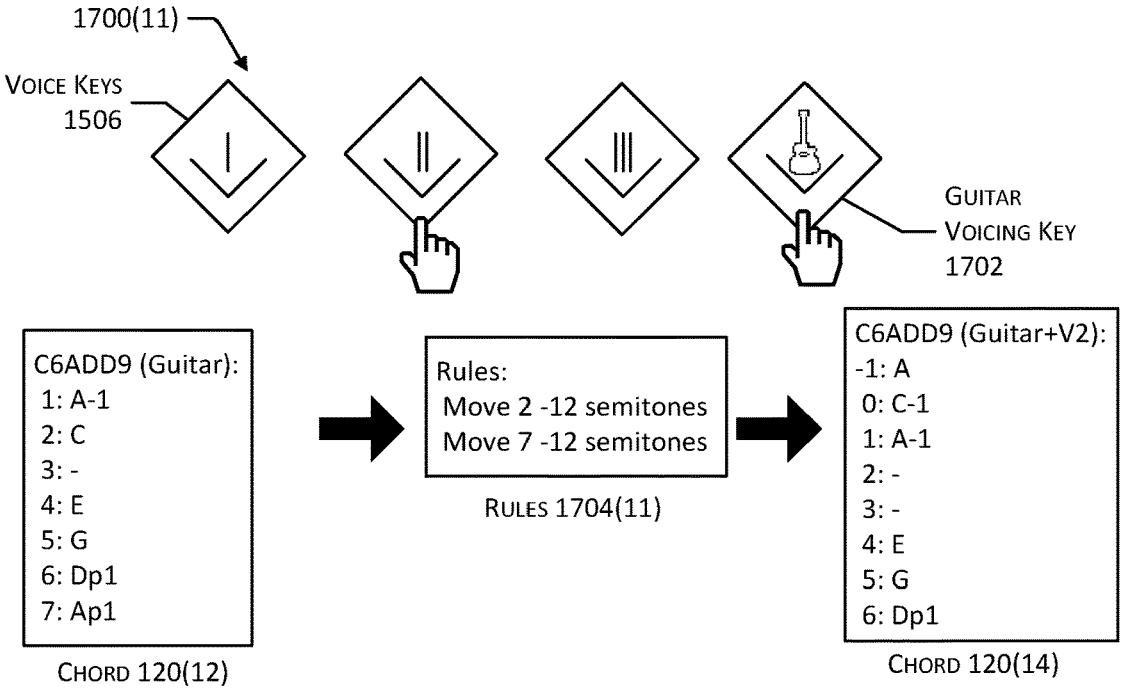
Figure 17F:
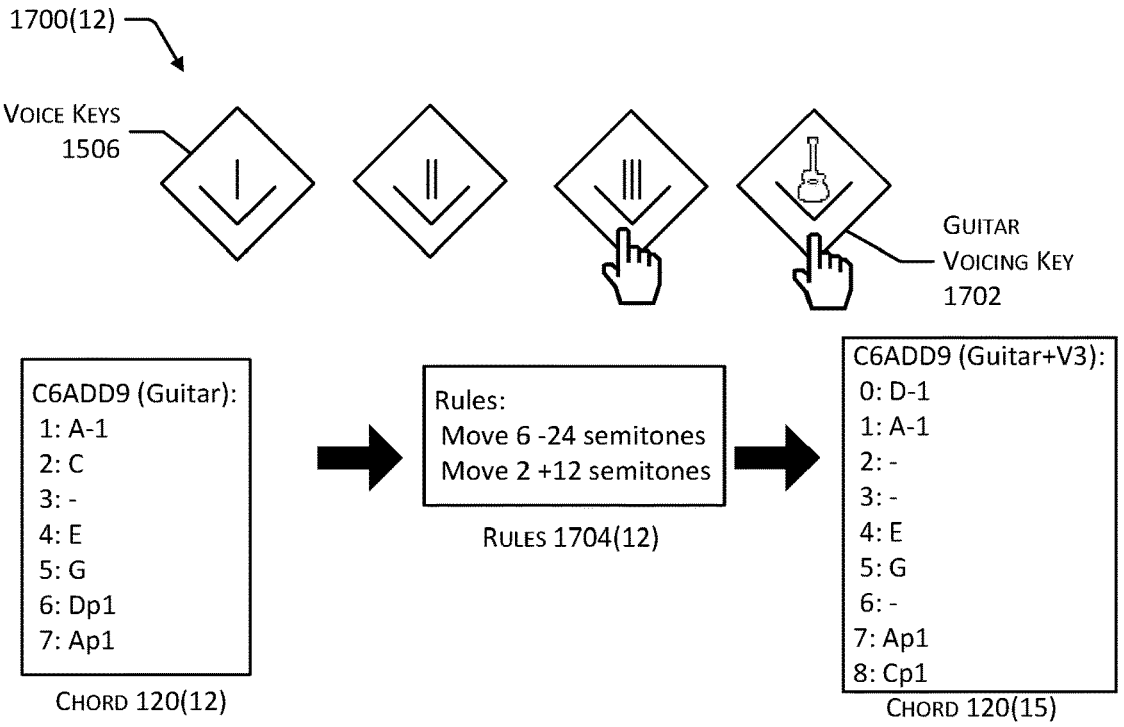

FIG. 17F depicts an eleventh layout 1700(11) in which the guitar voicing key 1702 and the second voice key 1506 are actuated, and a chord key 114 for an initial chord 120(11) having five notes 118 is selected. In such a case, in addition to applying the rules 1704(9) described with regard to the ninth layout 1700(9) to the initial chord 120(11) to form the twelfth chord 120(12), one or more additional rules 1704 (11) may be applied to the twelfth chord 120(12) to form a fourteenth chord 120(14) that is a voiced version of the twelfth chord 120(12). Specifically, the eleventh layout 1700(11) illustrates eleventh rules 1704(11) including movement of the second note 118 of the chord 120(12) one octave lower and movement of the sixth note 118 of the chord 120(12) one octave lower. As a result, the twelfth chord 120(12) having the notes "A-1,C,E,G,Dp1,Ap1" is transformed to a fourteenth chord 120(14) having the notes "A,C-1,A-1,E,G,Dp1".

FIG. 17F also depicts a twelfth layout 1700(12) in which the guitar voicing key 1702 and the third voice key 1506 are actuated, and a chord key 114 for an initial chord 120(11) having five notes 118 is selected. In such a case, in addition to applying the rules 1704(9) described with regard to the ninth layout 1700(9) to the initial chord 120(11) to form the twelfth chord 120(12), one or more additional rules 1704(12) may be applied to the twelfth chord 120(12) to form a fifteenth chord 120(15) that is a voiced version of the twelfth chord 120(12). Specifically, the twelfth layout 1700(12) illustrates twelfth rules 1704(12) including movement of the fifth note 118 of the chord 120(12) two octaves lower and movement of the second note 118 of the chord 120(12) one octave higher. As a result, the twelfth chord 120(12) having the notes "A-1,C,E,G,Dp1,Ap1" is transformed to a fifteenth chord 120(15) having the notes "D-1,A-1,E,G,Ap1,Cp1".

Figure 18:
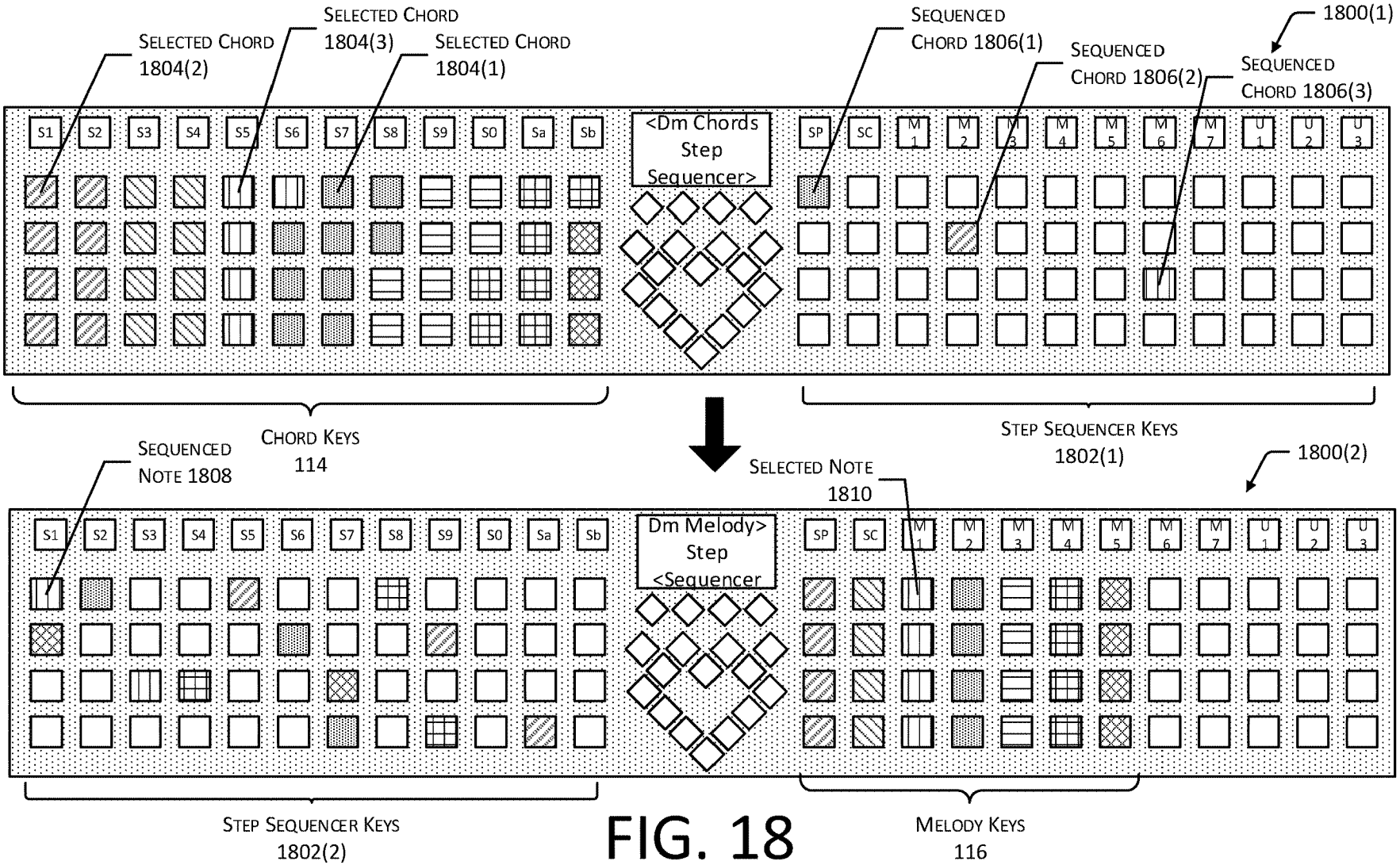
FIG. 18 depicts example layouts of the input device, according to some implementations, illustrating use of the input device as a step sequencer.

FIG. 18 depicts example layouts 1800 of the input device 104, according to some implementations, illustrating use of the input device 104 as a step sequencer. For example, the input device 104 may be divided such that one set of keys 106 includes chord keys 114 or melody keys 116, while another set of keys 106 functions as step sequencer keys 1802. The step sequencer keys 1802 may represent the placement of a chord 120 or note 118 relative to a period of time. For example, a step sequencer, which may be used to sequence "steps" in a "beat" may subdivide a period of time into beats. For example, four measures of music having four beats per measure may be divided into sixteen beats, also referred to as steps. For each step, a chord 120 or note 118 may be assigned such that when the step sequencer is actuated, the assigned chords 120 and notes 118 are played back over a period of time on the beats to which each chord 120 and note 118 was assigned.

As such, FIG. 18 depicts a first layout 1800(1) in which the input device 104 includes a set of chord keys 114 positioned on a first side of the input device 104 opposite a set of step sequencer keys 1802(1). As described previously, each chord key 114 may be associated with a particular chord 120 based on a scale that may be selected by a musician 102. In some implementations, chords 120 having common characteristics, such as the same root note, may be provided with common visual indicia 108, such as the same color. For example, keys 106 having identical cross-hatching in FIG. 18 may represent keys 106 that have been provided with the same color.

The chord keys 114 may be used to associate particular chords 120 with one or more of the step sequencer keys 1802(1). For example, a musician 102 may actuate a particular step sequencer key 1802(1) followed by a chord key 114 that corresponds to a chord 120 to be sequenced. Alternatively, a musician 120 may actuate a particular chord key 114 followed by a step sequencer key 1802(1) to which a chord 120 is to be assigned. For example, FIG. 18 depicts a first selected chord 1804(1) that corresponds to one of the chord keys 114 and a first sequenced chord 1806(1) that corresponds to one of the step sequencer keys 1802(1). The corresponding chord key 114 and step sequencer key 1802(1), and in some implementations, one or more menu keys 110, control keys 112, or other keys 106 of the input device 104, may be used to associate the sequenced chord 1806(1) with the selected step sequencer key 1802(1). Similarly, FIG. 18 depicts a second selected chord 1804(2) associated with one of the chord keys 114, and a second sequenced chord 1806(2) that may be assigned to one of the step sequencer keys 1802(1) using the input device 104. FIG. 18 also depicts a third selected chord 1804(3) and a corresponding third sequenced chord 1806(3).

In some implementations, the position of the step sequencer keys 1802(1) may be modified. For example, using a menu key 110, control key 112, or other key associated with the input device 104, the layout 1800 of the input device 104 may be changed such that the step sequencer keys 1802 are moved to the opposite side of the input device 104. Continuing the example, FIG. 18 depicts a second layout 1800(2) in which the step sequencer keys 1802(2) are positioned on the left side of the input device 104, while a set of melody keys 116 are positioned on the right side of the input device 104. The melody keys 116 and step sequencer keys 1802(2) may be used to associate notes 118 that correspond to the melody keys 116 with selected step sequencer keys 1802(2). For example, FIG. 18 depicts a selected note 1810 associated with a melody key 116 and a corresponding sequenced note 1808 associated with a step sequencer key 1802(2). Any number of notes 118 associated with melody keys 116 and chords 118 associated with chord keys 120 may be associated with step sequencer keys 1802. When the step sequencer function of the input device 104 is actuated, output data for outputting the sequenced chords 1806 and sequenced notes 1808 at times corresponding to the placement of the sequenced chords 1806 and sequenced notes 1808 within the step sequencer keys 1802 may be generated.

While FIG. 18 depicts example layouts 1800 in which chord keys 114 are positioned to the left of step sequencer keys 1802(1) and melody keys 116 are positioned to the right of step sequencer keys 1802(2), in other implementations, the position of the step sequencer keys 1802 may remain constant. For example, menu keys 110, control keys 112, or other keys 106 of the input device 104 may be used to change the keys 106 on one side of the input device 104 between different sets of chord keys 114 and different sets of melody keys 116 while the step sequencer keys 1802 remain on another side of the input device 104.

The code examples below are provided by way of illustration. It is understood that the functionality provided by the code described below may be implemented in alternative programming languages, data structures, logical constructs and so forth. Code Example 1 illustrates the assignment of chord keys 114 and melody keys 116, determining when a chord key 114 or melody key 116 is actuated, and the manner in which the actuation and release of chord keys 114 and melody keys 116 is resolved. Code Example 2 illustrates the modification of chords 120 using control keys 112, such as voice keys 1506, a guitar voicing key 1702, spread keys 1504, and octave keys 1502.

Code Example 1

```
#include <MIDI.h>
#include <SPI.h>
#include <SD.h>
#include <SoftwareSerial.h>
#include <MenuBackend.h>
#include <Keypad.h>
#include "FastLED.h"
//////////////////CONFIGURE IO & MEMORY ////////////////////////////////
//Setup LEDs
#define NUM_LEDS 93
#define DATA_PIN 3
CRGB leds[NUM_LEDS];
MIDI_CREATE_DEFAULT_INSTANCE( );
//DEFINE CHORD KEYPAD
const byte ROWS = 20; //rows
const byte COLS = 4; //columns
//Key lookup chord/melody bank
int keys[ROWS][COLS] = {
  { 80, 76, 72, 68 },
  { 79, 75, 71, 67 },
  { 78, 74, 70, 66 },
  { 77, 73, 69, 65 },
  { 64, 60, 56, 52 },
  { 63, 59, 55, 51 },
  { 62, 58, 54, 50 },
  { 61, 57, 53, 49 },
  { 48, 44, 40, 36 },
  { 47, 43, 39, 35 },
  { 46, 42, 38, 34 },
  { 45, 41, 37, 33 },
  { 32, 28, 24, 20 },
  { 31, 27, 23, 19 },
  { 30, 26, 22, 18 },
  { 29, 25, 21, 17 },
  { 16, 12, 8, 4 },
  { 15, 11, 7, 3 },
  { 14, 10, 6, 2 },
  { 13, 9, 5, 1 }
};
//hardware button input pins for key scan
byte rowPins[ROWS] = { 22, 23, 24, 25, 26, 27, 28, 29, 30, 31, 32, 33, 34,
35, 36, 37, 38, 39, 40, 41 }; //positive
byte colPins[COLS] = { 13, 12, 11, 9 }; //ground
Keypad kpd = Keypad( makeKeymap(keys), rowPins, colPins, ROWS, COLS );
//create keypad
//menu keys
const byte menu_ROWS = 1; //row
const byte menu_COLS = 4; //column
int menu_keys[menu_ROWS][menu_COLS] = { { 4, 3, 2, 1 } };
byte menu_rowPins[menu_ROWS] = { 17 }; //positive
byte menu_colPins[menu_COLS] = { 18, 19, 20, 21 }; //ground
Keypad menu_kpd = Keypad( makeKeymap(menu_keys), menu_rowPins, menu_colPins,
menu_ROWS, menu_COLS );
//control keys
const byte shift_ROWS = 3; //row
const byte shift_COLS = 3; //column
int shift_keys[shift_ROWS][shift_COLS] = {
  { 3, 6, 9 },
  { 2, 5, 8 },
  { 1, 4, 7 }
};
byte shift_rowPins[shift_ROWS] = { 47, 48, 49 }; //positive
byte shift_colPins[shift_COLS] = { 44, 45, 46 }; //ground
Keypad shift_kpd = Keypad( makeKeymap(shift_keys), shift_rowPins,
shift_colPins, shift_ROWS, shift_COLS );
//Create a software serial port for LCD communication
SoftwareSerial lcd = SoftwareSerial(0, 5);
int octaveoffset = 0; //initial octave offset
int velocity = 100; //initial velocity
int noteblackout = 0; //used in BL1
//Used for SD data
char SDBuffer[64]; //buffer
int arrayLoad0, arrayLoad1, arrayLoad2, arrayLoad3, arrayLoad4, arrayLoad5,
arrayLoad6, arrayLoad7; //temp storage for parsed data from SD
//Array of notes, start in 'C'
byte colorArray[93]; // 0 - 7 number for which color to display from
colorLookup
```

-continued

```
String chordlabelArray[48]; //chord labels stored here for LCD display
int currentnotePlaying; //current CHORD that is playing, only one at a time
can fire in BL1
byte noteArray[80][7]; //all notes (chord and melody) are loaded from the SD
into here for use during play
String colorLookup[10] = {"CRGB::Red", "CRGB::DarkOrange",
"CRGB::YellowGreen", "CRGB::Green", "CRGB::Blue", "CRGB::Cyan",
"CRGB::Purple", "CRGB::Plum", "CRGB::Plum", "CRGB::Plum"}; //LED colors
//Used to lookup color values, needed to pass vars
#define REFLECT(value) {#value, value}
template<typename T> struct Reflection {
  const char *name;
  T value;
};
Reflection<CRGB::HTMLColorCode> colors[ ] = {
  REFLECT(CRGB::Red),
  REFLECT(CRGB::DarkOrange),
  REFLECT(CRGB::YellowGreen),
  REFLECT(CRGB::Green),
  REFLECT(CRGB::Blue),
  REFLECT(CRGB::Cyan),
  REFLECT(CRGB::Purple),
  REFLECT(CRGB::Plum)
};
byte chordData[7] = {99, 99, 99, 99, 99, 99, 99}; //chord list. 99 is
indicator that is empty. *width of 7 used for beta testing.
byte melodyData[7] = {99, 99, 99, 99, 99, 99, 99}; //current playing melody
notes
byte donotshutoff[7] = {0};
String currentLoadedChord; //store in EEPROM
char prevLoadedFile[50]; //store in EEPROM
//////////////////////////////////////Code//////////////////////////////
//initialize components
void setup( ) {
  MIDI.begin(MIDI_CHANNEL_OMNI); //connect to MIDI
  pinMode(toggleMenu, INPUT_PULLUP);
  setupLCD( );
  setupMenu( );
  setupSD( );
  loadSD("/001/001/00001.txt", "A Dominant Bebop"); //load first file
off SD
}
//will repeat until the device is turned off
void loop( ) {
  readKeys( ); //read chords/melody
}
//performs the keyscan of the chord/melody keys
void readKeys( ) {
  if (kpd.getKeys( ))
  {
    for (int i = 0; i < LIST_MAX; i++) //scan the keylist
    {
      if ( kpd.key[i].stateChanged ) //find keys that changed state
      {
        switch (kpd.key[i].kstate) { //report active key state : IDLE,
PRESSED, HOLD, or RELEASED
          case PRESSED:
            //CHORD PRESS:
            if ( (kpd.key[i].kint - 1) < 48) {
              buttonPressed(kpd.key[i].kint - 1); //deincrement from human
to computer counting when sending key ( 0 - n)
              registerKey(kpd.key[i].kint - 1);
            }
            //MELODY PRESS:
            else if ( (kpd.key[i].kint - 1) >= 48 ) {
              melodyPressed(kpd.key[i].kint - 1);
              registerMelody(kpd.key[i].kint - 1);
            }
            break;
          case RELEASED:
            //CHORD RELEASED:
            if ( (kpd.key[i].kint - 1) < 48) {
              buttonReleased(kpd.key[i].kint - 1);
              unregisterKey(kpd.key[i].kint - 1);
            }
            //MELODY RELEASED
            else if ( (kpd.key[i].kint - 1) >= 48 ) {
              melodyReleased(kpd.key[i].kint - 1);
              unregisterMelody(kpd.key[i].kint - 1);
```

-continued

```
                }
                break;
            }
        }
    }
  }
}
//melody key is pressed
void melodyPressed(int buttonPin) {
  MIDI.sendNoteOn(int(noteArray[buttonPin][0] + octaveoffset), velocity, 1);
}
//melody key is released
void melodyReleased(int buttonPin) {
  MIDI.sendNoteOff(int(noteArray[buttonPin][0] + octaveoffset), velocity,
1);
}
//executes when a chord key is pressed
void buttonPressed(int buttonPin) {
  if ( (noteblackout == 0) && (buttonPin < 48) ) //if is a chord is allowed
to be played and if is a chord
  {
    for (int i = 0; i < 6; i++) { //only 7 possible notes in a chord
      {
        if (noteArray[buttonPin][i] != 0) //as long as not empty
        {
          MIDI.sendNoteOn(int(noteArray[buttonPin][i] + octaveoffset),
velocity, 1); //send chord note on
        }
      }
      //Display current chord on LCD
      lcd.write(0xFE);
      lcd.write(0x58);
      lcd.print(chordlabelArray[buttonPin]);
      noteblackout = 1; //no other chord can be struck
      currentnotePlaying = buttonPin; //keep track of which chord is
currently playing
    }
  }
}
//executes when a chord key is released
void buttonReleased(int buttonPin) {
  if ( (noteblackout == 1) && (buttonPin == currentnotePlaying) && (buttonPin
< 48) ) //must be a chord turning off
  {
    //clear key conflicts array
    for (int i = 0; i < 6; i++)
      donotshutoff[i] = 0;
    //check key conflicts, fill the array
    checkkeyConflicts(buttonPin);
    for (int i = 0; i < 6; i++) //traverse through currently pressed notes
    {
      if (noteArray[buttonPin][i] == 0) //if current note is a zero then we
have reached the end
        break;
      else {
        for (int m = 0; m < 6; m++) //for each currently pressed note,
check to see if match on do not stop list
        {
          if (donotshutoff[m] == 0) { //if at end of do-not-stop list then
there were no hits, fire off the note-off
            MIDI.sendNoteOff(int(noteArray[buttonPin][i] + octaveoffset),
velocity, 1);
            break;
          }
          if ( noteArray[buttonPin][i] == donotshutoff[m] )
        {
          break; //found match on do not shut off list, break out
        }
      }
    }
  }
  //remove chord title from LCD
  lcd.write(0xFE);
  lcd.write(0x58);
  noteblackout = 0; //reset noteblackout to 0, this will allow next chord
to be pressed
  if ( (findnextKey(buttonPin) != 99) && (buttonPin == currentnotePlaying)
) //if theres another key hit and if the current pressed was just released
    buttonPressed(findnextKey(buttonPin)); //pass next key in waiting list
```

-continued

```
  }
}
//track melody key that is pressed
void registerMelody(int key) {
  chronorderKeys(currentMelody); //pass the array to chron order & clean
  for (int i = 0; i < 7; i++)
  {
    if (currentMelody[i] == 99) { //if space available store
      currentMelody[i] = noteArray[key][0];
      break;
    }
  }
}
//melody key is released then we do not need to keep track of it
void unregisterMelody(int key) {
  for (int i = 0; i < 7; i++)
  {
    if (currentMelody[i] == noteArray[key][0])
      currentMelody[i] = 99;
    }
    chronorderKeys(currentMelody);
}
//add new physical chord key to the key waiting list
void registerKey(int key) {
  chronorderKeys(chordData); //pass the array to chron order & clean
  for (int i = 0; i < 7; i++) {
    if (chordData[i] == 99) { //if space available store (99 is non-note)
      chordData[i] = key;
      break;
    }
  }
}
//Remove a chord key from the key waiting list
void unregisterKey(int key) {
  for (int i = 0; i < 7; i++) {
    if (chordData[i] == key)
      chordData[i] = 99;
  }
  chronorderKeys(chordData);
}
//sometimes keys have been removed in the middle of the chordData array,
this will clean out empty slots
//
//Example array BEFORE: 09 22 99 21 15 99 99
//Example array AFTER: 09 22 21 15 99 99 99 (99 is removed from the
center)
void chronorderKeys(byte chronarray[ ] ) {
  for (int i = 0; i < 7; i++)
  {
    if (chordData[i] == 99) //if empty space at queue
    {
      for (int j = 1; j < (7 - i); j++) {//start search for any keys that
need to come down the line
        if (chordData[i + j] != 99) {
          chordData[i] = chordData[i + j]; //set empty space as next in
line
          chordData[i + j] = 99; //set old space to 99
          break;
        }
      }
    }
  }
}
//check conflicts before sending note-off data. notes that shouldn't be
turned off are placed in donotshutoff array
void checkkeyConflicts(int key) {
  int pos = 0;
  for (int i = 0; i < 7; i++)
  {
    for (int j = 0; j < 7; j++)
    {
      if (noteArray[key][j] == 0)
        break;
      if (noteArray[key][j] == currentMelody[i]) {
        donotshutoff[pos] = currentMelody[i];
        pos++;
      }
    }
  }
```

-continued

```
}
//return next key in chord array
int findnextKey(int key) {
  int returnkey = 99;
  for (int i = 0; i < 6; i++) {
    if (chordData[i] == key)
    {
      returnkey = chordData[i + 1];
      break;
    }
  }
  return returnkey;
}
```

Code Example 2

```
void theory::chordPressed(uint8_t buttonPin, float velocity)
{
  if (noteblackout == 1) {
      chordReleased(currentnotePlaying);
      noteblackout = 0;
  }
  //We will build the key before sending it off, using the base chord as
the start
  uint8_t note_count = 0;
  int8_t built_key[MAX_NOTE_COUNT_BUILT];
  memset(built_key, 0, sizeof(built_key)); //initialize to zero
    //Count and copy notes
  for (uint8_t i = 0; i < MAX_NOTE_COUNT; i++) {
      if (sc->scales[0].keys[buttonPin].note[i] != 0) {
        built_key[i] = sc->scales[0].keys[buttonPin].note[i];
        note_count++;
      } else
        break;
  }
    //Check for voicing/guitar voicing, spread and octave then apply
applicable filters to the original chord
  if (voiced) {
      if (guitar) {
        //base notes are already counted in "note_count" at this point
        switch (note_count) {
              //three note chord
          case (3):
            //3 will always start with this applied
            built_key[note_count] = built_key[0] + 12;    //stack
first note by 12
            note_count++;
            built_key[1] += 12;    //move second note up 12
            built_key[note_count] = built_key[2] + 12;    //stack
third note by 12
            note_count++;
            built_key[note_count] = built_key[0] + 24;    //stack
first note by 24 (this is written as position 4 stacked from Evan)
            note_count++;
            if (g2) {
              built_key[1] -= 12;    //move second note down 12
              break;
            } else if (g3) {
              built_key[1] -= 24;    //move second note down by 24
              break;
            } else if (g4) {
              built_key[1] += 12;    //move second note up 12
              break;
            }
            break;
              //four note chord
          case (4):
            built_key[note_count] = built_key[0] + 12;        //stack
first note by 12
            note_count++;
            built_key[1] += 12;    //move second note up 12
            built_key[note_count] = built_key[2] + 12;        //stack
third note by 12
            note_count++;
            if (g2) {
              built_key[2] -= 12; //move third note down 12
              break;
            } else if (g3) {
              built_key[3] -= 12; //move fourth note down by 24
              built_key[0] += 24; //move first note down by 24
              break;
            } else if (g4) {
              built_key[1] -= 24; //move second note down 24
              built_key[3] += 12; //move fourth note up 12
              break;
            }
            break;
              //five note chord
          case (5):
            built_key[2] += 12;
            built_key[note_count] = built_key[0] + 24;        //stack
first note by 24
            note_count++;
            if (g2) {
              built_key[3] -= 12;
              built_key[1] += 12;
              break;
            } else if (g3) {
              built_key[1] -= 12;
              built_key[5] -= 12;    //evan has this as position 7
moves down 12 notes
              break;
            } else if (g4) {
              built_key[2] -= 24;
              built_key[1] += 12;
              break;
            }
            break;
          default:    //was different than 3, 4, or 5 key, do nothing
            break;
        }
      } else if (voicing) {
        if (v1) {
          built_key[0] += 12; //voicing 1
        } else if (v2) {
          built_key[0] += 12; //voicing 2
          built_key[1] += 12;
        } else if (v3) {
          built_key[0] += 12; //voicing 3
          built_key[1] += 12;
          built_key[2] += 12;
        }
      }
    }
    if (spread) {
      if (s1) {
        built_key[0] -= 12;    //spread 1
      { else if (s2) {
        built_key[0] -= 24;    //spread 2
      } else if (s3) {
        built_key[0] -= 36; //spread 3
      }
    }
    if (octave) {
        //first lets create an array that contains all octaves we need
to build on
```

-continued

```
        int8_t octaveoffset[7] = {99, 99, 99, 99, 99, 99, 99};
    //99 symbol for end of array (7 octave buttons)
        uint8_t oct_i = 0;
        //check and add any active octave buttons to the octaveoffset
array
      if (o0) {
        octaveoffset[oct_i] = 0;
          oct_i++;
      }
        if (op1) {
        octaveoffset[oct_i] = 12;
          oct_i++;
      }
        if (om1) {
        octaveoffset[oct_i] = −12;
          oct_i++;
      }
        if (op2) {
        octaveoffset[oct_i] = 24;
          oct_i++;
      }
        if (om2) {
        octaveoffset[oct_i] = −24;
          oct_i++;
      }
        if (op3) {
        octaveoffset[oct_i] = 36;
          oct_i++;
      }
        if (om3) {
        octaveoffset[oct_i] = −36;
          oct_i++;
      }
        //temporary location to store the built octave keys
        int8_t octave_built_key[MAX_NOTE_COUNT_BUILT];
        memset(octave_built_key,    0,    sizeof(octave_built_key));
//initialize to zero
        //Now add all the octave stacks to the built chord
        uint8_t note_position = 0;
        for (uint8_t j = 0; j < 7; j++) {
          uint8_t notes_updated = 0;
          for (uint8_t i = 0; i < note_count; i++) {          //0
tonote_count is the original keys
            if (built_key[i] == 0) {
              break;
            }
            octave_built_key[i + note_position] = built_key[i]
+ octaveoffset[j];
            notes_updated = i;
          }
          //Check if the next item is the end, if so we break out
          if (octaveoffset[j + 1] == 99) {
            break;
          }
          note_position += notes_updated + 1;
        }
        note_count += note_position;
        //Stacking can create duplicate notes, deduplicate
        sortAscending(octave_built_key, note_count);
        note_count = removeArrDuplicates(octave_built_key,
note_count);
        //copy the applied filter array back to the built_key to be used
for note on data
        memcpy(built_key, octave_built_key, sizeof(built_key));
    }
    //Fit velocity to curve
      int curve_velocity;
      if (velocity <= CURVE_LOW_CEILING)
        curve_velocity = (velocity − BTN_NOISE_THRES) * (50 − 1) /
(CURVE_LOW_CEILING − BTN_NOISE_THRES);
      else if (velocity >= CURVE_MID_CEILING)
        curve_velocity = (velocity − CURVE_MID_CEILING) * (127 −
101) / (1.0 − CURVE_MID_CEILING) + 101;
      else
        curve_velocity = (velocity − CURVE_LOW_CEILING) * (100 −
51) / (CURVE_MID_CEILING − CURVE_LOW_CEILING) + 51;
      //Fire off built notes
    for (uint8_t i = 0; i < note_count; i++) {
      midi.write(MIDIMessage::NoteOn( built_key[i], curve_velocity,
0));
    }
    noteblackout = 1; //Make so no other chord can be struck
    //Center label on screen and display
    memset(screen->selected_screen.line,    0,    sizeof(screen-
>selected_screen.line)); //clear old menu items before we rewrite so no
artifacts are left
    char formatted_label16;    //store label with padded zeros (22 bc 21 is
screen size + 1 null char)
    uint8_t zero count = (16 − strlen(sc->scales[0].keys[buttonPin].label))
/ 2; //get count of items in label
    for (int j = 0; j < zero_count; j++) {
      formatted_label[j] = '  ';
      formatted_label[j + 1] = '\0';
    }
    for (int j = 0; j < 16 − zero_count; j++)
      formatted_label[j    +    zero_count]    =    sc-
>scales[0].keys[buttonPin].label[j];
    strcpy(screen->selected_screen.line[5], formatted_label);    //This is
the center menu item, will be highlighted
    menu_manager->setFontLarge( );
    menu_manager->updateScreen(screen);
    menu_manager->setFontStandard( );
    //Save the note information for the chord that was fired off
    currentnotePlaying = buttonPin;
    memset(prev_built_key, 0, sizeof(prev_built_key)); //first reset to zero
    memcpy(prev_built_key, built_key, sizeof(prev_built_key));
    prev_note_count = note_count;
}
```

The processes discussed in this disclosure may be implemented in hardware, software, or a combination thereof. In the context of software, the described operations represent computer-executable instructions stored on one or more computer-readable storage media that, when executed by one or more hardware processors, perform the recited operations. Generally, computer-executable instructions include routines, programs, objects, components, data structures, and the like that perform particular functions or implement particular abstract data types. Those having ordinary skill in the art will readily recognize that certain steps or operations illustrated in the figures above may be eliminated, combined, or performed in an alternate order. Any steps or operations may be performed serially or in parallel. Furthermore, the order in which the operations are described is not intended to be construed as a limitation.

Embodiments may be provided as a software program or computer program product including a non-transitory computer-readable storage medium having stored thereon instructions (in compressed or uncompressed form) that may be used to program a computer (or other electronic device) to perform processes or methods described in this disclosure. The computer-readable storage medium may be one or more of an electronic storage medium, a magnetic storage medium, an optical storage medium, a quantum storage medium, and so forth. For example, the computer-readable storage media may include, but is not limited to, hard drives, floppy diskettes, optical disks, read-only memories (ROMs), random access memories (RAMs), erasable programmable ROMs (EPROMs), electrically erasable programmable ROMs (EEPROMs), flash memory, magnetic or optical cards, solid-state memory devices, or other types of physical media suitable for storing electronic instructions. Further, embodiments may also be provided as a computer program product including a transitory machine-readable signal (in compressed or uncompressed form). Examples of transitory machine-readable signals, whether modulated using a carrier or unmodulated, include, but are not limited to, signals that a computer system or machine hosting or running a computer program can be configured to access, including signals transferred by one or more networks. For example, the transitory machine-readable signal may comprise transmission of software by the Internet.

Separate instances of these programs can be executed on or distributed across any number of separate computer systems. Although certain steps have been described as being performed by certain devices, software programs, processes, or entities, this need not be the case, and a variety of alternative implementations will be understood by those having ordinary skill in the art.

Additionally, those having ordinary skill in the art will readily recognize that the techniques described above can be utilized in a variety of devices, environments, and situations. Although the subject matter has been described in language specific to structural features or methodological acts, it is to be understood that the subject matter defined in the appended claims is not necessarily limited to the specific features or acts described. Rather, the specific features and acts are disclosed as exemplary forms of implementing the claims.

What is claimed is:

1. A system comprising:
a first plurality of keys;
one or more memories storing computer-executable instructions; and
one or more hardware processors to execute the computer-executable instructions to:
determine a first scale that includes a first plurality of musical notes;
determine a first plurality of chords associated with the first scale, wherein a first chord of the first plurality of chords includes a first subset including at least two musical notes of the first plurality of musical notes;
associate a first key of the first plurality of keys with the first chord;
determine actuation of the first key; and
generate output data that corresponds to the first subset of the first plurality of musical notes.

2. The system of claim 1, further comprising computer-executable instructions to:
associate a second key of the first plurality of keys with a second chord of the first plurality of chords, wherein the second chord includes a second subset of the first plurality of musical notes;
determine a first visual indicia associated with a first characteristic of the first chord;
determine a second visual indicia associated with a second characteristic of the second chord;
present the first visual indicia in association with the first key; and
present the second visual indicia in association with the second key.

3. The system of claim 1, further comprising:
a second plurality of keys; and
computer-executable instructions to:
associate a second key of the second plurality of keys with an individual musical note of the first plurality of musical notes, wherein the individual musical note is included in the first subset;
determine a visual indicia associated with the individual musical note;
present the visual indicia in association with the first key; and
present the visual indicia in association with the second key.

4. The system of claim 1, further comprising:
a second plurality of keys; and
computer-executable instructions to:
determine a second scale that includes a second plurality of musical notes;
determine a second plurality of chords associated with the second scale, wherein a second chord of the second plurality of chords includes a second subset of the second plurality of musical notes; and
associate a second key of the second plurality of keys with the second chord.

5. The system of claim 4, further comprising computer-executable instructions to:
determine a characteristic of the first chord;
determine that the second chord includes the characteristic;
determine a visual indicia associated with the characteristic;
present the visual indicia in association with the first key; and
present the visual indicia in association with the second key.

6. The system of claim 4, further comprising computer-executable instructions to:
determine that a characteristic is common to the first chord and the second chord; and
in response to the actuation of the first key, present a visual indicia in association with the second key.

7. The system of claim 1, further comprising:
one or more control keys; and
computer-executable instructions to:
determine actuation of a second key of the one or more control keys;
in response to actuation of the second key, modify the first chord by one or more of:
adding one or more musical notes of the first plurality of musical notes to the first chord; or
changing a pitch associated with at least one musical note of the first subset.

8. A method comprising:
determining a first scale that includes a first plurality of musical notes;
determining a first chord associated with the first scale, wherein the first chord includes a first subset including at least two musical notes of the first plurality of musical notes;
associating a first key of a first plurality of keys with the first chord;
determining a first characteristic of the first chord;
determining a first visible indicia associated with the first characteristic; and
providing the first visual indicia in association with the first key.

9. The method of claim 8, further comprising:
determining a second scale that includes a second plurality of musical notes;
determining a second chord associated with the second scale, wherein the second chord includes a second subset of the second plurality of musical notes;
associating a second key of a second plurality of keys with the second chord;
determining that the second chord includes the first characteristic; and
providing the first visible indicia in association with the second key.

10. The method of claim 8, further comprising:
determining a second scale that includes a second plurality of musical notes;
determining a second chord associated with the second scale, wherein the second chord includes a second subset of the second plurality of musical notes;
associating a second key of a second plurality of keys with the second chord;
determining that the second chord includes the first characteristic;
determining actuation of one of the first key or the second key; and
in response to the actuation of the one of the first key or the second key, providing a second visible indicia in association with the other of the first key or the second key.

11. The method of claim 8, wherein the first characteristic includes an individual musical note within the first subset, the method further comprising:
associating a second key of a second plurality of keys with the individual musical note; and
providing the first visual indicia in association with the second key.

12. The method of claim 8, further comprising:
determining actuation of the first key; and
in response to the actuation of the first key, associating at least one second key of a second plurality of keys with at least one musical note of the first subset.

13. A system comprising:
a first plurality of keys;
one or more memories storing computer-executable instructions; and
one or more hardware processors to execute the computer-executable instructions to:
determine a first scale that includes a first plurality of musical notes;
determine a first chord that includes a first subset including at least two musical notes of the first plurality of musical notes; and
associate a first key of the first plurality of keys with the first chord.

14. The system of claim 13, further comprising:
a second plurality of keys; and
computer-executable instructions to:
determine actuation of a second key of the second plurality of keys;
determine a second scale associated with the second key, wherein the second scale includes a second plurality of musical notes;
determine a second chord of the second scale that corresponds to the first chord of the first scale, wherein the second chord includes a second subset of the second plurality of musical notes; and
associate the first key with the second chord.

15. The system of claim 13, wherein the first scale is associated with a first root note and a first musical mode, the system further comprising:
a second plurality of keys; and
computer-executable instructions to:
determine actuation of a second key of the second plurality of keys;
determine a second scale associated with the second key, wherein the second scale includes a second plurality of musical notes and is associated with the first root note and a second musical mode that differs from the first musical mode;
determine a second chord of the second scale that corresponds to the first chord of the first scale, wherein the second chord includes a second subset of the second plurality of musical notes; and
associate the first key with the second chord.

16. The system of claim 13, wherein the first scale is associated with a first root note and a first musical mode, the system further comprising:
a second plurality of keys; and
computer-executable instructions to:
determine actuation of a second key of the second plurality of keys;
determine a second scale associated with the second key, wherein the second scale includes a second plurality of musical notes and is associated with the first musical mode and a second root note that differs from the first root note;
determine a second chord of the second scale that corresponds to the first chord of the first scale, wherein the second chord includes a second subset of the second plurality of musical notes; and
associate the first key with the second chord.

17. The system of claim 13, further comprising:
a second plurality of keys; and
computer-executable instructions to:
determine actuation of a second key of the second plurality of keys;
determine a control function associated with the second key; and
based on the control function, one or more of:
add one or more musical notes of the first plurality of musical notes to the first chord; or
change a pitch associated with at least one musical note of the first subset.

18. The system of claim 13, further comprising:
a second plurality of keys; and
computer-executable instructions to:
determine actuation of the first key; and
in response to the actuation of the first key, associate a second key of the second plurality of keys with a first musical note within the first subset.

19. The system of claim 13, further comprising:
a second plurality of keys; and
computer-executable instructions to:
determine a second scale that includes a second plurality of musical notes;
determine a second chord that includes a second subset of the second plurality of musical notes;
associate a second key of the second plurality of keys with the second chord;
determine a characteristic of the first chord;
determine that the second chord includes the characteristic;
determine actuation of one of the first key or the second key; and
in response to the actuation of the one of the first key or the second key, provide a visible indicia in association with the other of the first key or the second key.

20. The system of claim 13, further comprising:
a second plurality of keys; and
computer-executable instructions to:
determine actuation of the first key;
determine actuation of a second key of the second plurality of keys, wherein the second key is associated with a period of time;
associate the first chord with the second key;

receive user input indicating output associated with the second plurality of keys;

determine occurrence of the period of time associated with the second key;

determine that the first chord is associated with the second key; and generate output data that corresponds to the first chord.

* * * * *